US007467920B2

(12) United States Patent
Sullivan et al.

(10) Patent No.: US 7,467,920 B2
(45) Date of Patent: Dec. 23, 2008

(54) FIRST AND SECOND STAGE TURBINE AIRFOIL SHAPES

(75) Inventors: Michael Adelbert Sullivan, Woodstock, GA (US); Dale W. Ladoon, Erie, PA (US); Ferruccio Candela, Florence (IT); Adam J. Fredmonski, Miami, FL (US)

(73) Assignee: General Electric Company, Schenectady, NY (US)

( * ) Notice: Subject to any disclaimer, the term of this patent is extended or adjusted under 35 U.S.C. 154(b) by 39 days.

(21) Appl. No.: 11/648,906

(22) Filed: Jan. 3, 2007

(65) Prior Publication Data

US 2008/0175707 A1 Jul. 24, 2008

Related U.S. Application Data

(63) Continuation of application No. 11/090,300, filed on Mar. 28, 2005, now abandoned.

(51) Int. Cl.
*F01D 9/04* (2006.01)
*F01D 5/14* (2006.01)

(52) U.S. Cl. ..... 415/193; 415/191; 415/208.2; 415/209.1; 415/211.2; 416/223 A; 416/243; 416/DIG. 2

(58) Field of Classification Search ..... 415/191, 415/193, 208.1, 208.2, 209.1, 210.1, 211.2; 416/223 R, 223 A, 243, DIG. 2
See application file for complete search history.

(56) References Cited

U.S. PATENT DOCUMENTS 6,398,489 B1 6/2002 Burdgick et al.
6,450,770 B1 9/2002 Wang et al.
6,461,109 B1 10/2002 Wedlake et al.
6,461,110 B1 10/2002 By et al.
6,474,948 B1 11/2002 Pirolla et al.
6,503,054 B1 1/2003 Bielek et al.
6,503,059 B1 1/2003 Frost et al.
6,558,122 B1 5/2003 Xu et al.
6,685,434 B1 2/2004 Humanchuk et al.
6,715,990 B1 4/2004 Arness et al.

(Continued)

OTHER PUBLICATIONS

U.S. Appl. No. 10/900,200, filed Jul. 28, 2004, entitled: Airfoil Shape and Sidewall Flowpath Surfaces for a Turbine Nozzle.

(Continued)

*Primary Examiner*—Christopher Verdier
(74) *Attorney, Agent, or Firm*—Nixon & Vanderhye, PC

(57) ABSTRACT

The first stage nozzles and buckets have nominal airfoil profiles substantially in accordance with Cartesian coordinate values of X, Y and R set forth in Tables I and II, respectively, and second stage nozzles and buckets have nominal airfoil profiles substantially in accordance with Cartesian coordinate values set forth in Tables III and IV, respectively. The X, Y and R values are in millimeters. R represents distances along a radius from an axis of rotation of the turbine. For each airfoil, X and Y are distances which, when connected by smooth continuous arcs, define airfoil profile sections in planes normal to the radius at each distance R. The profile sections at the R distances for each airfoil are joined smoothly with one another to form the airfoil shape. The airfoil shapes given by the X, Y and R distances lie within envelopes of ±4.064 millimeters in a direction normal to any airfoil surface location therealong.

16 Claims, 5 Drawing Sheets

U.S. PATENT DOCUMENTS 6,722,852 B1 4/2004 Wedlake et al.
6,722,853 B1 4/2004 Humanchuk et al.
6,736,599 B1 * 5/2004 Jacks et al. ..... 415/191
6,739,838 B1 5/2004 Bielek et al.
6,739,839 B1 * 5/2004 Brown et al. ..... 416/223 A
6,761,535 B1 * 7/2004 McGrath et al. ..... 416/97 R
6,769,878 B1 * 8/2004 Parker et al. ..... 416/243
6,769,879 B1 8/2004 Cleveland et al.
6,779,977 B2 8/2004 Lagrange et al.
6,779,980 B1 8/2004 Brittingham et al.
6,808,368 B1 10/2004 Tomberg et al.
6,832,897 B2 12/2004 Urban
6,854,961 B2 2/2005 Zhang et al.
6,857,855 B1 2/2005 Snook et al.
6,866,477 B2 3/2005 Arness et al.
6,881,038 B1 4/2005 Beddard et al.
6,884,038 B2 4/2005 Hyde et al.
6,887,041 B2 * 5/2005 Coke et al. ..... 415/191
6,910,868 B2 6/2005 Hyde et al.
6,994,520 B2 * 2/2006 Humanchuk et al. ..... 415/191
7,001,147 B1 * 2/2006 Phillips et al. ..... 415/191
7,186,090 B2 * 3/2007 Tomberg et al. ..... 416/223 A

OTHER PUBLICATIONS

U.S. Appl. No. 10/853,240, filed May 26, 2004, entitled: Internal Core Profile for a Turbine Nozzle Airfoil.
U.S. Appl. No. 10/986,162, filed Nov. 12, 2004, entitled: Airfoil Shape for a Compressor Blade.
U.S. Appl. No. 11/226,264, filed Sep. 15, 2004, entitled: Rotor Blade for a First Phase of a Gas Turbine.

* cited by examiner

FIRST AND SECOND STAGE TURBINE AIRFOIL SHAPES

This application is a continuation of application Ser. No. 11/090,300, filed Mar. 28, 2005, now abandoned the entire content of which is hereby incorporated by reference in this application.

BACKGROUND OF THE INVENTION

The present invention relates to airfoil shapes for a gas turbine and particularly relates to nozzle and bucket airfoil shapes for the first and second stages of the gas turbine.

There are many considerations in the design and construction of nozzle and bucket airfoils for turbines, including optimized aerodynamic efficiency, aerodynamic and mechanical blade loading and the interaction between various stages of a gas turbine. For example, and with respect to turbine nozzles, the airfoil shape of the nozzles provides guided turning of the hot gases for interactions along the hot gas path among the various stages of the turbine with substantial effect on the overall efficiency of the turbine. Accordingly, there is a need for airfoil shapes for each of the first and second stage nozzles and buckets for optimizing the efficiency of the gas turbine.

BRIEF DESCRIPTION OF THE INVENTION

In a preferred embodiment of the invention, there is provided a turbine nozzle including an airfoil having an airfoil shape, the airfoil having a nominal profile substantially in accordance with Cartesian coordinate values of X, Y and R set forth in millimeters in Table I wherein R is a distance along a radius from an axis of rotation of the turbine and X and Y are distances which, when connected by smooth continuing arcs, define airfoil profile sections in planes normal to the radius and at each distance R, the profile sections at the R distances being joined smoothly with one another to form the airfoil shape.

In a further preferred embodiment of the present invention, there is provided a turbine bucket including an airfoil having an airfoil shape, the airfoil having a nominal profile substantially in accordance with Cartesian coordinate values of X, Y and R set forth in millimeters in Table II wherein R is a distance along a radius from an axis of rotation of the turbine and X and Y are distances which, when connected by smooth continuing arcs, define airfoil profile sections in planes normal to the radius and at each distance R, the profile sections at the R distances being joined smoothly with one another to form the airfoil shape.

In another embodiment of the present invention, there is provided a turbine nozzle including an airfoil having an airfoil shape, the airfoil having a nominal profile substantially in accordance with Cartesian coordinate values of X, Y and R set forth in millimeters in Table III wherein R is a distance along a radius from an axis of rotation of the turbine and X and Y are distances which, when connected by smooth continuous arcs, define airfoil profile sections in planes normal to the radius and at each distance R, the profile sections in planes normal to the radius and at the R distances being joined smoothly with one another to form the airfoil shape.

In another preferred embodiment of the present invention, there is provided a turbine bucket including an airfoil having an airfoil shape, the airfoil having a nominal profile substantially in accordance with Cartesian coordinate values of X, Y and R set forth in millimeters in Table IV wherein R is a distance along a radius from an axis of rotation of the turbine and X and Y are distances which, when connected by smooth continuous arcs, define airfoil profile sections in planes normal to the radius and at each distance R, the profile sections at the R distances being joined smoothly with one another to form the airfoil shape.

In a still further preferred embodiment of the present invention, there is provided a first stage of a turbine having a plurality of nozzles in a circumferential array thereof about a turbine axis and a plurality of buckets in a circumferential array thereof about the axis downstream of the nozzles, each nozzle including an airfoil having an airfoil shape, the airfoil having a nominal profile substantially in accordance with Cartesian coordinate values of X, Y and R set forth in millimeters in Table I wherein R is a distance along a radius from the axis of rotation of the turbine and X and Y are distances which, when connected by smooth continuing arcs, define airfoil profile sections in planes normal to the radius and at each distance R, the profile sections at the R distances being joined smoothly with one another to form the airfoil shape, each bucket including a bucket airfoil having an airfoil shape, the bucket airfoil having a nominal airfoil profile substantially in accordance with Cartesian coordinate values of X, Y and R set forth in millimeters Table II wherein R is a distance along a radius from the axis of rotation of the turbine and X and Y are distances which, when connected by smooth continuing arcs, define bucket airfoil profile sections in planes normal to the radius and at each distance R, the profile sections at the R distances of Table II being joined smoothly with one another to form the bucket airfoil shape.

In another embodiment of the present invention, there is provided a second stage of a turbine having a plurality of nozzles in a circumferential array thereof about a turbine axis and a plurality of buckets in a circumferential array thereof about the axis downstream of the nozzles, each nozzle including an airfoil having an airfoil shape, the bucket airfoil having a nominal profile substantially in accordance with Cartesian coordinate values of X, Y and R set forth in millimeters in Table III wherein R is a distance along a radius from the axis of rotation of the turbine and X and y are distances which, when connected by smooth continuous arcs, define airfoil profile sections in planes normal to the radius and at each distance R, the profile sections at the R distances being joined smoothly with one another to form the airfoil shape, each bucket including a bucket airfoil having an airfoil shape, the bucket airfoil having a nominal profile substantially in accordance with Cartesian coordinate values of X, Y and R set forth in millimeters in Table IV wherein R is a distance along a radius from the axis of rotation of the turbine and X and Y are distances which, when connected by smooth continuous arcs, define airfoil profile sections in planes normal to the radius and at each distance R, the profile sections at the R distances of Table IV being joined smoothly with one another to form the bucket airfoil shape.

DETAILED DESCRIPTION OF THE INVENTION

Figure 1:
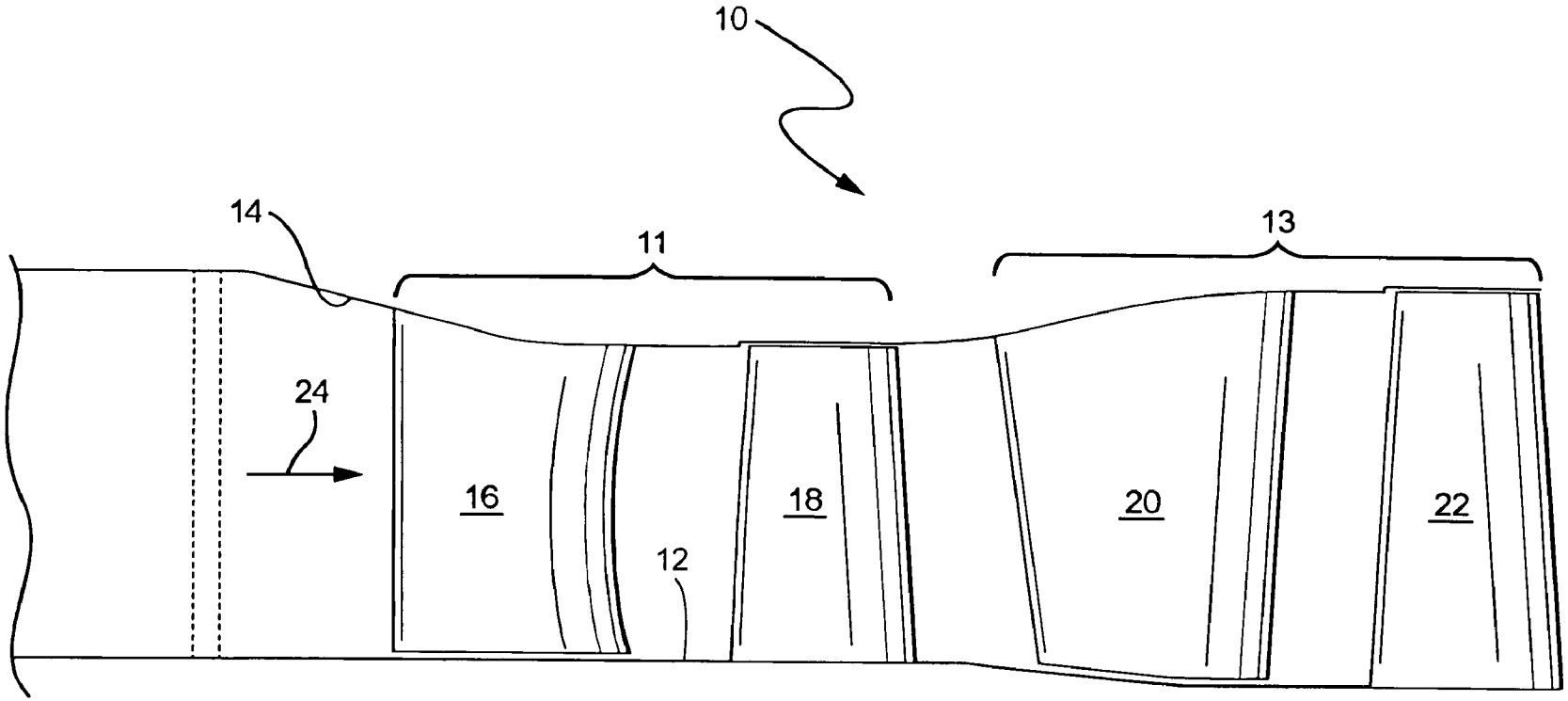
FIG. 1 is a generalized schematic illustration of the hot gas path of a turbine having first and second stage nozzle and bucket airfoil shapes in accordance with a preferred aspect of the present invention.

Referring now to FIG. 1, there is illustrated a portion of a turbine generally designated 10 and particularly the first and second stages 11 and 13, respectively of the turbine 10. Turbine 10 includes a rotor 12 and an outer casing 14. The first stage 11 of the gas turbine 10 includes a first stage nozzle having an array of circumferentially spaced nozzle airfoils 16 secured to casing 14 and an array of circumferentially spaced buckets 18 mounted on the rotor 12. The second stage 13 of the turbine includes an array of circumferentially spaced nozzle airfoils 20 secured to casing 14 and an array of circumferentially spaced buckets 22 mounted on the rotor 12. It will be appreciated that the turbine may include additional stages. Also, each of the nozzle and bucket airfoils have respective unique airfoil shapes for optimizing aerodynamic efficiency and aerodynamic and mechanical blade loading in the hot gas stream, generally indicated by the arrow 24, flowing in the annular hot gas flowpath.

A Cartesian coordinate system of X, Y and R values given in millimeters in Tables I-IV define the profile of the airfoils 16, 18, 20 and 22, respectively. The coordinate values for the X, Y and R coordinates are set forth in millimeters in these tables although other units of dimensions may be used. The Cartesian coordinate system has orthogonally related X, Y and R axes. The R axis is a linear distance in millimeters from an axis of rotation of the turbine and along a radius to a plane normal thereto containing the X and Y values which define airfoil profile sections at each distance R from the axis of rotation. The X axis extends in a direction parallel to the turbine rotor centerline, i.e. the axis of rotation, and the Y axis extends in a tangential direction By defining X and Y coordinate values in planes perpendicular to and at selected distances in an R direction, the profile of each airfoil can be ascertained. By connecting the X and Y values in each plane with smooth continuing arcs, each profile section at each distance R given in the Tables is fixed. The surface profiles at the various surface locations between the profile section planes at distances R are determined by smoothly connecting the adjacent profile sections to one another to form the airfoil shape.

The values set forth in Tables I-IV represent the airfoil profile sections at ambient non-operating or non-hot conditions. The values provided in Tables I-IV are generated and shown to three decimal places for determining the profiles of the airfoils. There are typical manufacturing tolerances as well as coatings which must be accounted for in the actual profile of each airfoil. Accordingly, the values for the profiles given in Tables I-IV are for nominal airfoils. It will therefore be appreciated that ± typical manufacturing tolerances, i.e., ± values, including any coating thicknesses, are additive to or subtractive from the X, Y values given in the tables below. Accordingly, a distance of ±4.064 mm in a direction normal to any surface location along each airfoil surface defines an airfoil profile envelope for the particular airfoil shape.

The coordinate values given in Table I below provide the preferred nominal profile shape excluding fillet regions for the first stage nozzle airfoil 16.

TABLE I

| Stage 1 Nozzle Airfoil | | | | | |
|---|---|---|---|---|---|
| X | Y | R | X | Y | R |
| 26.066 | 45.234 | 494.350 | −25.071 | −12.684 | 494.350 |
| 26.218 | 33.453 | 494.350 | −21.845 | −20.450 | 494.350 |

TABLE I-continued

| Stage 1 Nozzle Airfoil | | | | | |
|---|---|---|---|---|---|
| X | Y | R | X | Y | R |
| 28.217 | 50.428 | 494.350 | −21.643 | −5.060 | 494.350 |
| 18.693 | 31.651 | 494.350 | −16.402 | −24.581 | 494.350 |
| 29.153 | 48.638 | 494.350 | −24.927 | −10.973 | 494.350 |
| 23.042 | 39.061 | 494.350 | −22.905 | −19.098 | 494.350 |
| 27.656 | 40.176 | 494.350 | −20.385 | −3.888 | 494.350 |
| 26.751 | 46.810 | 494.350 | −17.903 | −23.745 | 494.350 |
| 25.843 | 31.775 | 494.350 | −24.487 | −9.314 | 494.350 |
| 28.535 | 50.650 | 494.350 | −23.795 | −17.629 | 494.350 |
| 19.613 | 33.103 | 494.350 | −19.054 | −2.801 | 494.350 |
| 28.900 | | 494.350 | −19.321 | −22.775 | 494.350 |
| 23.836 | 40.585 | 494.350 | −23.753 | −7.762 | 494.350 |
| 27.308 | 38.493 | 494.350 | −24.480 | −16.054 | 494.350 |
| 27.402 | 48.401 | 494.350 | −17.677 | −1.773 | 494.350 |
| 25.463 | 30.099 | 494.350 | −20.642 | −21.677 | 494.350 |
| 28.920 | 50.629 | 494.350 | −6.404 | −26.515 | 494.350 |
| 20.508 | 34.570 | 494.350 | −14.832 | −25.280 | 494.350 |
| 28.620 | 45.242 | 494.350 | 0.163 | −24.622 | 494.350 |
| 24.606 | 42.122 | 494.350 | −8.121 | −26.587 | 494.350 |
| 26.951 | 36.812 | 494.350 | −14.844 | 0.174 | 494.350 |
| 29.226 | 50.394 | 494.350 | −1.404 | −25.327 | 494.350 |
| 21.378 | 36.053 | 494.350 | −9.837 | −26.494 | 494.350 |
| 28.315 | 43.550 | 494.350 | −13.407 | 1.117 | 494.350 |
| 25.350 | 43.671 | 494.350 | −3.031 | −25.880 | 494.350 |
| 26.587 | 35.132 | 494.350 | −11.536 | −26.242 | 494.350 |
| 17.747 | 30.215 | 494.350 | −11.968 | 2.058 | 494.350 |
| 29.338 | 50.024 | 494.350 | −4.702 | −26.278 | 494.350 |
| 22.222 | 37.550 | 494.350 | −13.206 | −25.835 | 494.350 |
| 27.992 | 41.862 | 494.350 | 3.166 | 13.359 | 494.350 |
| −3.486 | 7.921 | 494.350 | 9.268 | 19.406 | 494.350 |
| −9.100 | 3.954 | 494.350 | 4.433 | 14.520 | 494.350 |
| −2.118 | 8.962 | 494.350 | 10.417 | 20.685 | 494.350 |
| −7.678 | 4.919 | 494.350 | 5.677 | 15.706 | 494.350 |
| −0.768 | 10.025 | 494.350 | 11.540 | 21.986 | 494.350 |
| −6.267 | 5.901 | 494.350 | 6.898 | 16.916 | 494.350 |
| 0.564 | 11.112 | 494.350 | 12.638 | 23.308 | 494.350 |
| −4.870 | 6.901 | 494.350 | 1.876 | 12.223 | 494.350 |
| −10.532 | 3.002 | 494.350 | 8.095 | 18.149 | 494.350 |
| −22.785 | −6.343 | 494.350 | 13.711 | 24.651 | 494.350 |
| −24.918 | −14.394 | 494.350 | 20.418 | 10.101 | 494.350 |
| −16.270 | −0.786 | 494.350 | 24.290 | 25.078 | 494.350 |
| 22.220 | 16.736 | 494.350 | 16.527 | 29.543 | 500.230 |
| 14.758 | 26.014 | 494.350 | 24.373 | 28.905 | 500.230 |
| 19.940 | 8.450 | 494.350 | 20.998 | 36.953 | 500.230 |
| 23.888 | 23.406 | 494.350 | 27.584 | 44.153 | 500.230 |
| 21.784 | 15.074 | 494.350 | 24.824 | 44.717 | 500.230 |
| 15.780 | 27.396 | 494.350 | 25.871 | 35.667 | 500.230 |
| 19.449 | 6.803 | 494.350 | 17.473 | 30.992 | 500.230 |
| 23.481 | 21.736 | 494.350 | 23.987 | 27.217 | 500.230 |
| 21.339 | 13.413 | 494.350 | 28.494 | 51.317 | 500.230 |
| 16.776 | 28.797 | 494.350 | 21.814 | 38.480 | 500.230 |
| 25.077 | 28.424 | 494.350 | 27.266 | 42.451 | 500.230 |
| 18.942 | 5.161 | 494.350 | 25.510 | 46.307 | 500.230 |
| 23.068 | 20.068 | 494.350 | 25.504 | 33.975 | 500.230 |
| 20.884 | 11.756 | 494.350 | 18.394 | 32.459 | 500.230 |
| 24.686 | 26.750 | 494.350 | 28.400 | 49.283 | 500.230 |
| 18.418 | 3.523 | 494.350 | 28.610 | 50.942 | 500.230 |
| 22.648 | 18.401 | 494.350 | 22.604 | 40.021 | 500.230 |
| 11.797 | −12.309 | 494.350 | 26.933 | 40.752 | 500.230 |
| 6.876 | −19.334 | 494.350 | 26.165 | 47.910 | 500.230 |
| 10.930 | −13.794 | 494.350 | 25.132 | 32.284 | 500.230 |
| 5.690 | −20.578 | 494.350 | 27.480 | 51.333 | 500.230 |
| 10.010 | −15.245 | 494.350 | 19.288 | 33.942 | 500.230 |
| 4.426 | −21.743 | 494.350 | 28.157 | 47.569 | 500.230 |
| 9.031 | −16.658 | 494.350 | −7.679 | 5.069 | 500.230 |
| 3.082 | −22.814 | 494.350 | −0.793 | 10.314 | 500.230 |
| 12.617 | −10.799 | 494.350 | −13.398 | 1.163 | 500.230 |
| 7.988 | −18.024 | 494.350 | −6.271 | 6.078 | 500.230 |
| 1.660 | −23.779 | 494.350 | 0.532 | 11.429 | 500.230 |
| 17.876 | 1.892 | 494.350 | −11.961 | 2.129 | 500.230 |
| 14.826 | −6.140 | 494.350 | −4.878 | 7.106 | 500.230 |
| 17.315 | 0.268 | 494.350 | −10.526 | 3.098 | 500.230 |
| 14.128 | −7.711 | 494.350 | −3.499 | 8.153 | 500.230 |
| 16.731 | −1.349 | 494.350 | −9.098 | 4.077 | 500.230 |
| 13.393 | −9.265 | 494.350 | −2.137 | 9.222 | 500.230 |
| 16.125 | −2.958 | 494.350 | −14.834 | 0.195 | 500.230 |

TABLE I-continued

| Stage 1 Nozzle Airfoil | | | | | |
|---|---|---|---|---|---|
| X | Y | R | X | Y | R |
| 15.490 | −4.555 | 494.350 | −16.360 | −24.862 | 500.230 |
| 27.795 | 51.563 | 500.230 | −24.926 | −11.112 | 500.230 |
| 28.183 | 51.550 | 500.230 | −22.878 | −19.293 | 500.230 |
| 15.554 | 28.110 | 500.230 | −20.373 | −3.956 | 500.230 |
| 23.370 | 41.574 | 500.230 | −17.862 | −24.002 | 500.230 |
| 26.588 | 39.055 | 500.230 | −24.483 | −9.440 | 500.230 |
| 26.787 | 49.526 | 500.230 | −23.776 | −17.813 | 500.230 |
| 24.755 | 30.594 | 500.230 | −25.071 | −12.835 | 500.230 |
| 20.156 | 35.440 | 500.230 | −19.042 | −2.848 | 500.230 |
| 27.883 | 45.859 | 500.230 | −19.282 | −23.012 | 500.230 |
| 24.109 | 43.140 | 500.230 | −23.747 | −7.875 | 500.230 |
| 26.233 | 37.361 | 500.230 | −24.470 | −16.229 | 500.230 |
| −17.666 | −1.798 | 500.230 | 13.188 | −9.256 | 500.230 |
| −20.605 | −21.897 | 500.230 | 9.025 | −16.835 | 500.230 |
| −22.775 | −6.444 | 500.230 | 3.206 | −23.196 | 500.230 |
| −24.916 | −14.557 | 500.230 | 12.453 | −10.823 | 500.230 |
| −16.260 | −0.788 | 500.230 | 8.018 | −18.243 | 500.230 |
| −21.812 | −20.656 | 500.230 | 1.791 | −24.193 | 500.230 |
| −21.631 | −5.145 | 500.230 | 11.674 | −12.370 | 500.230 |
| −1.280 | −25.782 | 500.230 | 6.938 | −19.597 | 500.230 |
| −9.776 | −26.892 | 500.230 | 10.847 | −13.891 | 500.230 |
| −2.918 | −26.342 | 500.230 | 16.892 | 0.446 | 500.230 |
| −11.484 | −26.610 | 500.230 | 13.884 | −7.670 | 500.230 |
| −4.603 | −26.736 | 500.230 | 16.341 | −1.196 | 500.230 |
| −13.159 | −26.172 | 500.230 | 15.769 | −2.831 | 500.230 |
| −6.320 | −26.961 | 500.230 | 15.171 | −4.455 | 500.230 |
| −14.788 | −25.588 | 500.230 | 14.544 | −6.069 | 500.230 |
| 0.293 | −25.061 | 500.230 | 27.748 | 52.275 | 506.110 |
| −8.050 | −27.012 | 500.230 | 28.062 | 52.044 | 506.110 |
| 10.289 | 21.241 | 500.230 | 27.964 | 49.842 | 506.110 |
| 5.606 | 16.141 | 500.230 | 27.044 | 52.049 | 506.110 |
| 11.395 | 22.573 | 500.230 | 28.176 | 51.669 | 506.110 |
| 6.815 | 17.381 | 500.230 | 26.423 | 50.363 | 506.110 |
| 12.475 | 23.927 | 500.230 | 27.357 | 52.285 | 506.110 |
| 1.835 | 12.569 | 500.230 | 16.477 | 30.050 | 506.110 |
| 7.999 | 18.644 | 500.230 | 13.530 | 25.730 | 506.110 |
| 13.528 | 25.302 | 500.230 | 14.540 | 27.151 | 506.110 |
| 3.116 | 13.735 | 500.230 | 15.523 | 28.591 | 506.110 |
| 9.157 | 19.931 | 500.230 | 24.037 | 29.299 | 506.110 |
| 4.373 | 14.925 | 500.230 | 20.835 | 37.596 | 506.110 |
| 23.202 | 23.844 | 500.230 | 27.170 | 44.672 | 506.110 |
| 21.153 | 15.432 | 500.230 | 24.532 | 45.488 | 506.110 |
| 18.914 | 7.069 | 500.230 | 25.501 | 36.117 | 506.110 |
| 22.803 | 22.159 | 500.230 | 17.403 | 31.527 | 506.110 |
| 20.724 | 13.755 | 500.230 | 23.660 | 27.597 | 506.110 |
| 18.433 | 5.406 | 500.230 | 21.626 | 39.150 | 506.110 |
| 22.399 | 20.475 | 500.230 | 26.862 | 42.957 | 506.110 |
| 20.286 | 12.080 | 500.230 | 25.193 | 47.101 | 506.110 |
| 17.936 | 3.747 | 500.230 | 25.143 | 34.411 | 506.110 |
| 21.990 | 18.793 | 500.230 | 18.302 | 33.021 | 506.110 |
| 19.840 | 10.407 | 500.230 | 23.277 | 25.896 | 506.110 |
| 23.596 | 25.530 | 500.230 | 22.391 | 40.716 | 506.110 |
| 17.423 | 2.094 | 500.230 | 26.538 | 41.243 | 506.110 |
| 21.575 | 17.112 | 500.230 | 25.823 | 48.726 | 506.110 |
| 14.554 | 26.697 | 500.230 | 24.779 | 32.706 | 506.110 |
| 19.383 | 8.736 | 500.230 | 19.173 | 34.531 | 506.110 |
| 5.779 | −20.882 | 500.230 | 27.725 | 48.115 | 506.110 |
| 9.967 | −15.382 | 500.230 | 23.130 | 42.295 | 506.110 |
| 4.535 | −22.087 | 500.230 | 26.201 | 39.533 | 506.110 |
| 24.411 | 31.002 | 506.110 | −2.816 | −26.666 | 506.110 |
| 20.018 | 36.056 | 506.110 | 6.867 | 17.675 | 506.110 |
| 27.459 | 46.392 | 506.110 | 12.490 | 24.330 | 506.110 |
| 23.844 | 43.886 | 506.110 | 8.048 | 18.958 | 506.110 |
| 25.854 | 37.824 | 506.110 | 3.170 | 13.976 | 506.110 |
| −17.628 | −1.833 | 506.110 | 9.201 | 20.265 | 506.110 |
| −16.225 | −0.798 | 506.110 | 4.428 | 15.183 | 506.110 |
| −14.803 | 0.210 | 506.110 | 10.326 | 21.597 | 506.110 |
| 0.582 | 11.640 | 506.110 | 5.661 | 16.416 | 506.110 |
| −11.933 | 2.191 | 506.110 | 11.422 | 22.952 | 506.110 |
| −4.841 | 7.258 | 506.110 | 18.222 | 5.597 | 506.110 |
| 1.888 | 12.795 | 506.110 | 22.105 | 20.799 | 506.110 |
| −10.499 | 3.181 | 506.110 | 20.035 | 12.331 | 506.110 |
| −3.459 | 8.321 | 506.110 | 17.738 | 3.923 | 506.110 |
| −9.069 | 4.179 | 506.110 | 21.704 | 19.102 | 506.110 |
| −2.093 | 9.404 | 506.110 | 19.598 | 10.643 | 506.110 |

TABLE I-continued

| Stage 1 Nozzle Airfoil | | | | | |
|---|---|---|---|---|---|
| X | Y | R | X | Y | R |
| −7.648 | 5.189 | 506.110 | 17.237 | 2.253 | 506.110 |
| −0.746 | 10.510 | 506.110 | 21.297 | 17.407 | 506.110 |
| −13.369 | 1.202 | 506.110 | 19.151 | 8.958 | 506.110 |
| −6.238 | 6.215 | 506.110 | 22.891 | 24.196 | 506.110 |
| −19.002 | −2.907 | 506.110 | 16.720 | 0.588 | 506.110 |
| −19.275 | −23.249 | 506.110 | 20.884 | 15.713 | 506.110 |
| −23.708 | −8.001 | 506.110 | 18.693 | 7.276 | 506.110 |
| −24.478 | −16.405 | 506.110 | 22.500 | 22.497 | 506.110 |
| −20.605 | −22.123 | 506.110 | 16.184 | −1.071 | 506.110 |
| −22.729 | −6.560 | 506.110 | 20.463 | 14.021 | 506.110 |
| −24.918 | −14.720 | 506.110 | 9.057 | −16.930 | 506.110 |
| −14.759 | −25.859 | 506.110 | 3.315 | −23.439 | 506.110 |
| −21.818 | −20.872 | 506.110 | 12.401 | −10.817 | 506.110 |
| −25.071 | −12.986 | 506.110 | 8.070 | −18.367 | 506.110 |
| −21.585 | −5.246 | 506.110 | 11.643 | −12.387 | 506.110 |
| −16.339 | −25.122 | 506.110 | 7.008 | −19.750 | 506.110 |
| −24.918 | −11.251 | 506.110 | 14.435 | −6.000 | 506.110 |
| −22.888 | −19.496 | 506.110 | 10.837 | −13.933 | 506.110 |
| −20.329 | −4.037 | 506.110 | 5.866 | −21.066 | 506.110 |
| −17.848 | −24.250 | 506.110 | 13.794 | −7.621 | 506.110 |
| −24.459 | −9.572 | 506.110 | 9.977 | −15.450 | 506.110 |
| −23.786 | −18.004 | 506.110 | 4.635 | −22.301 | 506.110 |
| −11.438 | −26.906 | 506.110 | 13.117 | −9.228 | 506.110 |
| −4.513 | −27.066 | 506.110 | 15.627 | −2.724 | 506.110 |
| −13.122 | −26.455 | 506.110 | 15.045 | −4.367 | 506.110 |
| 1.905 | −24.463 | 506.110 | 27.475 | 52.958 | 511.990 |
| −6.241 | −27.289 | 506.110 | 24.975 | 47.788 | 511.990 |
| 0.408 | −25.356 | 506.110 | 27.682 | 50.447 | 511.990 |
| −7.983 | −27.333 | 506.110 | 27.790 | 52.731 | 511.990 |
| −1.170 | −26.095 | 506.110 | 25.588 | 49.432 | 511.990 |
| −9.721 | −27.202 | 506.110 | 27.441 | 48.709 | 511.990 |
| 27.897 | 52.364 | 511.990 | −6.218 | 6.338 | 511.990 |
| 26.174 | 51.087 | 511.990 | 0.631 | 11.822 | 511.990 |
| 26.765 | 52.730 | 511.990 | −11.929 | 2.254 | 511.990 |
| 27.174 | 46.974 | 511.990 | −4.816 | 7.394 | 511.990 |
| 27.078 | 52.968 | 511.990 | 1.942 | 12.989 | 511.990 |
| 13.567 | 26.094 | 511.990 | −20.579 | −22.341 | 511.990 |
| 14.567 | 27.537 | 511.990 | −22.710 | −6.664 | 511.990 |
| 15.537 | 29.000 | 511.990 | −24.917 | −14.882 | 511.990 |
| 11.477 | 23.274 | 511.990 | −14.712 | −26.131 | 511.990 |
| 16.477 | 30.482 | 511.990 | −21.797 | −21.078 | 511.990 |
| 12.537 | 24.673 | 511.990 | −21.571 | −5.329 | 511.990 |
| 17.388 | 31.982 | 511.990 | −16.298 | −25.380 | 511.990 |
| 21.513 | 39.725 | 511.990 | −24.914 | −11.390 | 511.990 |
| 26.579 | 43.514 | 511.990 | −22.872 | −19.691 | 511.990 |
| 24.878 | 34.905 | 511.990 | −17.813 | −24.494 | 511.990 |
| 18.269 | 33.500 | 511.990 | −24.446 | −9.701 | 511.990 |
| 23.039 | 26.323 | 511.990 | −23.776 | −18.188 | 511.990 |
| 22.257 | 41.315 | 511.990 | −19.245 | −23.480 | 511.990 |
| 26.257 | 41.789 | 511.990 | −23.688 | −8.120 | 511.990 |
| 24.519 | 33.186 | 511.990 | −24.472 | −16.578 | 511.990 |
| 19.122 | 35.034 | 511.990 | −25.071 | −13.136 | 511.990 |
| 22.659 | 24.609 | 511.990 | 2.016 | −24.639 | 511.990 |
| 22.974 | 42.917 | 511.990 | −6.143 | −27.588 | 511.990 |
| 25.924 | 40.065 | 511.990 | 0.526 | −25.565 | 511.990 |
| 24.155 | 31.469 | 511.990 | −7.896 | −27.638 | 511.990 |
| 19.946 | 36.584 | 511.990 | −1.051 | −26.334 | 511.990 |
| 22.275 | 22.897 | 511.990 | −9.646 | −27.505 | 511.990 |
| 23.666 | 44.530 | 511.990 | −2.701 | −26.932 | 511.990 |
| 25.581 | 38.344 | 511.990 | −11.374 | −27.202 | 511.990 |
| 23.787 | 29.753 | 511.990 | −4.404 | −27.351 | 511.990 |
| 20.743 | 38.148 | 511.990 | −13.067 | −26.741 | 511.990 |
| 26.886 | 45.242 | 511.990 | 8.113 | 19.224 | 511.990 |
| 24.334 | 46.154 | 511.990 | 14.954 | −4.201 | 511.990 |
| 25.232 | 36.624 | 511.990 | 3.229 | 14.183 | 511.990 |
| 23.415 | 28.037 | 511.990 | 9.264 | 20.549 | 511.990 |
| −16.220 | −0.797 | 511.990 | 4.490 | 15.404 | 511.990 |
| −14.799 | 0.233 | 511.990 | 10.386 | 21.899 | 511.990 |
| −20.319 | −4.099 | 511.990 | 5.725 | 16.651 | 511.990 |
| −18.993 | −2.950 | 511.990 | 6.933 | 17.925 | 511.990 |
| −17.621 | −1.854 | 511.990 | 21.492 | 19.475 | 511.990 |
| −10.492 | 3.262 | 511.990 | 19.423 | 10.946 | 511.990 |
| −3.428 | 8.468 | 511.990 | 17.105 | 2.482 | 511.990 |
| −9.058 | 4.275 | 511.990 | 21.092 | 17.765 | 511.990 |
| −2.056 | 9.563 | 511.990 | 18.984 | 9.246 | 511.990 |

TABLE I-continued

| Stage 1 Nozzle Airfoil | | | | | |
|---|---|---|---|---|---|
| X | Y | R | X | Y | R |
| −7.633 | 5.300 | 511.990 | 16.597 | 0.802 | 511.990 |
| −0.702 | 10.680 | 511.990 | 20.686 | 16.058 | 511.990 |
| −13.366 | 1.247 | 511.990 | 18.534 | 7.550 | 511.990 |
| 16.071 | −0.873 | 511.990 | 22.606 | 24.981 | 517.870 |
| 20.273 | 14.352 | 511.990 | 22.905 | 43.456 | 517.870 |
| 18.072 | 5.856 | 511.990 | 25.837 | 40.552 | 517.870 |
| 21.886 | 21.185 | 511.990 | 24.085 | 31.892 | 517.870 |
| 15.524 | −2.541 | 511.990 | 19.911 | 37.055 | 517.870 |
| 19.852 | 12.648 | 511.990 | 22.227 | 23.255 | 517.870 |
| 17.596 | 4.167 | 511.990 | 25.497 | 38.818 | 517.870 |
| 11.616 | −12.313 | 511.990 | 23.722 | 30.163 | 517.870 |
| 7.063 | −19.797 | 511.990 | 20.699 | 38.637 | 517.870 |
| 14.355 | −5.851 | 511.990 | 21.842 | 21.530 | 517.870 |
| 10.825 | −13.880 | 511.990 | 25.151 | 37.085 | 517.870 |
| 5.937 | −21.142 | 511.990 | 23.354 | 28.435 | 517.870 |
| 13.726 | −7.490 | 511.990 | 21.459 | 40.232 | 517.870 |
| 9.982 | −15.419 | 511.990 | 21.453 | 19.807 | 517.870 |
| 4.722 | −22.409 | 511.990 | 24.800 | 35.353 | 517.870 |
| 13.062 | −9.114 | 511.990 | 22.982 | 26.708 | 517.8.70 |
| 9.078 | −16.923 | 511.990 | 22.195 | 41.838 | 517.870 |
| 3.416 | −23.580 | 511.990 | 26.170 | 42.287 | 517.870 |
| 12.360 | −10.723 | 511.990 | −21.576 | −5.405 | 517.870 |
| 8.107 | −18.386 | 511.990 | −14.813 | 0.259 | 517.870 |
| 25.508 | 50.027 | 517.870 | −20.330 | −4.152 | 517.870 |
| 27.353 | 49.255 | 517.870 | −13.377 | 1.288 | 517.870 |
| 27.717 | 53.328 | 517.870 | −19.007 | −2.981 | 517.870 |
| 26.095 | 51.693 | 517.870 | −17.637 | −1.865 | 517.870 |
| 27.086 | 47.508 | 517.870 | −22.707 | −6.761 | 517.870 |
| 27.818 | 52.964 | 517.870 | −16.236 | −0.789 | 517.870 |
| 23.592 | 45.084 | 517.870 | −2.009 | 9.685 | 517.870 |
| 26.684 | 53.326 | 517.870 | −7.618 | 5.386 | 517.870 |
| 26.797 | 45.765 | 517.870 | −0.648 | 10.812 | 517.870 |
| 24.256 | 46.722 | 517.870 | −6.195 | 6.434 | 517.870 |
| 27.000 | 53.566 | 517.870 | 0.692 | 11.965 | 517.870 |
| 26.490 | 44.025 | 517.870 | −11.935 | 2.309 | 517.870 |
| 24.894 | 48.369 | 517.870 | −4.785 | 7.498 | 517.870 |
| 27.596 | 51.005 | 517.870 | 2.008 | 13.144 | 517.870 |
| 27.401 | 53.554 | 517.870 | −10.491 | 3.329 | 517.870 |
| 14.596 | 27.888 | 517.870 | −3.388 | 8.581 | 517.870 |
| 10.447 | 22.169 | 517.870 | 3.298 | 14.351 | 517.870 |
| 15.556 | 29.372 | 517.870 | −9.051 | 4.352 | 517.870 |
| 11.532 | 23.564 | 517.870 | −25.071 | −13.286 | 517.870 |
| 16.485 | 30.875 | 517.870 | −16.244 | −25.636 | 517.870 |
| 12.585 | 24.983 | 517.870 | −24.911 | −11.529 | 517.870 |
| 17.385 | 32.396 | 517.870 | −22.839 | −19.879 | 517.870 |
| 13.606 | 26.425 | 517.870 | −17.763 | −24.734 | 517.870 |
| 18.255 | 33.933 | 517.870 | −24.439 | −9.828 | 517.870 |
| 9.330 | 20.800 | 517.870 | −23.751 | −18.367 | 517.870 |
| 24.445 | 33.622 | 517.870 | −19.199 | −23.704 | 517.870 |
| 19.097 | 35.487 | 517.870 | −23.681 | −8.234 | 517.870 |
| −24.458 | −16.749 | 517.870 | 27.871 | 53.803 | 523.750 |
| −12.999 | −27.022 | 517.870 | 23.672 | 45.558 | 523.750 |
| −20.537 | −22.552 | 517.870 | 26.937 | 46.156 | 523.750 |
| −24.912 | −15.043 | 517.870 | 27.970 | 53.434 | 523.750 |
| −14.652 | −26.401 | 517.870 | 24.350 | 47.203 | 523.750 |
| −21.759 | −21.276 | 517.870 | 26.831 | 53.804 | 523.750 |
| −7.794 | −27.924 | 517.870 | 26.633 | 44.404 | 523.750 |
| −0.922 | −26.530 | 517.870 | 25.004 | 48.857 | 523.750 |
| −9.556 | −27.796 | 517.870 | 27.736 | 51.433 | 523.750 |
| −2.573 | −27.158 | 517.870 | 27.150 | 54.044 | 523.750 |
| −11.296 | −27.491 | 517.870 | 22.252 | 42.296 | 523.750 |
| 3.525 | −23.680 | 517.870 | 26.315 | 42.653 | 523.750 |
| −4.282 | −27.603 | 517.870 | 25.634 | 50.520 | 523.750 |
| 2.135 | −24.770 | 517.870 | 27.492 | 49.671 | 523.750 |
| −6.029 | −27.861 | 517.870 | 27.554 | 54.032 | 523.750 |
| 0.651 | −25.728 | 517.870 | 22.973 | 43.922 | 523.750 |
| 4.561 | 15.586 | 517.870 | 26.237 | 52.194 | 523.750 |
| 5.797 | 16.849 | 517.870 | 11.599 | 23.845 | 523.750 |
| 16.077 | −0.698 | 517.870 | 16.525 | 31.246 | 523.750 |
| 7.004 | 18.140 | 517.870 | 7.093 | 18.342 | 523.750 |
| 15.534 | −2.380 | 517.870 | 12.646 | 25.283 | 523.750 |
| 8.182 | 19.456 | 517.870 | 17.422 | 32.783 | 523.750 |
| 14.967 | −4.053 | 517.870 | 8.267 | 19.678 | 523.750 |
| 14.373 | −5.717 | 517.870 | 13.661 | 26.744 | 523.750 |
| 18.969 | 9.500 | 517.870 | 18.291 | 34.335 | 523.750 |

TABLE I-continued

| Stage 1 Nozzle Airfoil | | | | | |
|---|---|---|---|---|---|
| X | Y | R | X | Y | R |
| 16.600 | 0.990 | 517.870 | 9.410 | 21.041 | 523.750 |
| 20.655 | 16.364 | 517.870 | 14.646 | 28.226 | 523.750 |
| 18.523 | 7.790 | 517.870 | 10.521 | 22.430 | 523.750 |
| 20.246 | 14.645 | 517.870 | 15.600 | 29.727 | 523.750 |
| 18.065 | 6.084 | 517.870 | 19.950 | 37.482 | 523.750 |
| 19.830 | 12.928 | 517.870 | 22.416 | 23.479 | 523.750 |
| 17.592 | 4.381 | 517.870 | 25.650 | 39.158 | 523.750 |
| 19.404 | 11.213 | 517.870 | 23.897 | 30.439 | 523.750 |
| 17.104 | 2.683 | 517.870 | 20.741 | 39.075 | 523.750 |
| 21.057 | 18.085 | 517.870 | 22.034 | 21.741 | 523.750 |
| 10.868 | −13.821 | 517.870 | 25.308 | 37.413 | 523.750 |
| 6.024 | −21.185 | 517.870 | 23.533 | 28.697 | 523.750 |
| 13.747 | −7.370 | 517.870 | 21.508 | 40.680 | 523.750 |
| 10.031 | −15.378 | 517.870 | 21.646 | 20.005 | 523.750 |
| 4.821 | −22.479 | 517.870 | 24.962 | 35.668 | 523.750 |
| 13.088 | −9.009 | 517.870 | 23.165 | 26.957 | 523.750 |
| 9.135 | −16.900 | 517.870 | 21.252 | 18.271 | 523.750 |
| 12.390 | −10.633 | 517.870 | 24.611 | 33.924 | 523.750 |
| 8.174 | −18.383 | 517.870 | 19.133 | 35.901 | 523.750 |
| 11.652 | −12.238 | 517.870 | 22.793 | 25.217 | 523.750 |
| 7.139 | −19.815 | 517.870 | 25.987 | 40.905 | 523.750 |
| 27.225 | 47.912 | 523.750 | 24.256 | 32.181 | 523.750 |
| −13.353 | 1.297 | 523.750 | 16.253 | −0.642 | 523.750 |
| −19.000 | −3.029 | 523.750 | 13.237 | −9.007 | 523.750 |
| −23.670 | −8.350 | 523.750 | 15.705 | −2.335 | 523.750 |
| −17.628 | −1.896 | 523.750 | 15.133 | −4.019 | 523.750 |
| −22.696 | −6.862 | 523.750 | 14.533 | −5.694 | 523.750 |
| −16.224 | −0.804 | 523.750 | 16.780 | 1.057 | 523.750 |
| −21.566 | −5.489 | 523.750 | 13.902 | −7.357 | 523.750 |
| −14.796 | 0.256 | 523.750 | 20.443 | 14.806 | 523.750 |
| −20.322 | −4.219 | 523.750 | 18.254 | 6.186 | 523.750 |
| −6.133 | 6.490 | 523.750 | 20.026 | 13.077 | 523.750 |
| 0.783 | 12.080 | 523.750 | 17.779 | 4.471 | 523.750 |
| −11.904 | 2.329 | 523.750 | 19.600 | 11.350 | 523.750 |
| −4.715 | 7.565 | 523.750 | 17.288 | 2.762 | 523.750 |
| 2.101 | 13.274 | 523.750 | 19.163 | 9.625 | 523.750 |
| −10.453 | 3.358 | 523.750 | 20.851 | 16.538 | 523.750 |
| −3.312 | 8.658 | 523.750 | 18.715 | 7.904 | 523.750 |
| 3.392 | 14.498 | 523.750 | 4.944 | −22.590 | 523.750 |
| −9.004 | 4.390 | 523.750 | 9.262 | −16.953 | 523.750 |
| −1.926 | 9.774 | 523.750 | 12.535 | −10.641 | 523.750 |
| 4.655 | 15.751 | 523.750 | 8.298 | −18.448 | 523.750 |
| −7.563 | 5.433 | 523.750 | 11.791 | −12.257 | 523.750 |
| −0.561 | 10.914 | 523.750 | 7.262 | −19.894 | 523.750 |
| −17.724 | −24.980 | 523.750 | 11.002 | −13.851 | 523.750 |
| −24.430 | −9.956 | 523.750 | 6.147 | −21.280 | 523.750 |
| −23.732 | −18.548 | 523.750 | 10.161 | −15.419 | 523.750 |
| −25.072 | −13.436 | 523.750 | 4.771 | 15.947 | 529.630 |
| −19.163 | −23.936 | 523.750 | 28.239 | 54.172 | 529.630 |
| −24.446 | −16.921 | 523.750 | 24.643 | 47.639 | 529.630 |
| −12.937 | −27.304 | 523.750 | 21.706 | 41.103 | 529.630 |
| −20.505 | −22.769 | 523.750 | 26.971 | 44.621 | 529.630 |
| −24.909 | −15.205 | 523.750 | 28.336 | 53.799 | 529.630 |
| −14.600 | −26.674 | 523.759 | 25.323 | 49.297 | 529.630 |
| −21.730 | −21.480 | 523.750 | 28.078 | 51.701 | 529.630 |
| −16.199 | −25.896 | 523.750 | 27.193 | 54.178 | 529.630 |
| −24.908 | −11.667 | 523.750 | 22.471 | 42.723 | 529.630 |
| −22.814 | −20.071 | 523.750 | 26.656 | 42.858 | 529.630 |
| −2.449 | −27.381 | 523.750 | 25.978 | 50.964 | 529.630 |
| −11.223 | −27.777 | 523.750 | 27.830 | 49.927 | 529.630 |
| 3.650 | −23.810 | 523.750 | 27.514 | 54.418 | 529.630 |
| −4.165 | −27.849 | 523.750 | 23.215 | 44.353 | 529.630 |
| 2.263 | −24.922 | 523.750 | 26.332 | 41.096 | 529.630 |
| −5.921 | −28.126 | 523.750 | 26.606 | 52.642 | 529.630 |
| 0.780 | −25.904 | 523.750 | 27.561 | 48.156 | 529.630 |
| −7.697 | −28.201 | 523.750 | 27.921 | 54.405 | 529.630 |
| −0.795 | −26.730 | 523.750 | 23.939 | 45.992 | 529.630 |
| −9.471 | −28.080 | 523.750 | 26.001 | 39.335 | 529.630 |
| 5.889 | 17.032 | 523.750 | 20.919 | 39.493 | 529.630 |
| 27.273 | 46.387 | 529.630 | −8.875 | 4.375 | 529.630 |
| 12.740 | 25.615 | 529.630 | −1.792 | 9.857 | 529.630 |
| 17.542 | 33.174 | 529.630 | −7.431 | 5.435 | 529.630 |
| 8.369 | 19.939 | 529.630 | −0.429 | 11.019 | 529.630 |
| 13.757 | 27.090 | 529.630 | −5.998 | 6.511 | 529.630 |
| 18.423 | 34.734 | 529.630 | 0.912 | 12.207 | 529.630 |

TABLE I-continued

| Stage 1 Nozzle Airfoil | | | | | |
|---|---|---|---|---|---|
| X | Y | R | X | Y | R |
| 9.508 | 21.322 | 529.630 | −24.444 | −17.096 | 529.630 |
| 14.744 | 28.585 | 529.630 | −12.902 | −27.607 | 529.630 |
| 19.278 | 36.308 | 529.630 | −20.502 | −23.006 | 529.630 |
| 10.616 | 22.730 | 529.630 | −24.908 | −15.368 | 529.630 |
| 15.704 | 20.098 | 529.630 | −14.575 | −26.969 | 529.630 |
| 6.000 | 17.251 | 529.630 | −21.727 | −21.700 | 529.630 |
| 11.693 | 24.161 | 529.630 | −16.183 | −26.180 | 529.630 |
| 16.636 | 31.628 | 529.630 | −22.811 | −20.275 | 529.630 |
| 7.199 | 18.582 | 529.630 | −25.072 | −13.586 | 529.630 |
| 25.664 | 37.575 | 529.630 | −17.714 | −25.250 | 529.630 |
| 23.910 | 28.791 | 529.630 | −23.729 | −18.738 | 529.630 |
| 22.030 | 20.032 | 529.630 | −19.158 | −24.190 | 529.630 |
| 25.322 | 35.816 | 529.630 | −4.067 | −28.137 | 529.630 |
| 23.544 | 27.037 | 529.630 | 2.396 | −25.166 | 529.630 |
| 21.635 | 18.284 | 529.630 | −5.835 | −28.423 | 529.630 |
| 24.976 | 34.059 | 529.630 | 0.905 | −26.157 | 529.630 |
| 23.174 | 25.284 | 529.630 | −7.624 | −28.505 | 529.630 |
| 21.233 | 16.539 | 529.630 | −0.679 | −26.994 | 529.630 |
| 24.626 | 32.302 | 529.630 | −9.411 | −28.388 | 529.630 |
| 20.110 | 37.895 | 529.630 | 5.097 | −22.817 | 529.630 |
| 22.799 | 23.532 | 529.630 | −2.342 | −27.657 | 529.630 |
| 20.822 | 14.795 | 529.630 | −11.176 | −28.084 | 529.630 |
| 24.270 | 30.546 | 529.630 | 3.794 | −24.045 | 529.630 |
| 22.418 | 21.781 | 529.630 | 12.791 | −10.812 | 529.630 |
| −23.643 | −8.470 | 529.630 | 15.438 | −4.154 | 529.630 |
| −17.541 | −1.983 | 529.630 | 17.632 | 2.667 | 529.630 |
| −22.655 | −6.976 | 529.630 | 14.827 | −5.839 | 529.630 |
| −16.127 | −0.883 | 529.630 | 17.115 | 0.952 | 529.630 |
| −21.513 | −5.597 | 529.630 | 14.185 | −7.511 | 529.630 |
| −14.691 | 0.188 | 529.630 | 16.579 | −0.758 | 529.630 |
| −24.904 | −11.805 | 529.630 | 13.507 | −9.169 | 529.630 |
| −20.256 | −4.320 | 529.630 | 16.021 | −2.460 | 529.630 |
| −13.241 | 1.240 | 529.630 | 20.402 | 13.053 | 529.630 |
| −24.416 | −10.084 | 529.630 | 18.130 | 4.388 | 529.630 |
| −18.923 | −3.124 | 529.630 | 19.973 | 11.314 | 529.630 |
| −11.785 | 2.284 | 529.630 | 19.532 | 9.577 | 529.630 |
| −4.579 | 7.605 | 529.630 | 19.079 | 7.844 | 529.630 |
| 2.227 | 13.425 | 529.630 | 18.612 | 6.114 | 529.630 |
| −10.328 | 3.327 | 529.630 | 8.487 | −18.655 | 529.630 |
| −3.177 | 8.719 | 529.630 | 12.034 | −12.436 | 529.630 |
| 3.513 | 14.671 | 529.630 | 7.438 | −20.107 | 529.630 |
| 11.232 | −14.037 | 529.630 | 25.523 | 34.054 | 535.510 |
| 6.311 | −21.499 | 529.630 | 23.731 | 25.206 | 535.510 |
| 10.377 | −15.612 | 529.630 | 21.784 | 16.390 | 535.510 |
| 9.464 | −17.153 | 529.630 | 25.175 | 32.282 | 535.510 |
| 3.692 | 14.835 | 535.510 | 23.356 | 23.440 | 535.510 |
| 4.946 | 16.134 | 535.510 | 21.369 | 14.633 | 535.510 |
| 6.172 | 17.460 | 535.510 | 24.822 | 30.511 | 535.510 |
| 2.410 | 13.564 | 535.510 | 22.974 | 21.675 | 535.510 |
| 19.586 | 36.655 | 535.510 | 20.945 | 12.878 | 535.510 |
| 20.442 | 38.245 | 535.510 | 24.464 | 28.742 | 535.510 |
| 28.617 | 51.841 | 535.510 | 22.585 | 19.911 | 535.510 |
| 22.883 | 43.080 | 535.510 | 25.866 | 35.827 | 535.510 |
| 27.183 | 42.928 | 535.510 | −15.961 | −1.011 | 535.510 |
| 28.906 | 54.065 | 535.510 | −21.425 | −5.721 | 535.510 |
| 26.537 | 51.334 | 535.510 | −14.512 | 0.066 | 535.510 |
| 28.362 | 50.053 | 535.510 | −24.901 | −11.942 | 535.510 |
| 27.760 | 54.453 | 535.510 | −20.145 | −4.448 | 535.510 |
| 23.656 | 44.712 | 535.510 | −13.052 | 1.129 | 535.510 |
| 26.862 | 41.151 | 535.510 | −24.400 | −10.210 | 535.510 |
| 27.190 | 53.017 | 535.510 | −18.790 | −3.255 | 535.510 |
| 28.087 | 48.269 | 535.510 | −11.589 | 2.186 | 535.510 |
| 28.085 | 54.694 | 535.510 | −23.605 | −8.591 | 535.510 |
| 24.410 | 46.353 | 535.510 | −17.390 | −2.115 | 535.510 |
| 26.535 | 39.375 | 535.510 | −25.072 | −13.737 | 535.510 |
| 21.276 | 39.846 | 535.510 | −22.593 | −7.097 | 535.510 |
| 27.797 | 46.487 | 535.510 | −8.670 | 4.313 | 535.510 |
| 28.495 | 54.678 | 535.510 | −1.595 | 9.917 | 535.510 |
| 25.144 | 48.002 | 535.510 | −7.224 | 5.394 | 535.510 |
| 26.203 | 37.601 | 535.510 | −0.236 | 11.106 | 535.510 |
| 22.090 | 41.458 | 535.510 | −5.792 | 6.494 | 535.510 |
| 27.495 | 44.707 | 535.510 | 1.100 | 12.321 | 535.510 |
| 28.814 | 54.442 | 535.510 | −4.375 | 7.613 | 535.510 |
| 25.854 | 49.662 | 535.510 | −10.127 | 3.246 | 535.510 |
| 18.707 | 35.078 | 535.510 | −2.975 | 8.753 | 535.510 |

TABLE I-continued

| Stage 1 Nozzle Airfoil | | | | | |
|---|---|---|---|---|---|
| X | Y | R | X | Y | R |
| 9.679 | 21.586 | 535.510 | −14.557 | −27.277 | 535.510 |
| 14.957 | 28.907 | 535.510 | −21.738 | −21.933 | 535.510 |
| 10.791 | 23.009 | 535.510 | −16.175 | −26.477 | 535.510 |
| 15.932 | 30.427 | 535.510 | −22.821 | −20.490 | 535.510 |
| 11.874 | 24.454 | 535.510 | −17.714 | −25.534 | 535.510 |
| 16.881 | 31.963 | 535.510 | −23.736 | −18.934 | 535.510 |
| 7.370 | 18.811 | 535.510 | −11.132 | −28.405 | 535.510 |
| 12.929 | 25.919 | 535.510 | −19.164 | −24.458 | 535.510 |
| 17.806 | 33.513 | 535.510 | −24.448 | −17.276 | 535.510 |
| 8.539 | 20.187 | 535.510 | −12.872 | −27.923 | 535.510 |
| 13.957 | 27.404 | 535.510 | −20.511 | −23.257 | 535.510 |
| 24.100 | 26.973 | 535.510 | −24.909 | −15.533 | 535.510 |
| 22.189 | 18.150 | 535.510 | 1.052 | −26.493 | 535.510 |
| −7.553 | −28.831 | 535.510 | 28.535 | 54.627 | 541.390 |
| −0.549 | −27.327 | 535.510 | 27.970 | 53.247 | 541.390 |
| −9.354 | −28.712 | 535.510 | 28.816 | 48.316 | 541.390 |
| 5.306 | −23.162 | 535.510 | 25.086 | 46.561 | 541.390 |
| −2.228 | −27.987 | 535.510 | 27.261 | 39.345 | 541.390 |
| 3.980 | −24.388 | 535.510 | 21.848 | 40.037 | 541.390 |
| −3.968 | −28.466 | 535.510 | 28.522 | 46.519 | 541.390 |
| 2.563 | −25.505 | 535.510 | 26.930 | 37.555 | 541.390 |
| −5.750 | −28.750 | 535.510 | 28.863 | 54.869 | 541.390 |
| 18.130 | 2.418 | 535.510 | 25.847 | 48.215 | 541.390 |
| 15.261 | −6.140 | 535.510 | 26.594 | 35.765 | 541.390 |
| 11.574 | −14.375 | 535.510 | 22.687 | 41.654 | 541.390 |
| 17.603 | 0.691 | 535.510 | 28.218 | 44.723 | 541.390 |
| 14.602 | −7.821 | 535.510 | 29.275 | 54.849 | 541.390 |
| 17.055 | −1.030 | 535.510 | 26.583 | 49.880 | 541.390 |
| 13.907 | −9.488 | 535.510 | 26.252 | 33.977 | 541.390 |
| 16.484 | −2.743 | 535.510 | 29.365 | 51.916 | 541.390 |
| 13.173 | −11.137 | 535.510 | 10.019 | 21.705 | 541.390 |
| 15.887 | −4.447 | 535.510 | 15.374 | 29.064 | 541.390 |
| 12.397 | −12.768 | 535.510 | 11.143 | 23.137 | 541.390 |
| 20.064 | 9.376 | 535.510 | 16.368 | 30.590 | 541.390 |
| 19.604 | 7.630 | 535.510 | 12.240 | 24.590 | 541.390 |
| 19.130 | 5.888 | 535.510 | 17.337 | 32.131 | 541.390 |
| 18.639 | 4.150 | 535.510 | 7.688 | 18.907 | 541.390 |
| 20.511 | 11.125 | 535.510 | 13.311 | 26.063 | 541.390 |
| 7.692 | −20.455 | 535.510 | 21.216 | 10.851 | 541.390 |
| 6.542 | −21.846 | 535.510 | 18.284 | 33.687 | 541.390 |
| 10.698 | −15.954 | 535.510 | 8.867 | 20.295 | 541.390 |
| 9.763 | −17.498 | 535.510 | 14.355 | 27.555 | 541.390 |
| 8.764 | −19.002 | 535.510 | 20.763 | 9.087 | 541.390 |
| 5.248 | 16.204 | 541.390 | 22.504 | 16.159 | 541.390 |
| 0.042 | 11.113 | 541.390 | 25.906 | 32.189 | 541.390 |
| 6.482 | 17.543 | 541.390 | 24.086 | 23.268 | 541.390 |
| 1.383 | 12.345 | 541.390 | 22.085 | 14.387 | 541.390 |
| 2.698 | 13.604 | 541.390 | 25.554 | 30.403 | 541.390 |
| 3.987 | 14.891 | 541.390 | 23.703 | 21.488 | 541.390 |
| 20.109 | 36.838 | 541.390 | 21.656 | 12.617 | 541.390 |
| 20.989 | 38.432 | 541.390 | 25.196 | 28.617 | 541.390 |
| 19.207 | 35.256 | 541.390 | 23.312 | 19.710 | 541.390 |
| 23.505 | 43.280 | 541.390 | 24.832 | 26.833 | 541.390 |
| 27.906 | 42.929 | 541.390 | 22.913 | 17.933 | 541.390 |
| 29.593 | 54.607 | 541.390 | 24.462 | 25.050 | 541.390 |
| 29.679 | 54.223 | 541.390 | −21.343 | −5.838 | 541.390 |
| 27.291 | 51.558 | 541.390 | −14.325 | −0.056 | 541.390 |
| 29.098 | 50.115 | 541.390 | −24.899 | −12.077 | 541.390 |
| 24.305 | 44.916 | 541.390 | −20.038 | −4.569 | 541.390 |
| 27.586 | 41.137 | 541.390 | −25.073 | −13.887 | 541.390 |
| −12.850 | 1.011 | 541.390 | 18.792 | 2.076 | 541.390 |
| −24.390 | −10.332 | 541.390 | 15.850 | −6.538 | 541.390 |
| −24.446 | −17.457 | 541.390 | 12.054 | −14.806 | 541.390 |
| −18.660 | −3.378 | 541.390 | 18.253 | 0.337 | 541.390 |
| −11.373 | 2.076 | 541.390 | 20.295 | 7.327 | 541.390 |
| −23.577 | −8.705 | 541.390 | 19.812 | 5.572 | 541.390 |
| −24.909 | −15.698 | 541.390 | 10.189 | −17.933 | 541.390 |
| −17.240 | −2.239 | 541.390 | 9.160 | −19.435 | 541.390 |
| −9.899 | 3.145 | 541.390 | 8.058 | −20.884 | 541.390 |
| −22.539 | −7.210 | 541.390 | 6.950 | 17.471 | 547.270 |
| −15.792 | −1.136 | 541.390 | 3.105 | 13.522 | 547.270 |
| −8.433 | 4.225 | 541.390 | 0.410 | 11.024 | 547.270 |
| −1.323 | 9.908 | 541.390 | 5.695 | 16.129 | 547.270 |
| −6.978 | 5.320 | 541.390 | 4.414 | 14.812 | 547.270 |
| −5.538 | 6.434 | 541.390 | 1.770 | 12.259 | 547.270 |

TABLE I-continued

| Stage 1 Nozzle Airfoil | | | | | |
|---|---|---|---|---|---|
| X | Y | R | X | Y | R |
| −4.114 | 7.569 | 541.390 | −0.973 | 9.815 | 547.270 |
| −2.709 | 8.727 | 541.390 | −2.378 | 8.630 | 547.270 |
| −22.814 | −20.702 | 541.390 | 19.939 | 35.239 | 547.270 |
| −17.677 | −25.802 | 541.390 | 21.766 | 38.427 | 547.270 |
| −23.732 | −19.131 | 541.390 | 20.863 | 36.827 | 547.270 |
| −11.044 | −28.707 | 541.390 | 18.993 | 33.664 | 547.270 |
| −19.137 | −24.714 | 541.390 | 18.024 | 32.102 | 547.270 |
| −12.797 | −28.218 | 541.390 | 30.284 | 54.910 | 547.270 |
| −20.493 | −23.500 | 541.390 | 28.841 | 42.872 | 547.270 |
| −14.496 | −27.564 | 541.390 | 25.174 | 44.938 | 547.270 |
| −21.726 | −22.161 | 541.390 | 24.351 | 43.295 | 547.270 |
| −16.126 | −26.755 | 541.390 | 26.827 | 32.033 | 547.270 |
| −0.357 | −27.688 | 541.390 | 27.856 | 37.448 | 547.270 |
| −9.251 | −29.020 | 541.390 | 29.868 | 54.932 | 547.270 |
| 5.609 | −23.577 | 541.390 | 22.648 | 40.039 | 547.270 |
| −2.058 | −28.335 | 541.390 | 28.254 | 51.610 | 547.270 |
| 4.253 | −24.791 | 541.390 | 28.518 | 41.063 | 547.270 |
| −3.818 | −28.801 | 541.390 | 29.158 | 44.682 | 547.270 |
| 2.806 | −25.895 | 541.390 | 29.768 | 48.306 | 547.270 |
| −5.617 | −29.075 | 541.390 | 30.341 | 51.935 | 547.270 |
| 1.268 | −26.869 | 541.390 | 29.538 | 54.687 | 547.270 |
| −7.435 | −29.147 | 541.390 | 30.600 | 54.658 | 547.270 |
| 6.876 | −22.269 | 541.390 | 28.957 | 53.308 | 547.270 |
| 15.172 | −8.228 | 541.390 | 23.509 | 41.662 | 547.270 |
| 11.152 | −16.388 | 541.390 | 27.523 | 49.925 | 547.270 |
| 17.692 | −1.396 | 541.390 | 26.763 | 48.252 | 547.270 |
| 14.457 | −9.902 | 541.390 | 25.978 | 46.590 | 547.270 |
| 17.106 | −3.120 | 541.390 | 27.175 | 33.837 | 547.270 |
| 13.702 | −11.559 | 541.390 | 27.518 | 35.642 | 547.270 |
| 19.311 | 3.821 | 541.390 | 29.467 | 46.493 | 547.270 |
| 16.493 | −4.835 | 541.390 | 30.059 | 50.120 | 547.270 |
| 12.902 | −13.195 | 541.390 | 30.658 | 54.047 | 547.270 |
| 28.190 | 39.255 | 547.270 | −8.177 | 4.117 | 547.270 |
| 11.697 | 23.080 | 547.270 | −3.802 | 7.469 | 547.270 |
| 9.377 | 20.230 | 547.270 | −6.703 | 5.214 | 547.270 |
| 21.634 | 8.722 | 547.270 | −19.061 | −24.951 | 547.270 |
| 17.032 | 30.556 | 547.270 | −16.021 | −27.006 | 547.270 |
| 14.975 | 27.511 | 547.270 | −12.662 | −28.484 | 547.270 |
| 21.158 | 6.947 | 547.270 | −10.893 | −28.981 | 547.270 |
| 10.551 | 21.644 | 547.270 | −22.779 | −20.908 | 547.270 |
| 8.177 | 18.839 | 547.270 | −9.085 | −29.304 | 547.270 |
| 22.094 | 10.500 | 547.270 | −20.431 | −23.727 | 547.270 |
| 12.816 | 24.537 | 547.270 | −17.586 | −26.046 | 547.270 |
| 16.016 | 29.025 | 547.270 | −14.375 | −27.822 | 547.270 |
| 13.908 | 26.015 | 547.270 | −21.678 | −22.378 | 547.270 |
| 24.997 | 23.030 | 547.270 | −1.817 | −28.691 | 547.270 |
| 22.542 | 12.283 | 547.270 | 1.567 | −27.274 | 547.270 |
| 23.400 | 15.856 | 547.270 | 6.021 | −24.051 | 547.270 |
| 25.376 | 24.828 | 547.270 | −3.600 | −29.134 | 547.270 |
| 26.114 | 28.428 | 547.270 | −7.254 | −29.444 | 547.270 |
| 22.977 | 14.068 | 547.270 | −0.089 | −28.068 | 547.270 |
| 23.813 | 17.646 | 547.270 | 3.140 | −26.326 | 547.270 |
| 24.217 | 19.439 | 547.270 | 4.625 | −25.245 | 547.270 |
| 24.611 | 21.233 | 547.270 | 7.328 | −22.760 | 547.270 |
| 25.748 | 26.627 | 547.270 | −5.418 | −29.388 | 547.270 |
| 26.473 | 30.230 | 547.270 | 16.603 | −7.021 | 547.270 |
| −9.663 | 3.036 | 547.270 | 10.754 | −18.449 | 547.270 |
| −23.709 | −19.325 | 547.270 | 13.561 | −13.709 | 547.270 |
| −25.073 | −14.037 | 547.270 | 17.895 | −3.581 | 547.270 |
| −21.284 | −5.936 | 547.270 | 19.071 | −0.100 | 547.270 |
| −12.655 | 0.902 | 547.270 | 20.154 | 3.412 | 547.270 |
| −14.152 | −0.163 | 547.270 | 15.905 | −8.721 | 547.270 |
| −17.113 | −2.340 | 547.270 | 9.689 | −19.946 | 547.270 |
| −19.955 | −4.668 | 547.270 | 11.751 | −16.906 | 547.270 |
| −24.387 | −10.449 | 547.270 | 12.684 | −15.323 | 547.270 |
| −23.563 | −8.809 | 547.270 | 14.387 | −12.067 | 547.270 |
| −24.434 | −17.638 | 547.270 | 15.167 | −10.404 | 547.270 |
| −22.506 | −7.308 | 547.270 | 17.265 | −5.308 | 547.270 |
| −24.899 | −12.210 | 547.270 | 18.496 | −1.845 | 547.270 |
| −24.905 | −15.864 | 547.270 | 19.623 | 1.653 | 547.270 |
| −11.157 | 1.966 | 547.270 | 20.665 | 5.177 | 547.270 |
| −15.641 | −1.239 | 547.270 | 8.549 | −21.387 | 547.270 |
| −18.556 | −3.478 | 547.270 | | | |
| −5.244 | 6.331 | 547.270 | | | |

Figure 2:
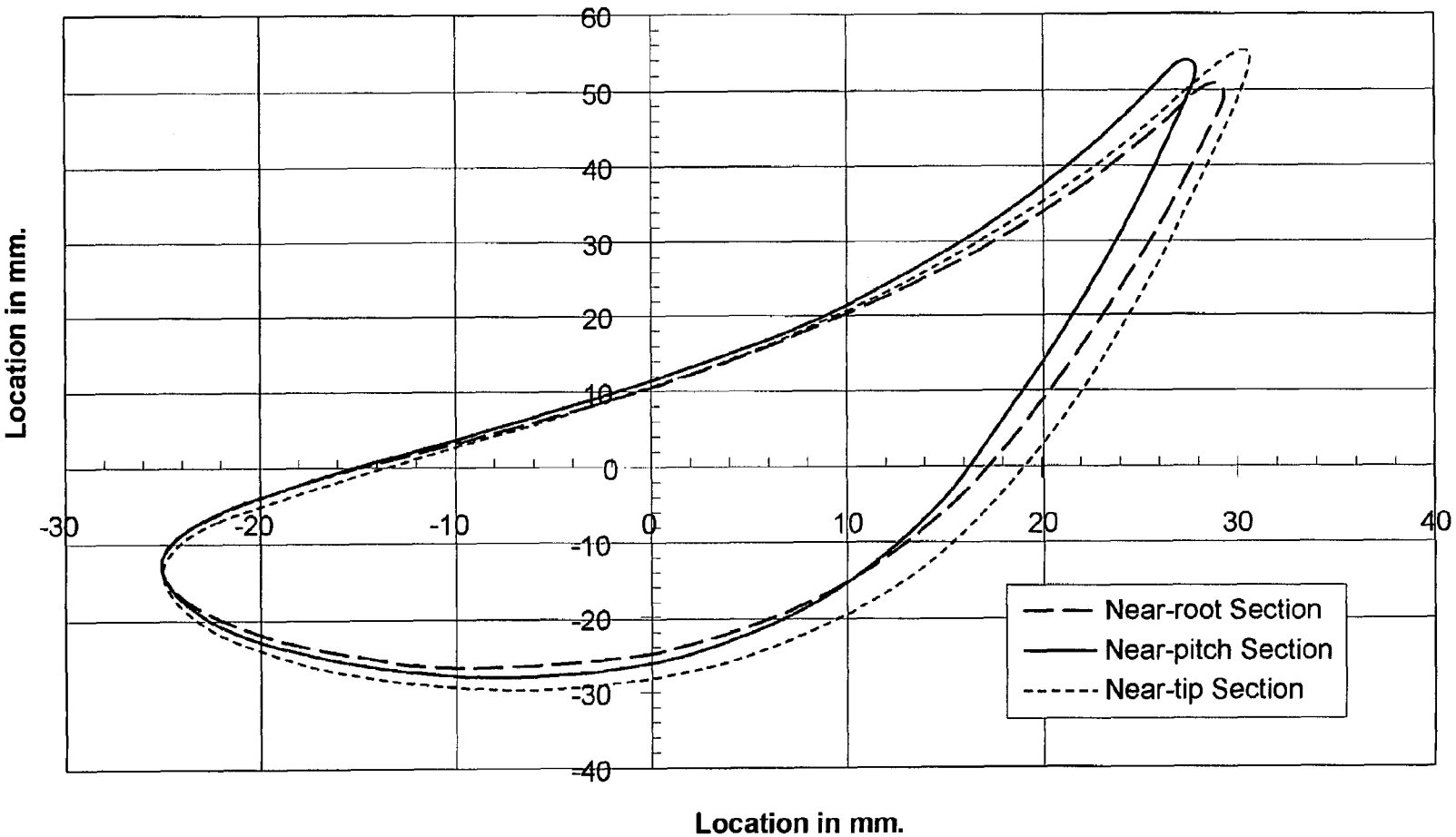
FIGS. 2 and 3 constitute plots of the first stage nozzle and bucket airfoil shapes, respectively, at the near root, near pitch and near tip sections.

As an example, the profile sections of the first stage nozzle airfoils 16 at each of near root, near pitch and near tip distances R are illustrated in FIG. 2.

The coordinate values given in Table II below provide the preferred nominal profile shape excluding the fillet region for the first stage bucket airfoil 18.

TABLE II

| Stage 1 Bucket Airfoil | | | | | |
|---|---|---|---|---|---|
| X | Y | R | X | Y | R |
| 397.512 | −0.247 | 501.471 | 391.171 | 17.632 | 501.471 |
| 377.726 | 3.399 | 501.471 | 399.570 | −1.226 | 501.471 |
| 403.720 | 13.970 | 501.471 | 384.051 | −0.349 | 501.471 |
| 400.021 | 16.614 | 501.471 | 378.277 | 5.607 | 501.471 |
| 391.940 | 0.774 | 501.471 | 403.293 | −3.848 | 501.471 |
| 382.576 | 12.267 | 501.471 | 406.050 | 11.470 | 501.471 |
| 392.285 | 17.871 | 501.471 | 407.418 | 9.646 | 501.471 |
| 395.693 | 17.968 | 501.471 | 394.214 | 0.628 | 501.471 |
| 386.291 | 0.077 | 501.471 | 384.227 | 13.839 | 501.471 |
| 379.216 | 7.682 | 501.471 | 401.959 | 15.416 | 501.471 |
| 401.494 | −2.447 | 501.471 | 398.989 | 17.097 | 501.471 |
| 408.658 | 7.733 | 501.471 | 388.536 | 0.476 | 501.471 |
| 396.437 | 0.131 | 501.471 | 380.414 | 9.621 | 501.471 |
| 402.861 | 14.719 | 501.471 | 386.033 | 15.228 | 501.471 |
| 396.817 | 17.782 | 501.471 | 389.018 | 16.888 | 501.471 |
| 390.801 | 0.732 | 501.471 | 398.557 | −0.702 | 501.471 |
| 381.811 | 11.421 | 501.471 | 377.938 | 4.518 | 501.471 |
| 390.080 | 17.302 | 501.471 | 404.536 | 13.174 | 501.471 |
| 393.416 | 18.010 | 501.471 | 405.313 | 12.339 | 501.471 |
| 385.172 | −0.141 | 501.471 | 393.080 | 0.743 | 501.471 |
| 378.709 | 6.661 | 501.471 | 383.381 | 13.074 | 501.471 |
| 402.408 | −3.128 | 501.471 | 394.555 | 18.044 | 501.471 |
| 408.053 | 8.699 | 501.471 | 397.918 | 17.489 | 501.471 |
| 395.335 | 0.424 | 501.471 | 387.412 | 0.288 | 501.471 |
| 385.111 | 14.558 | 501.471 | 379.787 | 8.669 | 501.471 |
| 406.751 | 10.571 | 501.471 | 400.548 | −1.811 | 501.471 |
| 401.012 | 16.050 | 501.471 | 409.236 | 6.751 | 501.471 |
| 389.666 | 0.628 | 501.471 | 387.988 | 16.400 | 501.471 |
| 381.090 | 10.539 | 501.471 | 404.981 | −5.380 | 501.471 |
| 386.992 | 15.844 | 501.471 | 412.682 | −0.442 | 501.471 |
| 415.794 | −9.013 | 501.471 | 420.001 | −23.223 | 501.471 |
| 414.696 | −5.774 | 501.471 | 415.245 | −18.998 | 501.471 |
| 408.808 | −9.600 | 501.471 | 418.021 | −23.976 | 501.471 |
| 412.242 | 0.610 | 501.471 | 416.385 | −20.973 | 501.471 |
| 417.505 | −14.451 | 501.471 | 415.820 | −19.983 | 501.471 |
| 412.195 | −14.183 | 501.471 | 417.485 | −22.970 | 501.471 |
| 405.788 | −6.185 | 501.471 | 419.405 | −21.022 | 501.471 |
| 411.318 | 2.694 | 501.471 | 420.290 | −24.326 | 501.471 |
| 417.173 | −13.360 | 501.471 | 419.101 | −19.923 | 501.471 |
| 415.435 | −7.931 | 501.471 | 414.061 | −17.049 | 501.471 |
| 409.516 | −10.493 | 501.471 | 419.705 | −22.122 | 501.471 |
| 410.829 | 3.724 | 501.471 | 419.077 | −25.997 | 501.471 |
| 418.157 | −16.636 | 501.471 | 420.060 | −26.349 | 501.471 |
| 412.830 | −15.130 | 501.471 | 383.582 | 13.908 | 508.892 |
| 413.521 | −2.562 | 501.471 | 382.821 | 13.029 | 508.892 |
| 411.788 | 1.656 | 501.471 | 380.814 | 10.180 | 508.892 |
| 406.574 | −7.011 | 501.471 | 397.966 | 0.438 | 508.892 |
| 417.833 | −15.543 | 501.471 | 408.872 | 6.598 | 508.892 |
| 416.147 | −10.097 | 501.471 | 400.152 | 17.307 | 508.892 |
| 410.209 | −11.399 | 501.471 | 387.074 | 16.963 | 508.892 |
| 410.320 | 4.745 | 501.471 | 378.571 | 4.842 | 508.892 |
| 413.451 | −16.086 | 501.471 | 402.762 | −2.810 | 508.892 |
| 414.314 | −4.700 | 501.471 | 405.848 | 11.558 | 508.892 |
| 413.108 | −1.499 | 501.471 | 394.731 | 19.230 | 508.892 |
| 407.338 | −7.857 | 501.471 | 379.870 | −0.366 | 508.892 |
| 418.476 | −17.730 | 501.471 | 393.488 | 1.593 | 508.892 |
| 416.836 | −12.271 | 501.471 | 403.661 | 14.272 | 508.892 |
| 410.885 | −12.317 | 501.471 | 390.164 | 18.564 | 508.892 |
| 409.790 | 5.754 | 501.471 | 380.242 | 9.168 | 508.892 |
| 404.150 | −4.600 | 501.471 | 384.418 | −0.178 | 508.892 |
| 415.069 | −6.851 | 501.471 | 399.005 | −0.085 | 508.892 |
| 413.923 | −3.629 | 501.471 | 385.238 | 15.539 | 508.892 |
| 408.082 | −8.721 | 501.471 | 408.317 | 7.619 | 508.892 |
| 416.494 | −11.183 | 501.471 | 399.152 | 17.899 | 508.892 |
| 411.547 | −13.245 | 501.471 | 378.370 | 3.697 | 508.892 |
| 418.791 | −18.826 | 501.471 | 388.878 | 1.140 | 508.892 |
| 381.789 | −0.626 | 501.471 | 405.155 | 12.492 | 508.892 |

TABLE II-continued

| Stage 1 Bucket Airfoil | | | | | |
|---|---|---|---|---|---|
| X | Y | R | X | Y | R |
| 380.650 | −0.603 | 501.471 | 393.569 | 19.250 | 508.892 |
| 379.539 | −0.361 | 501.471 | 380.986 | −0.670 | 508.892 |
| 378.564 | 0.215 | 501.471 | 394.642 | 1.460 | 508.892 |
| 377.930 | 1.150 | 501.471 | 402.853 | 15.109 | 508.892 |
| 382.924 | −0.522 | 501.471 | 389.091 | 18.116 | 508.892 |
| 377.693 | 2.261 | 501.471 | 379.724 | 8.127 | 508.892 |
| 414.658 | −18.020 | 501.471 | 385.531 | 0.158 | 508.892 |
| 416.940 | −21.969 | 501.471 | 400.003 | −0.682 | 508.892 |
| 418.548 | −24.987 | 501.471 | 386.133 | 16.281 | 508.892 |
| 420.570 | −25.431 | 501.471 | 407.740 | 8.629 | 508.892 |
| 398.104 | 18.401 | 508.892 | 403.611 | −3.603 | 508.892 |
| 378.312 | 2.537 | 508.892 | 413.328 | −16.611 | 508.892 |
| 390.015 | 1.382 | 508.892 | 417.933 | −17.285 | 508.892 |
| 384.387 | 14.747 | 508.892 | 412.69 | −31.878 | 508.892 |
| 392.412 | 19.141 | 508.892 | 407.46 | −47.951 | 508.892 |
| 382.147 | −0.661 | 508.892 | 416.214 | −21.657 | 508.892 |
| 395.779 | 1.219 | 508.892 | 420.127 | −25.122 | 508.892 |
| 402.001 | 15.900 | 508.892 | 416.192 | −11.739 | 508.892 |
| 388.061 | 17.579 | 508.892 | 410.420 | 3.472 | 508.892 |
| 379.266 | 7.059 | 508.892 | 410.848 | −12.677 | 508.892 |
| 386.641 | 0.506 | 508.892 | 418.907 | −26.809 | 508.892 |
| 400.960 | −1.341 | 508.892 | 414.319 | −6.235 | 508.892 |
| 407.137 | 9.623 | 508.892 | 404.431 | −4.428 | 508.892 |
| 397.011 | 18.798 | 508.892 | 413.923 | −17.610 | 508.892 |
| 378.469 | 1.387 | 508.892 | 417.595 | −16.173 | 508.892 |
| 391.166 | 1.547 | 508.892 | 412.262 | −0.798 | 508.892 |
| 381.436 | 11.162 | 508.892 | 408.172 | −8.874 | 508.892 |
| 404.427 | 13.398 | 508.892 | 416.766 | −22.680 | 508.892 |
| 391.274 | 18.909 | 508.892 | 419.835 | −23.997 | 508.892 |
| 383.293 | −0.469 | 508.892 | 415.828 | −10.634 | 508.892 |
| 396.890 | 0.876 | 508.892 | 409.922 | 4.523 | 508.892 |
| 401.102 | 16.636 | 508.892 | 411.484 | −13.650 | 508.892 |
| 382.106 | 12.113 | 508.892 | 419.899 | −27.187 | 508.892 |
| 378.878 | 5.963 | 508.892 | 418.912 | −20.633 | 508.892 |
| 387.754 | 0.841 | 508.892 | 413.925 | −5.141 | 508.892 |
| 401.879 | −2.053 | 508.892 | 405.223 | −5.279 | 508.892 |
| 406.508 | 10.601 | 508.892 | 414.508 | −18.614 | 508.892 |
| 395.883 | 19.078 | 508.892 | 417.251 | −15.062 | 508.892 |
| 378.961 | 0.342 | 508.892 | 411.821 | 0.278 | 508.892 |
| 392.326 | 1.621 | 508.892 | 408.863 | −9.809 | 508.892 |
| 416.903 | −13.953 | 508.892 | 417.310 | −23.708 | 508.892 |
| 411.368 | 1.349 | 508.892 | 419.534 | −22.874 | 508.892 |
| 409.538 | −10.755 | 508.892 | 415.460 | −9.531 | 508.892 |
| 417.847 | −24.739 | 508.892 | 409.406 | 5.565 | 508.892 |
| 419.226 | −21.752 | 508.892 | 412.109 | −14.630 | 508.892 |
| 415.086 | −8.430 | 508.892 | 418.592 | −19.515 | 508.892 |
| 412.723 | −15.617 | 508.892 | 413.523 | −4.050 | 508.892 |
| 418.265 | −18.399 | 508.892 | 405.992 | −6.151 | 508.892 |
| 413.113 | −2.962 | 508.892 | 415.085 | −19.624 | 508.892 |
| 406.738 | −7.043 | 508.892 | 403.046 | 15.154 | 516.313 |
| 415.653 | −20.638 | 508.892 | 388.387 | 18.295 | 516.313 |
| 420.409 | −26.250 | 508.892 | 408.800 | 6.339 | 516.313 |
| 416.550 | −12.845 | 508.892 | 398.466 | 18.769 | 516.313 |
| 410.901 | 2.414 | 508.892 | 383.979 | 14.465 | 516.313 |
| 410.199 | −11.712 | 508.892 | 396.217 | 1.767 | 516.313 |
| 418.376 | −25.774 | 508.892 | 405.902 | 11.436 | 516.313 |
| 414.705 | −7.332 | 508.892 | 392.783 | 19.835 | 516.313 |
| 402.231 | 15.998 | 516.313 | 386.029 | 0.589 | 516.313 |
| 387.403 | 17.656 | 516.313 | 401.211 | −1.252 | 516.313 |
| 408.266 | 7.384 | 516.313 | 379.033 | 3.990 | 516.313 |
| 397.393 | 19.242 | 516.313 | 391.601 | 2.347 | 516.313 |
| 383.245 | 13.549 | 516.313 | 381.526 | −0.544 | 516.313 |
| 397.302 | 1.320 | 516.313 | 380.299 | 8.493 | 516.313 |
| 405.241 | 12.405 | 516.313 | 387.110 | 1.045 | 516.313 |
| 391.629 | 19.632 | 516.313 | 402.086 | −2.033 | 516.313 |
| 401.369 | 16.794 | 516.313 | 378.975 | 2.819 | 516.313 |
| 386.472 | 16.943 | 516.313 | 392.772 | 2.404 | 516.313 |
| 407.712 | 8.418 | 516.313 | 382.696 | −0.514 | 516.313 |
| 396.275 | 19.598 | 516.313 | 379.870 | 7.401 | 516.313 |
| 382.558 | 12.598 | 516.313 | 388.200 | 1.478 | 516.313 |
| 398.344 | 0.782 | 516.313 | 402.928 | −2.851 | 516.313 |
| 404.547 | 13.351 | 516.313 | 379.110 | 1.656 | 516.313 |
| 390.505 | 19.297 | 516.313 | 393.942 | 2.322 | 516.313 |
| 400.455 | 17.529 | 516.313 | 383.837 | −0.246 | 516.313 |
| 385.591 | 16.168 | 516.313 | 379.507 | 6.286 | 516.313 |

TABLE II-continued

| Stage 1 Bucket Airfoil | | | | | |
|---|---|---|---|---|---|
| X | Y | R | X | Y | R |
| 407.134 | 9.440 | 516.313 | 389.309 | 1.860 | 516.313 |
| 395.124 | 19.820 | 516.313 | 379.548 | 0.574 | 516.313 |
| 381.918 | 11.615 | 516.313 | 395.095 | 2.106 | 516.313 |
| 399.342 | 0.165 | 516.313 | 384.943 | 0.145 | 516.313 |
| 403.816 | 14.269 | 516.313 | 419.382 | −23.477 | 516.313 |
| 389.422 | 18.847 | 516.313 | 416.727 | −14.474 | 516.313 |
| 409.316 | 5.286 | 516.313 | 404.520 | −4.574 | 516.313 |
| 399.487 | 18.192 | 516.313 | 413.758 | −18.128 | 516.313 |
| 384.761 | 15.339 | 516.313 | 419.072 | −22.345 | 516.313 |
| 406.532 | 10.446 | 516.313 | 420.251 | −26.887 | 516.313 |
| 393.954 | 19.899 | 516.313 | 414.899 | −8.899 | 516.313 |
| 381.327 | 10.601 | 516.313 | 408.116 | −9.206 | 516.313 |
| 400.297 | −0.516 | 516.313 | 416.596 | −23.262 | 516.313 |
| 411.222 | 0.997 | 516.313 | 418.104 | −18.961 | 516.313 |
| 412.937 | −3.371 | 516.313 | 411.346 | −14.102 | 516.313 |
| 410.767 | 2.079 | 516.313 | 416.371 | −13.356 | 516.313 |
| 414.519 | −7.789 | 516.313 | 405.278 | −5.469 | 516.313 |
| 412.523 | −2.273 | 516.313 | 414.341 | −19.146 | 516.313 |
| 410.298 | 3.154 | 516.313 | 419.973 | −25.747 | 516.313 |
| 414.134 | −6.681 | 516.313 | 408.785 | −10.170 | 516.313 |
| 412.099 | −1.179 | 516.313 | 417.141 | −24.301 | 516.313 |
| 409.815 | 4.224 | 516.313 | 417.768 | −17.836 | 516.313 |
| 413.742 | −5.575 | 516.313 | 411.962 | −15.101 | 516.313 |
| 411.666 | −0.089 | 516.313 | 416.010 | −12.240 | 516.313 |
| 413.343 | −4.472 | 516.313 | 406.015 | −6.382 | 516.313 |
| 379.222 | 5.148 | 516.313 | 414.916 | −20.169 | 516.313 |
| 390.443 | 2.159 | 516.313 | 419.682 | −24.611 | 516.313 |
| 380.411 | −0.200 | 516.313 | 409.442 | −11.142 | 516.313 |
| 380.786 | 9.560 | 516.313 | 417.678 | −25.344 | 516.313 |
| 417.426 | −16.714 | 516.313 | 381.202 | 0.265 | 523.734 |
| 412.568 | −16.105 | 516.313 | 384.468 | 14.965 | 523.734 |
| 415.644 | −11.125 | 516.313 | 398.932 | 18.787 | 523.734 |
| 406.732 | −7.311 | 516.313 | 408.884 | 5.999 | 523.734 |
| 415.484 | −21.196 | 516.313 | 391.118 | 3.048 | 523.734 |
| 418.756 | −21.215 | 516.313 | 379.873 | 5.568 | 523.734 |
| 410.087 | −12.122 | 516.313 | 388.881 | 18.788 | 523.734 |
| 418.207 | −26.392 | 516.313 | 403.345 | 14.961 | 523.734 |
| 417.079 | −15.593 | 516.313 | 400.630 | −0.509 | 523.734 |
| 403.738 | −3.699 | 516.313 | 385.696 | 0.846 | 523.734 |
| 413.167 | −17.114 | 516.313 | 381.870 | 11.064 | 523.734 |
| 419.734 | −27.829 | 516.313 | 394.494 | 20.186 | 523.734 |
| 415.274 | −10.011 | 516.313 | 406.697 | 10.152 | 523.734 |
| 407.432 | −8.253 | 516.313 | 395.735 | 2.664 | 523.734 |
| 416.044 | −22.227 | 516.313 | 380.308 | 1.005 | 523.734 |
| 418.433 | −20.087 | 516.313 | 385.244 | 15.846 | 523.734 |
| 410.721 | −13.109 | 516.313 | 399.921 | 18.155 | 523.734 |
| 418.736 | −27.439 | 516.313 | 409.382 | 4.936 | 523.734 |
| 398.813 | 0.975 | 523.734 | 389.983 | 2.752 | 523.734 |
| 383.495 | 0.046 | 523.734 | 380.135 | 6.712 | 523.734 |
| 383.069 | 13.082 | 523.734 | 389.927 | 19.320 | 523.734 |
| 396.794 | 19.746 | 523.734 | 404.085 | 14.050 | 523.734 |
| 407.834 | 8.098 | 523.734 | 399.742 | 0.258 | 523.734 |
| 393.454 | 3.186 | 523.734 | 384.618 | 0.384 | 523.734 |
| 379.675 | 3.234 | 523.734 | 382.444 | 12.088 | 523.734 |
| 386.953 | 17.453 | 523.734 | 395.658 | 20.038 | 523.734 |
| 401.733 | 16.666 | 523.734 | 407.278 | 9.132 | 523.734 |
| 402.298 | −2.161 | 523.734 | 394.612 | 3.001 | 523.734 |
| 387.809 | 1.869 | 523.734 | 379.838 | 2.073 | 523.734 |
| 380.882 | 8.936 | 523.734 | 386.072 | 16.678 | 523.734 |
| 392.158 | 20.034 | 523.734 | 400.854 | 17.443 | 523.734 |
| 405.455 | 12.144 | 523.734 | 403.086 | −3.031 | 523.734 |
| 397.837 | 1.627 | 523.734 | 388.882 | 2.346 | 523.734 |
| 382.328 | −0.040 | 523.734 | 380.475 | 7.835 | 523.734 |
| 383.744 | 14.042 | 523.734 | 391.022 | 19.741 | 523.734 |
| 397.888 | 19.323 | 523.734 | 404.787 | 13.109 | 523.734 |
| 408.369 | 7.054 | 523.734 | 417.518 | −25.780 | 523.734 |
| 392.281 | 3.200 | 523.734 | 409.334 | −11.538 | 523.734 |
| 379.708 | 4.406 | 523.734 | 414.058 | −7.094 | 523.734 |
| 387.889 | 18.161 | 523.734 | 418.933 | −22.785 | 523.734 |
| 402.562 | 15.835 | 523.734 | 414.760 | −20.600 | 523.734 |
| 401.481 | −1.318 | 523.734 | 406.014 | −6.699 | 523.734 |
| 386.753 | 1.356 | 523.734 | 410.331 | 2.789 | 523.734 |
| 381.349 | 10.013 | 523.734 | 415.899 | −12.667 | 523.734 |
| 393.321 | 20.184 | 523.734 | 411.817 | −15.523 | 523.734 |
| 406.090 | 11.157 | 523.734 | 412.487 | −2.669 | 523.734 |

TABLE II-continued

| Stage 1 Bucket Airfoil | | | | | |
|---|---|---|---|---|---|
| X | Y | R | X | Y | R |
| 396.812 | 2.198 | 523.734 | 417.638 | −18.272 | 523.734 |
| 416.983 | −24.736 | 523.734 | 402.152 | 16.341 | 531.155 |
| 408.692 | −10.555 | 523.734 | 402.670 | −2.292 | 531.155 |
| 414.435 | −8.206 | 523.734 | 388.796 | 3.080 | 531.155 |
| 419.240 | −23.918 | 523.734 | 381.480 | 9.498 | 531.155 |
| 414.185 | −19.577 | 523.734 | 392.826 | 20.214 | 531.155 |
| 405.310 | −5.760 | 523.734 | 405.718 | 11.748 | 531.155 |
| 410.784 | 1.706 | 523.734 | 398.572 | 1.834 | 531.155 |
| 416.255 | −13.785 | 523.734 | 383.422 | 0.932 | 531.155 |
| 419.570 | −28.271 | 523.734 | 384.306 | 14.572 | 531.155 |
| 411.207 | −14.520 | 523.734 | 398.461 | 19.155 | 531.155 |
| 412.890 | −3.772 | 523.734 | 408.522 | 6.645 | 531.155 |
| 417.972 | −19.397 | 523.734 | 393.299 | 4.087 | 531.155 |
| 416.439 | −23.696 | 523.734 | 380.417 | 4.980 | 531.155 |
| 408.040 | −9.579 | 523.734 | 388.507 | 18.564 | 531.155 |
| 414.808 | −9.319 | 523.734 | 402.946 | 15.489 | 531.155 |
| 419.538 | −25.053 | 523.734 | 401.914 | −1.405 | 531.155 |
| 413.603 | −18.558 | 523.734 | 387.746 | 2.576 | 531.155 |
| 404.589 | −4.834 | 523.734 | 381.932 | 10.572 | 531.155 |
| 411.225 | 0.618 | 523.734 | 393.988 | 20.292 | 531.155 |
| 416.607 | −14.905 | 523.734 | 406.329 | 10.756 | 531.155 |
| 418.571 | −27.879 | 523.734 | 397.628 | 2.516 | 531.155 |
| 410.591 | −13.521 | 523.734 | 382.276 | 1.097 | 531.155 |
| 413.286 | −4.877 | 523.734 | 385.035 | 15.480 | 531.155 |
| 418.299 | −20.525 | 523.734 | 399.466 | 18.568 | 531.155 |
| 415.887 | −22.660 | 523.734 | 409.019 | 5.592 | 531.155 |
| 407.378 | −8.610 | 523.734 | 392.135 | 4.061 | 531.155 |
| 415.176 | −10.433 | 523.734 | 380.543 | 6.137 | 531.155 |
| 419.825 | −26.192 | 523.734 | 389.516 | 19.147 | 531.155 |
| 413.014 | −17.542 | 523.734 | 403.695 | 14.597 | 531.155 |
| 403.849 | −3.923 | 523.734 | 401.132 | −0.542 | 531.155 |
| 411.655 | −0.474 | 523.734 | 386.706 | 2.050 | 531.155 |
| 416.955 | −16.026 | 523.734 | 382.443 | 11.619 | 531.155 |
| 418.045 | −26.830 | 523.734 | 395.150 | 20.218 | 531.155 |
| 409.966 | −12.527 | 523.734 | 406.912 | 9.747 | 531.155 |
| 413.675 | −5.984 | 523.734 | 396.627 | 3.111 | 531.155 |
| 418.619 | −21.654 | 523.734 | 381.285 | 1.692 | 531.155 |
| 415.327 | −21.628 | 523.734 | 385.819 | 16.342 | 531.155 |
| 406.703 | −7.650 | 523.734 | 400.416 | 17.893 | 531.155 |
| 409.864 | 3.866 | 523.734 | 390.988 | 3.863 | 531.155 |
| 415.539 | −11.549 | 523.734 | 380.775 | 7.279 | 531.155 |
| 420.097 | −27.333 | 523.734 | 390.577 | 19.627 | 531.155 |
| 412.419 | −16.531 | 523.734 | 404.405 | 13.672 | 531.155 |
| 412.076 | −1.570 | 523.734 | 400.317 | 0.291 | 531.155 |
| 417.299 | −17.148 | 523.734 | 385.656 | 1.547 | 531.155 |
| 394.452 | 3.927 | 531.155 | 383.010 | 12.637 | 531.155 |
| 380.439 | 3.816 | 531.155 | 396.293 | 19.997 | 531.155 |
| 387.555 | 17.894 | 531.155 | 407.471 | 8.725 | 531.155 |
| 395.566 | 3.592 | 531.155 | 409.500 | 4.530 | 531.155 |
| 380.686 | 2.680 | 531.155 | 415.116 | −10.777 | 531.155 |
| 386.659 | 17.150 | 531.155 | 419.681 | −26.434 | 531.155 |
| 401.310 | 17.146 | 531.155 | 412.932 | −17.832 | 531.155 |
| 403.402 | −3.198 | 531.155 | 404.115 | −4.120 | 531.155 |
| 389.874 | 3.522 | 531.155 | 411.696 | −0.865 | 531.155 |
| 381.092 | 8.400 | 531.155 | 416.856 | −16.337 | 531.155 |
| 391.684 | 19.987 | 531.155 | 417.896 | −27.067 | 531.155 |
| 405.078 | 12.722 | 531.155 | 409.956 | −12.825 | 531.155 |
| 399.466 | 1.087 | 531.155 | 413.655 | −6.351 | 531.155 |
| 384.566 | 1.136 | 531.155 | 418.493 | −21.927 | 531.155 |
| 383.631 | 13.622 | 531.155 | 415.210 | −21.898 | 531.155 |
| 397.401 | 19.638 | 531.155 | 406.813 | −7.920 | 531.155 |
| 408.007 | 7.690 | 531.155 | 409.965 | 3.462 | 531.155 |
| 414.650 | −20.876 | 531.155 | 415.471 | −11.886 | 531.155 |
| 406.157 | −6.956 | 531.155 | 419.948 | −27.568 | 531.155 |
| 410.416 | 2.387 | 531.155 | 412.348 | −16.824 | 531.155 |
| 415.823 | −12.997 | 531.155 | 412.103 | −1.957 | 531.155 |
| 411.759 | −15.819 | 531.155 | 417.194 | −17.452 | 531.155 |
| 412.502 | −3.051 | 531.155 | 417.375 | −26.025 | 531.155 |
| 417.527 | −18.568 | 531.155 | 409.342 | −11.834 | 531.155 |
| 416.846 | −24.987 | 531.155 | 414.027 | −7.455 | 531.155 |
| 408.722 | −10.847 | 531.155 | 418.802 | −23.051 | 531.155 |
| 414.395 | −8.561 | 531.155 | 403.208 | −2.367 | 538.576 |
| 419.105 | −24.176 | 531.155 | 390.056 | 4.623 | 538.576 |
| 414.084 | −19.858 | 531.155 | 382.092 | 10.297 | 538.576 |
| 405.490 | −6.001 | 531.155 | 393.599 | 20.294 | 538.576 |

TABLE II-continued

| Stage 1 Bucket Airfoil | | | | | |
|---|---|---|---|---|---|
| X | Y | R | X | Y | R |
| 410.854 | 1.308 | 531.155 | 405.989 | 11.280 | 538.576 |
| 416.170 | −14.109 | 531.155 | 399.447 | 1.968 | 538.576 |
| 419.413 | −28.494 | 531.155 | 384.735 | 2.483 | 538.576 |
| 411.163 | −14.817 | 531.155 | 384.912 | 15.277 | 538.576 |
| 412.893 | −4.149 | 531.155 | 399.070 | 18.835 | 538.576 |
| 417.855 | −19.686 | 531.155 | 408.687 | 6.210 | 538.576 |
| 416.308 | −23.953 | 531.155 | 394.581 | 4.902 | 538.576 |
| 408.095 | −9.866 | 531.155 | 381.181 | 5.817 | 538.576 |
| 414.758 | −9.668 | 531.155 | 389.224 | 19.018 | 538.576 |
| 419.399 | −25.303 | 531.155 | 403.340 | 15.032 | 538.576 |
| 413.511 | −18.843 | 531.155 | 402.509 | −1.455 | 538.576 |
| 404.810 | −5.055 | 531.155 | 388.982 | 4.215 | 538.576 |
| 411.280 | 0.223 | 531.155 | 382.532 | 11.359 | 538.576 |
| 416.515 | −15.223 | 531.155 | 394.747 | 20.275 | 538.576 |
| 418.417 | −28.109 | 531.155 | 406.575 | 10.291 | 538.576 |
| 410.562 | −13.819 | 531.155 | 398.588 | 2.731 | 538.576 |
| 413.277 | −5.249 | 531.155 | 383.592 | 2.434 | 538.576 |
| 418.177 | −20.806 | 531.155 | 385.656 | 16.153 | 538.576 |
| 415.763 | −22.924 | 531.155 | 400.029 | 18.202 | 538.576 |
| 407.458 | −8.890 | 531.155 | 409.167 | 5.166 | 538.576 |
| 393.448 | 5.086 | 538.576 | 415.768 | −13.209 | 538.576 |
| 381.245 | 6.964 | 538.576 | 414.044 | −19.969 | 538.576 |
| 390.258 | 19.519 | 538.576 | 405.843 | −6.133 | 538.576 |
| 404.055 | 14.132 | 538.576 | 414.023 | −7.734 | 538.576 |
| 401.787 | −0.561 | 538.576 | 416.774 | −16.506 | 538.576 |
| 387.933 | 3.745 | 538.576 | 419.266 | −28.498 | 538.576 |
| 383.036 | 12.391 | 538.576 | 411.233 | −14.958 | 538.576 |
| 395.883 | 20.108 | 538.576 | 414.380 | −8.827 | 538.576 |
| 407.136 | 9.288 | 538.576 | 418.676 | −23.134 | 538.576 |
| 397.677 | 3.431 | 538.576 | 416.205 | −24.026 | 538.576 |
| 382.513 | 2.808 | 538.576 | 408.305 | −10.014 | 538.576 |
| 386.459 | 16.975 | 538.576 | 417.428 | −18.710 | 538.576 |
| 400.933 | 17.493 | 538.576 | 419.540 | −26.471 | 538.576 |
| 392.300 | 5.092 | 538.576 | 413.491 | −18.962 | 538.576 |
| 381.435 | 8.097 | 538.576 | 405.204 | −5.177 | 538.576 |
| 391.339 | 19.907 | 538.576 | 412.921 | −4.468 | 538.576 |
| 404.732 | 13.204 | 538.576 | 417.103 | −17.607 | 538.576 |
| 401.040 | 0.312 | 538.576 | 418.277 | −28.129 | 538.576 |
| 386.893 | 3.257 | 538.576 | 410.658 | −13.963 | 538.576 |
| 383.602 | 13.391 | 538.576 | 410.081 | 3.057 | 538.576 |
| 396.991 | 19.804 | 538.576 | 415.673 | −23.007 | 538.576 |
| 407.673 | 8.273 | 538.576 | 407.701 | −9.036 | 538.576 |
| 396.706 | 4.045 | 538.576 | 409.631 | 4.115 | 538.576 |
| 381.703 | 3.605 | 538.576 | 411.760 | −1.222 | 538.576 |
| 387.322 | 17.733 | 538.576 | 416.106 | −14.307 | 538.576 |
| 401.783 | 16.721 | 538.576 | 419.804 | −27.589 | 538.576 |
| 391.163 | 4.927 | 538.576 | 412.933 | −17.957 | 538.576 |
| 381.723 | 9.209 | 538.576 | 404.553 | −4.230 | 538.576 |
| 392.457 | 20.169 | 538.576 | 413.294 | −5.555 | 538.576 |
| 405.376 | 12.252 | 538.576 | 417.749 | −19.813 | 538.576 |
| 400.261 | 1.158 | 538.576 | 417.761 | −27.102 | 538.576 |
| 385.836 | 2.807 | 538.576 | 410.078 | −12.971 | 538.576 |
| 384.228 | 14.355 | 538.576 | 410.518 | 1.994 | 538.576 |
| 398.056 | 19.375 | 538.576 | 414.733 | −9.920 | 538.576 |
| 408.190 | 7.246 | 538.576 | 418.973 | −24.244 | 538.576 |
| 395.673 | 4.546 | 538.576 | 415.136 | −21.991 | 538.576 |
| 381.301 | 4.676 | 538.576 | 407.090 | −8.063 | 538.576 |
| 388.245 | 18.418 | 538.576 | 412.155 | −2.301 | 538.576 |
| 402.584 | 15.897 | 538.576 | 412.371 | −16.955 | 538.576 |
| 412.542 | −3.383 | 538.576 | 403.889 | −3.293 | 538.576 |
| 416.441 | −15.406 | 538.576 | 413.661 | −6.644 | 538.576 |
| 411.804 | −15.955 | 538.576 | 418.063 | −20.918 | 538.576 |
| 415.081 | −11.015 | 538.576 | 417.249 | −26.073 | 538.576 |
| 418.372 | −22.025 | 538.576 | 409.492 | −11.982 | 538.576 |
| 416.730 | −25.048 | 538.576 | 410.943 | 0.926 | 538.576 |
| 408.901 | −10.996 | 538.576 | 415.426 | −12.112 | 538.576 |
| 411.357 | −0.146 | 538.576 | 419.263 | −25.356 | 538.576 |
| 414.593 | −20.979 | 538.576 | 410.634 | 1.649 | 545.997 |
| 406.471 | −7.095 | 538.576 | 412.600 | −3.632 | 545.997 |
| 384.914 | 15.272 | ~545.997 | 411.046 | 0.600 | 545.997 |
| 398.739 | 19.015 | 545.997 | 412.968 | −4.697 | 545.997 |
| 408.381 | 6.814 | 545.997 | 409.325 | 4.767 | 545.997 |
| 396.935 | 4.976 | 545.997 | 411.448 | −0.453 | 545.997 |
| 389.060 | 19.029 | 545.997 | 409.774 | 3.733 | 545.997 |
| 403.019 | 15.392 | 545.997 | 411.840 | −1.509 | 545.997 |

TABLE II-continued

| Stage 1 Bucket Airfoil | | | | | |
|---|---|---|---|---|---|
| X | Y | R | X | Y | R |
| 391.563 | 6.256 | 545.997 | 410.210 | 2.694 | 545.997 |
| 382.753 | 11.332 | 545.997 | 412.224 | −2.569 | 545.997 |
| 394.464 | 20.322 | 545.997 | 387.263 | 4.946 | 545.997 |
| 406.264 | 10.793 | 545.997 | 382.320 | 5.834 | 545.997 |
| 385.619 | 16.151 | 545.997 | 401.787 | 0.312 | 545.997 |
| 399.697 | 18.422 | 545.997 | 386.198 | 4.577 | 545.997 |
| 408.861 | 5.794 | 545.997 | 382.038 | 6.922 | 545.997 |
| 395.948 | 5.520 | 545.997 | 390.455 | 6.054 | 545.997 |
| 390.068 | 19.533 | 545.997 | 403.797 | −2.407 | 545.997 |
| 403.736 | 14.522 | 545.997 | 385.096 | 4.347 | 545.997 |
| 400.329 | 2.030 | 545.997 | 382.006 | 8.047 | 545.997 |
| 383.188 | 12.371 | 545.997 | 389.373 | 5.738 | 545.997 |
| 395.581 | 20.182 | 545.997 | 383.977 | 4.423 | 545.997 |
| 406.826 | 9.816 | 545.997 | 403.146 | −1.487 | 545.997 |
| 386.386 | 16.976 | 545.997 | 382.142 | 9.165 | 545.997 |
| 400.602 | 17.750 | 545.997 | 402.477 | −0.580 | 545.997 |
| 401.073 | 1.183 | 545.997 | 388.314 | 5.353 | 545.997 |
| 394.902 | 5.938 | 545.997 | 382.983 | 4.936 | 545.997 |
| 391.124 | 19.925 | 545.997 | 382.399 | 10.262 | 545.997 |
| 404.416 | 13.623 | 545.997 | 412.440 | −16.929 | 545.997 |
| 383.696 | 13.377 | 545.997 | 405.664 | −5.226 | 545.997 |
| 396.674 | 19.909 | 545.997 | 414.038 | −7.905 | 545.997 |
| 407.365 | 8.826 | 545.997 | 418.552 | −23.024 | 545.997 |
| 398.730 | 3.618 | 545.997 | 404.432 | −3.338 | 545.997 |
| 387.217 | 17.738 | 545.997 | 410.262 | −12.982 | 545.997 |
| 401.456 | 17.014 | 545.997 | 415.729 | −13.281 | 545.997 |
| 393.809 | 6.207 | 545.997 | 414.563 | −20.906 | 545.997 |
| 392.219 | 20.192 | 545.997 | 407.439 | −8.104 | 545.997 |
| 405.061 | 12.699 | 545.997 | 417.337 | −18.682 | 545.997 |
| 399.551 | 2.845 | 545.997 | 418.149 | −27.934 | 545.997 |
| 384.272 | 14.345 | 545.997 | 411.901 | −15.939 | 545.997 |
| 397.730 | 19.515 | 545.997 | 414.384 | −8.978 | 545.997 |
| 407.883 | 7.825 | 545.997 | 418.843 | −24.113 | 545.997 |
| 397.861 | 4.335 | 545.997 | 416.118 | −23.909 | 545.997 |
| 388.109 | 18.426 | 545.997 | 409.707 | −12.000 | 545.997 |
| 402.260 | 16.225 | 545.997 | 416.057 | −14.359 | 545.997 |
| 392.687 | 6.313 | 545.997 | 414.037 | −19.910 | 545.997 |
| 393.337 | 20.326 | 545.997 | 406.856 | −7.140 | 545.997 |
| 405.677 | 11.755 | 545.997 | 417.648 | −19.766 | 545.997 |
| 417.637 | −26.930 | 545.997 | 383.881 | 13.603 | 553.418 |
| 414.726 | −10.052 | 545.997 | 396.458 | 20.102 | 553.418 |
| 419.129 | −25.203 | 545.997 | 407.051 | 9.406 | 553.418 |
| 419.126 | −28.283 | 545.997 | 400.413 | 2.916 | 553.418 |
| 415.604 | −22.906 | 545.997 | 386.701 | 6.749 | 553.418 |
| 409.148 | −11.022 | 545.997 | 387.232 | 17.925 | 553.418 |
| 416.381 | −15.439 | 545.997 | 401.160 | 17.320 | 553.418 |
| 413.508 | −18.914 | 545.997 | 396.278 | 6.517 | 553.418 |
| 406.265 | −6.180 | 545.997 | 382.836 | 9.369 | 553.418 |
| 413.330 | −5.765 | 545.997 | 392.104 | 20.356 | 553.418 |
| 417.954 | −20.850 | 545.997 | 404.748 | 13.159 | 553.418 |
| 417.136 | −25.921 | 545.997 | 403.111 | −0.563 | 553.418 |
| 411.358 | −14.951 | 545.997 | 390.998 | 7.698 | 553.418 |
| 415.064 | −11.127 | 545.997 | 384.407 | 14.570 | 553.418 |
| 419.403 | −26.296 | 545.997 | 397.492 | 19.724 | 553.418 |
| 408.584 | −10.046 | 545.997 | 407.569 | 8.434 | 553.418 |
| 416.703 | −16.519 | 545.997 | 399.670 | 3.730 | 553.418 |
| 405.054 | −4.278 | 545.997 | 385.609 | 6.616 | 553.418 |
| 412.975 | −17.921 | 545.997 | 388.099 | 18.603 | 553.418 |
| 413.687 | −6.834 | 545.997 | 401.958 | 16.561 | 553.418 |
| 418.255 | −21.936 | 545.997 | 395.299 | 7.020 | 553.418 |
| 416.629 | −24.914 | 545.997 | 382.883 | 10.468 | 553.418 |
| 410.812 | −13.965 | 545.997 | 393.196 | 20.493 | 553.418 |
| 415.398 | −12.203 | 545.997 | 405.363 | 12.245 | 553.418 |
| 419.662 | −27.393 | 545.997 | 402.469 | 0.332 | 553.418 |
| 415.085 | −21.905 | 545.997 | 389.910 | 7.531 | 553.418 |
| 408.015 | −9.073 | 545.997 | 385.011 | 15.491 | 553.418 |
| 417.022 | −17.600 | 545.997 | 398.482 | 19.242 | 553.418 |
| 398.070 | 5.242 | 553.418 | 408.067 | 7.452 | 553.418 |
| 383.602 | 7.358 | 553.418 | 398.891 | 4.508 | 553.418 |
| 390.007 | 19.696 | 553.418 | 384.525 | 6.773 | 553.418 |
| 403.426 | 14.920 | 553.418 | 389.026 | 19.197 | 553.418 |
| 393.194 | 7.648 | 553.418 | 402.712 | 15.759 | 553.418 |
| 383.440 | 12.594 | 553.418 | 394.267 | 7.404 | 553.418 |
| 395.389 | 20.363 | 553.418 | 383.099 | 11.547 | 553.418 |
| 406.512 | 10.366 | 553.418 | 394.296 | 20.496 | 553.418 |

TABLE II-continued

| Stage 1 Bucket Airfoil | | | | | |
|---|---|---|---|---|---|
| X | Y | R | X | Y | R |
| 401.124 | 2.076 | 553.418 | 405.950 | 11.313 | 553.418 |
| 387.772 | 7.003 | 553.418 | 401.808 | 1.213 | 553.418 |
| 386.426 | 17.175 | 553.418 | 388.837 | 7.284 | 553.418 |
| 400.316 | 18.027 | 553.418 | 385.685 | 16.361 | 553.418 |
| 409.013 | 5.463 | 553.418 | 399.424 | 18.672 | 553.418 |
| 397.201 | 5.917 | 553.418 | 408.548 | 6.462 | 553.418 |
| 383.034 | 8.290 | 553.418 | 414.531 | −20.656 | 553.418 |
| 391.037 | 20.087 | 553.418 | 407.219 | −7.083 | 553.418 |
| 404.104 | 14.052 | 553.418 | 410.734 | 1.409 | 553.418 |
| 403.735 | −1.471 | 553.418 | 415.689 | −13.187 | 553.418 |
| 392.098 | 7.744 | 553.418 | 411.990 | −15.771 | 553.418 |
| 404.344 | −2.388 | 553.418 | 404.940 | −3.314 | 553.418 |
| 412.649 | −3.754 | 553.418 | 412.283 | −2.715 | 553.418 |
| 417.243 | −18.470 | 553.418 | 416.938 | −17.411 | 553.418 |
| 416.531 | −24.581 | 553.418 | 417.027 | −25.564 | 553.418 |
| 409.383 | −10.920 | 553.418 | 409.911 | −11.887 | 553.418 |
| 414.386 | −8.979 | 553.418 | 414.049 | −7.930 | 553.418 |
| 418.710 | −23.777 | 553.418 | 418.425 | −22.713 | 553.418 |
| 414.027 | −19.677 | 553.418 | 404.452 | 13.543 | 560.839 |
| 406.663 | −6.133 | 553.418 | 392.062 | 20.315 | 560.839 |
| 411.135 | 0.383 | 553.418 | 384.351 | 9.840 | 560.839 |
| 416.006 | −14.242 | 553.418 | 398.252 | 6.034 | 560.839 |
| 418.992 | −27.849 | 553.418 | 400.911 | 17.529 | 560.839 |
| 411.475 | −14.797 | 553.418 | 387.276 | 18.060 | 560.839 |
| 413.008 | −4.795 | 553.418 | 389.504 | 9.232 | 560.839 |
| 417.544 | −19.529 | 553.418 | 401.785 | 2.036 | 560.839 |
| 416.034 | −23.598 | 553.418 | 406.731 | 9.929 | 560.839 |
| 408.850 | −9.957 | 553.418 | 396.295 | 20.134 | 560.839 |
| 409.463 | 4.458 | 553.418 | 384.058 | 13.865 | 560.839 |
| 414.717 | −10.029 | 553.418 | 394.731 | 8.426 | 560.839 |
| 418.991 | −24.842 | 553.418 | 403.814 | 14.401 | 560.839 |
| 413.520 | −18.699 | 553.418 | 391.024 | 20.061 | 560.839 |
| 406.098 | −5.188 | 553.418 | 385.257 | 9.291 | 560.839 |
| 411.527 | −0.646 | 553.418 | 399.022 | 5.293 | 560.839 |
| 416.320 | −15.297 | 553.418 | 408.680 | 6.125 | 560.839 |
| 418.028 | −27.525 | 553.418 | 400.081 | 18.202 | 560.839 |
| 410.957 | −13.825 | 553.418 | 386.474 | 17.354 | 560.839 |
| 413.361 | −5.838 | 553.418 | 390.572 | 9.266 | 560.839 |
| 417.842 | −20.589 | 553.418 | 402.414 | 1.172 | 560.839 |
| 415.535 | −22.616 | 553.418 | 406.197 | 10.855 | 560.839 |
| 408.312 | −8.996 | 553.418 | 395.252 | 20.362 | 560.839 |
| 409.899 | 3.447 | 553.418 | 383.742 | 12.846 | 560.839 |
| 415.045 | −11.081 | 553.418 | 395.683 | 7.943 | 560.839 |
| 419.264 | −25.909 | 553.418 | 403.145 | 15.234 | 560.839 |
| 413.012 | −17.722 | 553.418 | 390.019 | 19.700 | 560.839 |
| 405.524 | −4.248 | 553.418 | 386.304 | 9.091 | 560.839 |
| 411.909 | −1.679 | 553.418 | 399.756 | 4.517 | 560.839 |
| 416.630 | −16.354 | 553.418 | 408.218 | 7.089 | 560.839 |
| 417.520 | −26.549 | 553.418 | 399.204 | 18.812 | 560.839 |
| 410.436 | −12.855 | 553.418 | 385.740 | 16.578 | 560.839 |
| 413.708 | −6.883 | 553.418 | 391.640 | 9.221 | 560.839 |
| 418.135 | −21.651 | 553.418 | 403.025 | 0.295 | 560.839 |
| 415.034 | −21.635 | 553.418 | 405.640 | 11.767 | 560.839 |
| 407.769 | −8.038 | 553.418 | 394.189 | 20.471 | 560.839 |
| 410.322 | 2.430 | 553.418 | 383.620 | 11.786 | 560.839 |
| 415.369 | −12.133 | 553.418 | 396.587 | 7.372 | 560.839 |
| 419.518 | −26.980 | 553.418 | 402.440 | 16.037 | 560.839 |
| 412.502 | −16.746 | 553.418 | 389.055 | 19.240 | 560.839 |
| 387.372 | 9.087 | 560.839 | 410.394 | 2.209 | 560.839 |
| 400.459 | 3.712 | 560.839 | 407.987 | −7.941 | 560.839 |
| 407.741 | 8.045 | 560.839 | 414.964 | −21.177 | 560.839 |
| 398.278 | 19.346 | 560.839 | 418.005 | −21.150 | 560.839 |
| 385.083 | 15.736 | 560.839 | 413.695 | −6.823 | 560.839 |
| 392.697 | 9.070 | 560.839 | 410.523 | −12.645 | 560.839 |
| 403.620 | −0.593 | 560.839 | 417.411 | −25.927 | 560.839 |
| 405.059 | 12.664 | 560.839 | 416.542 | −16.011 | 560.839 |
| 393.121 | 20.454 | 560.839 | 411.938 | −1.777 | 560.839 |
| 383.784 | 10.735 | 560.839 | 405.873 | −4.226 | 560.839 |
| 397.442 | 6.731 | 560.839 | 412.999 | −17.381 | 560.839 |
| 401.696 | 16.805 | 560.839 | 419.121 | −25.277 | 560.839 |
| 388.138 | 18.691 | 560.839 | 415.000 | −10.894 | 560.839 |
| 388.438 | 9.158 | 560.839 | 409.984 | 3.196 | 560.839 |
| 401.134 | 2.884 | 560.839 | 408.502 | −8.878 | 560.839 |
| 407.245 | 8.992 | 560.839 | 415.454 | −22.127 | 560.839 |
| 397.307 | 19.792 | 560.839 | 417.718 | −20.121 | 560.839 |

TABLE II-continued

| Stage 1 Bucket Airfoil | | | | | |
|---|---|---|---|---|---|
| X | Y | R | X | Y | R |
| 384.516 | 14.830 | 560.839 | 413.356 | −5.810 | 560.839 |
| 393.732 | 8.806 | 560.839 | 411.021 | −13.590 | 560.839 |
| 404.200 | −1.490 | 560.839 | 417.917 | −26.868 | 560.839 |
| 415.935 | −13.961 | 560.839 | 416.240 | −14.985 | 560.839 |
| 411.184 | 0.223 | 560.839 | 411.565 | −0.775 | 560.839 |
| 406.943 | −6.076 | 560.839 | 406.411 | −5.149 | 560.839 |
| 413.982 | −19.278 | 560.839 | 413.491 | −18.329 | 560.839 |
| 418.570 | −23.212 | 560.839 | 418.848 | −24.244 | 560.839 |
| 414.357 | −8.856 | 560.839 | 414.680 | −9.874 | 560.839 |
| 409.128 | 5.155 | 560.839 | 409.562 | 4.178 | 560.839 |
| 409.519 | −10.758 | 560.839 | 409.012 | −9.817 | 560.839 |
| 416.433 | −24.027 | 560.839 | 415.944 | −23.077 | 560.839 |
| 417.136 | −18.064 | 560.839 | 417.429 | −19.092 | 560.839 |
| 412.661 | −3.789 | 560.839 | 413.012 | −4.798 | 560.839 |
| 404.768 | −2.396 | 560.839 | 411.517 | −14.537 | 560.839 |
| 412.012 | −15.484 | 560.839 | 418.862 | −27.161 | 560.839 |
| 415.627 | −12.938 | 560.839 | 408.693 | 5.959 | 568.260 |
| 410.794 | 1.218 | 560.839 | 400.411 | 17.694 | 568.260 |
| 407.468 | −7.007 | 560.839 | 386.925 | 11.445 | 568.260 |
| 414.473 | −20.228 | 560.839 | 399.639 | 5.309 | 568.260 |
| 418.289 | −22.181 | 560.839 | 406.306 | 10.551 | 568.260 |
| 414.028 | −7.839 | 560.839 | 392.722 | 20.289 | 568.260 |
| 410.022 | −11.701 | 560.839 | 391.988 | 10.375 | 568.260 |
| 416.923 | −24.977 | 560.839 | 402.752 | 1.177 | 568.260 |
| 416.840 | −17.037 | 560.839 | 390.672 | 20.021 | 568.260 |
| 412.303 | −2.781 | 560.839 | 403.369 | 14.807 | 568.260 |
| 405.325 | −3.308 | 560.839 | 384.226 | 14.133 | 568.260 |
| 412.506 | −16.432 | 560.839 | 396.621 | 8.134 | 568.260 |
| 419.371 | −26.315 | 560.839 | 391.691 | 20.203 | 568.260 |
| 415.315 | −11.915 | 560.839 | 408.248 | 6.894 | 568.260 |
| 394.787 | 20.173 | 568.260 | 407.504 | −6.836 | 568.260 |
| 387.933 | 11.209 | 568.260 | 414.366 | −19.605 | 568.260 |
| 400.309 | 4.519 | 568.260 | 416.815 | −24.166 | 568.260 |
| 388.708 | 19.374 | 568.260 | 416.704 | −16.446 | 568.260 |
| 405.772 | 11.438 | 568.260 | 412.221 | −2.663 | 568.260 |
| 397.756 | 19.293 | 568.260 | 409.971 | −11.388 | 568.260 |
| 392.976 | 10.067 | 568.260 | 419.221 | −25.417 | 568.260 |
| 403.318 | 0.310 | 568.260 | 415.198 | −11.493 | 568.260 |
| 384.809 | 16.097 | 568.260 | 410.353 | 2.165 | 568.260 |
| 402.688 | 15.587 | 568.260 | 405.470 | −3.229 | 568.260 |
| 384.432 | 13.127 | 568.260 | 412.411 | −15.954 | 568.260 |
| 397.433 | 7.491 | 568.260 | 417.854 | −20.425 | 568.260 |
| 407.788 | 7.821 | 568.260 | 413.594 | −6.571 | 568.260 |
| 399.568 | 18.295 | 568.260 | 408.002 | −7.744 | 568.260 |
| 388.950 | 11.017 | 568.260 | 414.856 | −20.518 | 568.260 |
| 400.952 | 3.708 | 568.260 | 416.409 | −15.454 | 568.260 |
| 386.109 | 17.699 | 568.260 | 411.862 | −1.692 | 568.260 |
| 405.214 | 12.310 | 568.260 | 410.459 | −12.301 | 568.260 |
| 396.794 | 19.676 | 568.260 | 418.969 | −24.414 | 568.260 |
| 393.941 | 9.690 | 568.260 | 414.886 | −10.506 | 568.260 |
| 403.872 | −0.565 | 568.260 | 409.954 | 3.120 | 568.260 |
| 384.392 | 15.151 | 568.260 | 405.986 | −4.126 | 568.260 |
| 401.970 | 16.333 | 568.260 | 412.899 | −16.867 | 568.260 |
| 385.063 | 12.317 | 568.260 | 418.736 | −26.242 | 568.260 |
| 398.205 | 6.801 | 568.260 | 417.570 | −19.429 | 568.260 |
| 407.312 | 8.741 | 568.260 | 413.259 | −5.591 | 568.260 |
| 393.757 | 20.279 | 568.260 | 408.497 | −8.654 | 568.260 |
| 389.969 | 10.832 | 568.260 | 416.112 | −14.462 | 568.260 |
| 401.572 | 2.878 | 568.260 | 411.497 | −0.723 | 568.260 |
| 385.398 | 16.947 | 568.260 | 416.326 | −23.254 | 568.260 |
| 404.629 | 13.165 | 568.260 | 410.948 | −13.214 | 568.260 |
| 395.802 | 19.971 | 568.260 | 418.692 | −23.416 | 568.260 |
| 394.873 | 9.241 | 568.260 | 414.570 | −9.520 | 568.260 |
| 387.783 | 18.911 | 568.260 | 409.545 | 4.071 | 568.260 |
| 401.211 | 17.038 | 568.260 | 406.497 | −5.027 | 568.260 |
| 385.947 | 11.784 | 568.260 | 413.387 | −17.780 | 568.260 |
| 398.939 | 6.071 | 568.260 | 417.811 | −25.981 | 568.260 |
| 406.818 | 9.651 | 568.260 | 417.284 | −18.434 | 568.260 |
| 398.682 | 18.830 | 568.260 | 412.919 | −4.613 | 568.260 |
| 390.983 | 10.625 | 568.260 | 408.990 | −9.564 | 568.260 |
| 402.171 | 2.034 | 568.260 | 415.811 | −13.471 | 568.260 |
| 389.674 | 19.744 | 568.260 | 411.123 | 0.243 | 568.260 |
| 404.015 | 13.998 | 568.260 | 415.836 | −22.342 | 568.260 |
| 395.768 | 8.720 | 568.260 | 404.414 | −1.447 | 568.260 |
| 386.911 | 18.352 | 568.260 | 411.435 | −14.127 | 568.260 |

TABLE II-continued

| Stage 1 Bucket Airfoil | | | | | |
|---|---|---|---|---|---|
| X | Y | R | X | Y | R |
| 418.135 | −21.422 | 568.260 | 418.414 | −22.419 | 568.260 |
| 413.924 | −7.552 | 568.260 | 414.249 | −8.535 | 568.260 |
| 409.125 | 5.018 | 568.260 | 409.481 | −10.476 | 568.260 |
| 407.003 | −5.930 | 568.260 | 415.506 | −12.481 | 568.260 |
| 413.876 | −18.693 | 568.260 | 410.742 | 1.206 | 568.260 |
| 417.305 | −25.079 | 568.260 | 415.346 | −21.430 | 568.260 |
| 416.995 | −17.440 | 568.260 | 404.946 | −2.336 | 568.260 |
| 412.573 | −3.637 | 568.260 | 411.923 | −15.041 | 568.260 |

Figure 3:
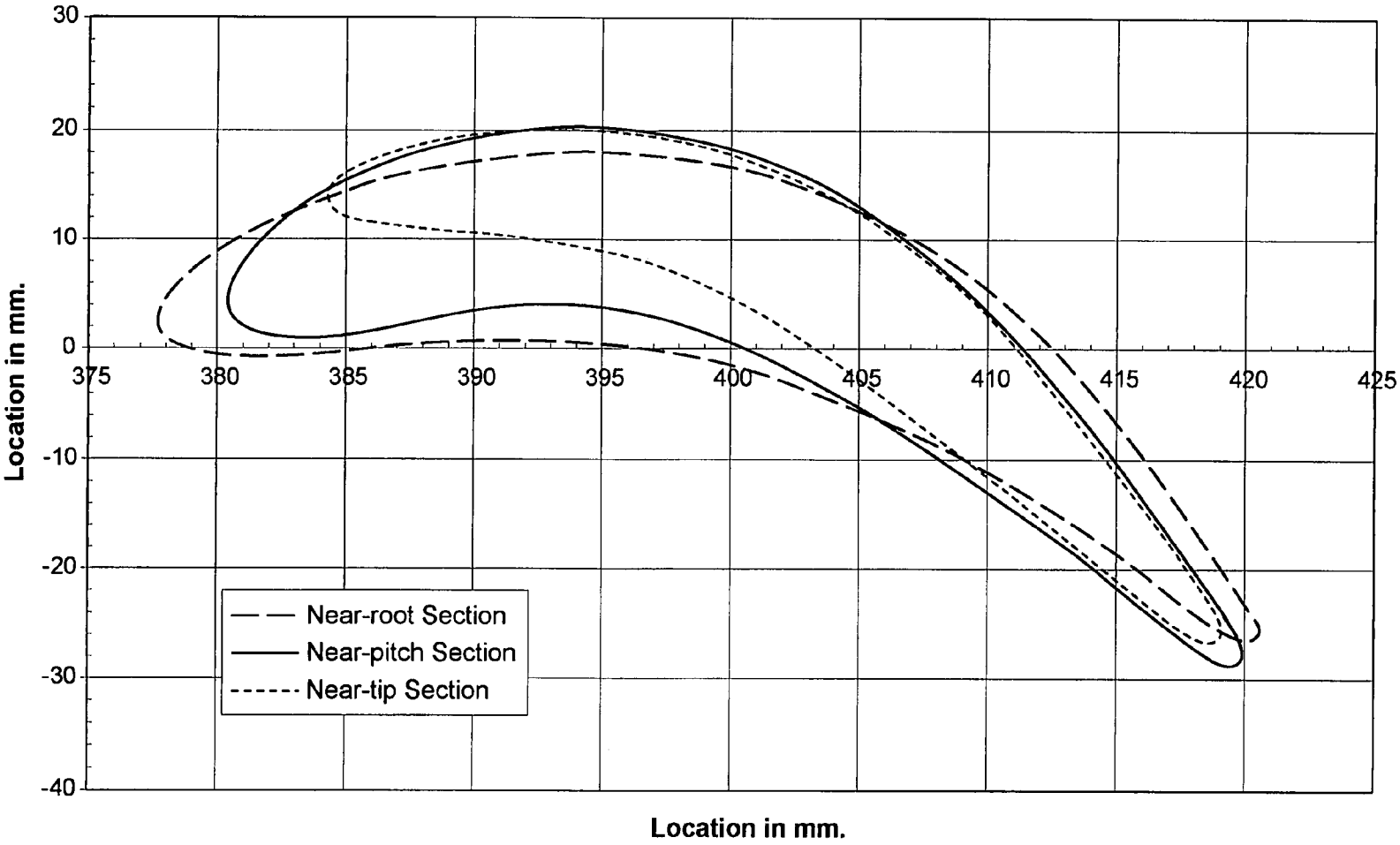

As an example, the profile sections of the first stage bucket airfoils 18 at each of the near root, near pitch and near tip distances R are illustrated in FIG. 3.

The coordinate values given in Table III below provide the preferred nominal profile shape excluding fillet regions for the second stage nozzle airfoils 20.

TABLE III

| Stage 2 Nozzle Airfoil | | |
|---|---|---|
| X | Y | R |
| 18.248 | 27.890 | 494.350 |
| 14.572 | 22.815 | 494.350 |
| 19.133 | 29.183 | 494.350 |
| 15.512 | 24.068 | 494.350 |
| 20.005 | 30.485 | 494.350 |
| 16.438 | 25.332 | 494.350 |
| 17.350 | 26.607 | 494.350 |
| 21.711 | 33.113 | 494.350 |
| 25.942 | 34.060 | 494.350 |
| 28.655 | 42.470 | 494.350 |
| 25.768 | 39.814 | 494.350 |
| 23.313 | 26.680 | 494.350 |
| 27.922 | 40.006 | 494.350 |
| 22.545 | 34.439 | 494.350 |
| 25.430 | 32.579 | 494.350 |
| 28.609 | 42.826 | 494.350 |
| 26.538 | 41.178 | 494.350 |
| 22.769 | 25.211 | 494.350 |
| 27.439 | 38.515 | 494.350 |
| 23.368 | 35.773 | 494.350 |
| 24.911 | 31.100 | 494.350 |
| 28.375 | 43.097 | 494.350 |
| 22.220 | 23.743 | 494.350 |
| 26.945 | 37.028 | 494.350 |
| 24.180 | 37.113 | 494.350 |
| 24.385 | 29.624 | 494.350 |
| 28.033 | 43.192 | 494.350 |
| 20.864 | 31.795 | 494.350 |
| 26.446 | 35.543 | 494.350 |
| 24.980 | 38.460 | 494.350 |
| 23.852 | 28.151 | 494.350 |
| 27.702 | 43.103 | 494.350 |
| 28.369 | 41.507 | 494.350 |
| −18.628 | −2.056 | 494.350 |
| −17.144 | −1.553 | 494.350 |
| −8.417 | 1.916 | 494.350 |
| −1.758 | 6.026 | 494.350 |
| −14.179 | −0.538 | 494.350 |
| −7.033 | 2.649 | 494.350 |
| −0.506 | 6.968 | 494.350 |
| −12.712 | 0.011 | 494.350 |
| −5.674 | 3.429 | 494.350 |
| 0.718 | 7.946 | 494.350 |
| −11.260 | 0.600 | 494.350 |
| −4.342 | 4.254 | 494.350 |
| −9.827 | 1.233 | 494.350 |
| −3.036 | 5.120 | 494.350 |
| −15.659 | −1.054 | 494.350 |
| −27.296 | −8.215 | 494.350 |
| −26.634 | −15.701 | 494.350 |

TABLE III-continued

| Stage 2 Nozzle Airfoil | | |
|---|---|---|
| X | Y | R |
| −21.556 | −3.169 | 494.350 |
| −22.116 | −19.953 | 494.350 |
| −27.786 | −9.701 | 494.350 |
| −26.526 | −6.854 | 494.350 |
| −27.344 | −14.306 | 494.350 |
| −20.102 | −2.586 | 494.350 |
| −23.427 | −19.097 | 494.350 |
| −25.508 | −5.665 | 494.350 |
| −27.804 | −12.811 | 494.350 |
| −17.763 | −21.683 | 494.350 |
| −24.637 | −18.103 | 494.350 |
| −24.303 | −4.667 | 494.350 |
| −27.960 | −11.255 | 494.350 |
| −19.267 | −21.246 | 494.350 |
| −25.718 | −16.970 | 494.350 |
| −22.968 | −3.848 | 494.350 |
| −20.723 | −20.670 | 494.350 |
| −6.984 | −20.936 | 494.350 |
| −14.667 | −22.140 | 494.350 |
| −1.499 | −17.944 | 494.350 |
| −8.471 | −21.428 | 494.350 |
| −16.225 | −21.981 | 494.350 |
| −2.793 | −18.826 | 494.350 |
| −9.992 | −21.801 | 494.350 |
| −4.140 | −19.626 | 494.350 |
| −11.539 | −22.048 | 494.350 |
| 0.930 | −15.966 | 494.350 |
| −5.538 | −20.333 | 494.350 |
| −13.101 | −22.162 | 494.350 |
| −0.258 | −16.988 | 494.350 |
| 8.596 | 15.562 | 494.350 |
| 4.235 | 11.063 | 494.350 |
| 9.635 | 16.734 | 494.350 |
| 5.358 | 12.155 | 494.350 |
| 10.657 | 17.922 | 494.350 |
| 6.458 | 13.271 | 494.350 |
| 1.916 | 8.956 | 494.350 |
| 7.537 | 14.407 | 494.350 |
| 3.088 | 9.996 | 494.350 |
| 18.248 | 13.520 | 494.350 |
| 13.617 | 21.573 | 494.350 |
| 15.202 | 6.303 | 494.350 |
| 20.547 | 19.351 | 494.350 |
| 17.657 | 12.069 | 494.350 |
| 14.560 | 4.874 | 494.350 |
| 19.981 | 17.890 | 494.350 |
| 17.058 | 10.622 | 494.350 |
| 19.410 | 16.431 | 494.350 |
| 11.660 | 19.125 | 494.350 |
| 16.450 | 9.178 | 494.350 |
| 21.666 | 22.278 | 494.350 |
| 18.832 | 14.974 | 494.350 |
| 12.647 | 20.342 | 494.350 |
| 15.832 | 7.738 | 494.350 |
| 21.109 | 20.813 | 494.350 |
| 8.753 | −6.224 | 494.350 |
| 4.186 | −12.581 | 494.350 |
| 7.911 | −7.546 | 494.350 |
| 3.150 | −13.756 | 494.350 |
| 11.098 | −2.152 | 494.350 |
| 7.036 | −8.846 | 494.350 |
| 2.065 | −14.887 | 494.350 |
| 10.344 | −3.525 | 494.350 |
| 6.126 | −10.121 | 494.350 |
| 9.563 | −4.883 | 494.350 |
| 5.177 | −11.367 | 494.350 |
| 11.829 | −0.766 | 494.350 |
| 13.902 | 3.452 | 494.350 |
| 13.229 | 2.037 | 494.350 |
| 12.538 | 0.631 | 494.350 |
| 29.098 | 43.055 | 501.440 |
| 29.063 | 43.422 | 501.440 |
| 28.824 | 43.703 | 501.440 |
| 28.475 | 43.801 | 501.440 |
| 28.005 | 43.581 | 501.440 |

TABLE III-continued

| Stage 2 Nozzle Airfoil | | |
|---|---|---|
| X | Y | R |
| 14.895 | 22.842 | 501.440 |
| 19.519 | 29.429 | 501.440 |
| 15.849 | 24.138 | 501.440 |
| 16.787 | 25.446 | 501.440 |
| 12.940 | 20.283 | 501.440 |
| 17.712 | 26.764 | 501.440 |
| 13.926 | 21.556 | 501.440 |
| 18.622 | 28.092 | 501.440 |
| 27.018 | 41.820 | 501.440 |
| 23.091 | 25.177 | 501.440 |
| 27.826 | 38.868 | 501.440 |
| 23.806 | 36.239 | 501.440 |
| 25.263 | 31.239 | 501.440 |
| 22.535 | 23.666 | 501.440 |
| 20.402 | 30.775 | 501.440 |
| 27.326 | 37.338 | 501.440 |
| 24.628 | 37.624 | 501.440 |
| 24.729 | 29.720 | 501.440 |
| 21.974 | 22.157 | 501.440 |
| 21.271 | 32.129 | 501.440 |
| 26.821 | 35.810 | 501.440 |
| 25.439 | 39.014 | 501.440 |
| 24.189 | 28.204 | 501.440 |
| 28.772 | 41.945 | 501.440 |
| 21.410 | 20.650 | 501.440 |
| 22.129 | 33.492 | 501.440 |
| 26.309 | 34.284 | 501.440 |
| 26.237 | 40.412 | 501.440 |
| 23.642 | 26.689 | 501.440 |
| 28.315 | 40.402 | 501.440 |
| 22.973 | 34.862 | 501.440 |
| 25.790 | 32.760 | 501.440 |
| −20.751 | −3.025 | 501.440 |
| −19.219 | −2.529 | 501.440 |
| −17.680 | −2.058 | 501.440 |
| −23.734 | −4.228 | 501.440 |
| −22.263 | −3.576 | 501.440 |
| −0.492 | 6.467 | 501.440 |
| −13.088 | −0.567 | 501.440 |
| −5.812 | 2.848 | 501.440 |
| −11.585 | 0.010 | 501.440 |
| −4.438 | 3.687 | 501.440 |
| −10.102 | 0.637 | 501.440 |
| −3.093 | 4.572 | 501.440 |
| −16.141 | −1.588 | 501.440 |
| −8.645 | 1.320 | 501.440 |
| −1.778 | 5.499 | 501.440 |
| −14.608 | −1.097 | 501.440 |
| −7.214 | 2.058 | 501.440 |
| −16.887 | −22.961 | 501.440 |
| −24.217 | −19.813 | 501.440 |
| −26.384 | −6.036 | 501.440 |
| −28.746 | −13.358 | 501.440 |
| −18.457 | −22.605 | 501.440 |
| −28.750 | −10.166 | 501.440 |
| −25.450 | −18.780 | 501.440 |
| −25.127 | −5.033 | 501.440 |
| −28.927 | −11.762 | 501.440 |
| −19.989 | −22.112 | 501.440 |
| −26.557 | −17.612 | 501.440 |
| −21.469 | −21.481 | 501.440 |
| −28.238 | −8.642 | 501.440 |
| −27.503 | −16.311 | 501.440 |
| −22.883 | −20.714 | 501.440 |
| −27.441 | −7.246 | 501.440 |
| −28.250 | −14.887 | 501.440 |
| −3.020 | −20.099 | 501.440 |
| −10.481 | −22.983 | 501.440 |
| −4.418 | −20.897 | 501.440 |
| −12.077 | −23.188 | 501.440 |
| −5.868 | −21.595 | 501.440 |
| −13.685 | −23.252 | 501.440 |
| −0.392 | −18.243 | 501.440 |
| −7.367 | −22.180 | 501.440 |
| −15.293 | −23.176 | 501.440 |

TABLE III-continued

| Stage 2 Nozzle Airfoil | | |
|---|---|---|
| X | Y | R |
| −1.678 | −19.211 | 501.440 |
| −8.908 | −22.645 | 501.440 |
| 5.516 | 11.816 | 501.440 |
| 10.917 | 17.779 | 501.440 |
| 0.765 | 7.473 | 501.440 |
| 6.639 | 12.969 | 501.440 |
| 1.994 | 8.513 | 501.440 |
| 7.740 | 14.143 | 501.440 |
| 3.194 | 9.585 | 501.440 |
| 8.819 | 15.338 | 501.440 |
| 4.368 | 10.687 | 501.440 |
| 9.878 | 16.550 | 501.440 |
| 14.785 | 4.232 | 501.440 |
| 20.270 | 17.639 | 501.440 |
| 17.314 | 10.153 | 501.440 |
| 14.119 | 2.766 | 501.440 |
| 19.692 | 16.137 | 501.440 |
| 11.938 | 19.024 | 501.440 |
| 16.699 | 8.665 | 501.440 |
| 19.108 | 14.636 | 501.440 |
| 16.074 | 7.182 | 501.440 |
| 18.517 | 13.139 | 501.440 |
| 15.436 | 5.704 | 501.440 |
| 20.843 | 19.143 | 501.440 |
| 17.920 | 11.644 | 501.440 |
| 3.128 | −14.943 | 501.440 |
| 7.123 | −9.901 | 501.440 |
| 2.009 | −16.100 | 501.440 |
| 10.502 | −4.422 | 501.440 |
| 6.190 | −11.212 | 501.440 |
| 0.836 | −17.203 | 501.440 |
| 9.706 | −5.821 | 501.440 |
| 5.215 | −12.493 | 501.440 |
| 8.879 | −7.202 | 501.440 |
| 4.196 | −13.739 | 501.440 |
| 8.019 | −8.563 | 501.440 |
| 11.270 | −3.008 | 501.440 |
| 13.436 | −1.309 | 501.440 |
| 12.734 | −0.140 | 501.440 |
| 12.014 | −1.580 | 501.440 |
| 29.514 | 44.020 | 508.530 |
| 29.155 | 42.295 | 508.530 |
| 29.271 | 44.312 | 508.530 |
| 26.749 | 41.089 | 508.530 |
| 28.913 | 44.411 | 508.530 |
| 27.539 | 42.542 | 508.530 |
| 28.566 | 44.295 | 508.530 |
| 29.554 | 43.835 | 508.530 |
| 12.321 | 18.939 | 508.530 |
| 17.222 | 25.597 | 508.530 |
| 13.336 | 20.244 | 508.530 |
| 18.155 | 26.963 | 508.530 |
| 14.333 | 21.564 | 508.530 |
| 19.072 | 28.339 | 508.530 |
| 15.312 | 22.897 | 508.530 |
| 16.275 | 24.242 | 508.530 |
| 20.865 | 31.119 | 508.530 |
| 27.693 | 37.554 | 508.530 |
| 25.124 | 38.207 | 508.530 |
| 25.067 | 29.712 | 508.530 |
| 22.277 | 21.927 | 508.530 |
| 21.742 | 32.522 | 508.530 |
| 27.183 | 35.980 | 508.530 |
| 25.942 | 39.645 | 508.530 |
| 24.520 | 28.151 | 508.530 |
| 21.704 | 20.376 | 508.530 |
| 22.605 | 33.933 | 508.530 |
| 26.665 | 34.409 | 508.530 |
| 23.967 | 26.592 | 508.530 |
| 28.688 | 40.708 | 508.530 |
| 21.128 | 18.825 | 508.530 |
| 23.456 | 35.351 | 508.530 |
| 26.140 | 32.841 | 508.530 |
| 23.408 | 25.036 | 508.530 |
| 19.976 | 29.725 | 508.530 |

TABLE III-continued

| Stage 2 Nozzle Airfoil | | |
|---|---|---|
| X | Y | R |
| 28.195 | 39.129 | 508.530 |
| 24.295 | 36.776 | 508.530 |
| 25.607 | 31.275 | 508.530 |
| 22.845 | 23.481 | 508.530 |
| −25.803 | −5.505 | 508.530 |
| −18.043 | −2.719 | 508.530 |
| −24.333 | −4.750 | 508.530 |
| −22.794 | −4.145 | 508.530 |
| −21.221 | −3.633 | 508.530 |
| −19.634 | −3.168 | 508.530 |
| −11.755 | −0.672 | 508.530 |
| −4.399 | 3.079 | 508.530 |
| −10.228 | −0.037 | 508.530 |
| −3.017 | 3.988 | 508.530 |
| −16.453 | −2.263 | 508.530 |
| −8.726 | 0.657 | 508.530 |
| −1.667 | 4.943 | 508.530 |
| −14.871 | −1.780 | 508.530 |
| −7.254 | 1.410 | 508.530 |
| −0.348 | 5.941 | 508.530 |
| −13.304 | −1.251 | 508.530 |
| −5.811 | 2.219 | 508.530 |
| −26.384 | −19.500 | 508.530 |
| −29.906 | −12.263 | 508.530 |
| −20.838 | −23.036 | 508.530 |
| −27.508 | −18.289 | 508.530 |
| −22.342 | −22.349 | 508.530 |
| −29.147 | −9.070 | 508.530 |
| −28.470 | −16.945 | 508.530 |
| −23.778 | −21.529 | 508.530 |
| −28.287 | −7.661 | 508.530 |
| −29.231 | −15.478 | 508.530 |
| −17.678 | −23.999 | 508.530 |
| −25.131 | −20.579 | 508.530 |
| −27.146 | −6.468 | 508.530 |
| −29.702 | −10.626 | 508.530 |
| −29.733 | −13.904 | 508.530 |
| −19.279 | −23.587 | 508.530 |
| −4.817 | −22.252 | 508.530 |
| −12.746 | −24.387 | 508.530 |
| −6.323 | −22.936 | 508.530 |
| −14.399 | −24.401 | 508.530 |
| −0.640 | −19.590 | 508.530 |
| −7.878 | −23.498 | 508.530 |
| −16.047 | −24.271 | 508.530 |
| −1.973 | −20.568 | 508.530 |
| −9.474 | −23.931 | 508.530 |
| −3.366 | −21.459 | 508.530 |
| −11.100 | −24.229 | 508.530 |
| 6.939 | 12.663 | 508.530 |
| 2.198 | 8.053 | 508.530 |
| 8.060 | 13.880 | 508.530 |
| 3.425 | 9.161 | 508.530 |
| 9.157 | 15.117 | 508.530 |
| 4.624 | 10.301 | 508.530 |
| 10.232 | 16.374 | 508.530 |
| 5.795 | 11.469 | 508.530 |
| 0.940 | 6.978 | 508.530 |
| 19.958 | 15.731 | 508.530 |
| 16.910 | 8.044 | 508.530 |
| 13.580 | 0.475 | 508.530 |
| 19.364 | 14.188 | 508.530 |
| 16.273 | 6.518 | 508.530 |
| 18.763 | 12.647 | 508.530 |
| 15.622 | 4.997 | 508.530 |
| 18.154 | 11.109 | 508.530 |
| 14.958 | 3.483 | 508.530 |
| 20.546 | 17.277 | 508.530 |
| 11.286 | 17.648 | 508.530 |
| 17.537 | 9.574 | 508.530 |
| 14.277 | 1.975 | 508.530 |
| 10.580 | −5.420 | 508.530 |
| 6.156 | −12.400 | 508.530 |
| 0.632 | −18.533 | 508.530 |
| 9.764 | −6.859 | 508.530 |

TABLE III-continued

| Stage 2 Nozzle Airfoil | | |
|---|---|---|
| X | Y | R |
| 5.153 | −13.715 | 508.530 |
| 8.917 | −8.279 | 508.530 |
| 4.103 | −14.993 | 508.530 |
| 8.035 | −9.678 | 508.530 |
| 3.001 | −16.226 | 508.530 |
| 7.116 | −11.053 | 508.530 |
| 1.845 | −17.409 | 508.530 |
| 12.863 | −1.015 | 508.530 |
| 12.126 | −2.496 | 508.530 |
| 11.366 | −3.965 | 508.530 |
| 26.453 | 40.292 | 515.620 |
| 29.535 | 42.623 | 515.620 |
| 29.964 | 44.620 | 515.620 |
| 27.266 | 41.784 | 515.620 |
| 29.062 | 40.992 | 515.620 |
| 29.716 | 44.922 | 515.620 |
| 28.066 | 43.283 | 515.620 |
| 28.567 | 39.367 | 515.620 |
| 29.348 | 45.019 | 515.620 |
| 28.997 | 44.893 | 515.620 |
| 25.629 | 38.807 | 515.620 |
| 29.985 | 44.231 | 515.620 |
| 13.767 | 20.196 | 515.620 |
| 18.622 | 27.164 | 515.620 |
| 14.773 | 21.565 | 515.620 |
| 15.760 | 22.947 | 515.620 |
| 11.695 | 17.503 | 515.620 |
| 16.731 | 24.342 | 515.620 |
| 12.741 | 18.842 | 515.620 |
| 17.684 | 25.748 | 515.620 |
| 24.860 | 28.068 | 515.620 |
| 22.004 | 20.068 | 515.620 |
| 23.095 | 34.385 | 515.620 |
| 27.028 | 34.508 | 515.620 |
| 24.300 | 26.464 | 515.620 |
| 19.545 | 28.591 | 515.620 |
| 21.417 | 18.474 | 515.620 |
| 23.950 | 35.853 | 515.620 |
| 26.497 | 32.894 | 515.620 |
| 23.734 | 24.862 | 515.620 |
| 20.453 | 30.027 | 515.620 |
| 20.824 | 16.882 | 515.620 |
| 24.794 | 37.327 | 515.620 |
| 25.959 | 31.283 | 515.620 |
| 23.163 | 23.262 | 515.620 |
| 21.346 | 31.471 | 515.620 |
| 28.063 | 37.745 | 515.620 |
| 25.413 | 29.674 | 515.620 |
| 22.586 | 21.664 | 515.620 |
| 22.227 | 32.924 | 515.620 |
| 27.549 | 36.125 | 515.620 |
| −24.852 | −5.398 | 515.620 |
| −23.245 | −4.849 | 515.620 |
| −29.095 | −8.127 | 515.620 |
| −21.614 | −4.375 | 515.620 |
| −27.848 | −6.978 | 515.620 |
| −19.973 | −3.933 | 515.620 |
| −26.406 | −6.084 | 515.620 |
| −18.332 | −3.495 | 515.620 |
| −2.894 | 3.373 | 515.620 |
| −16.695 | −3.041 | 515.620 |
| −8.755 | −0.055 | 515.620 |
| −1.510 | 4.357 | 515.620 |
| −15.068 | −2.552 | 515.620 |
| −7.243 | 0.719 | 515.620 |
| −0.158 | 5.386 | 515.620 |
| −13.457 | −2.013 | 515.620 |
| −5.761 | 1.551 | 515.620 |
| −11.865 | −1.420 | 515.620 |
| −4.312 | 2.437 | 515.620 |
| −10.296 | −0.768 | 515.620 |
| −23.277 | −23.267 | 515.620 |
| −30.039 | −9.534 | 515.620 |
| −29.493 | −17.624 | 515.620 |
| −24.736 | −22.397 | 515.620 |

TABLE III-continued

| Stage 2 Nozzle Airfoil | | |
|---|---|---|
| X | Y | R |
| −30.255 | −16.107 | 515.620 |
| −18.527 | −25.072 | 515.620 |
| −26.111 | −21.400 | 515.620 |
| −30.746 | −14.483 | 515.620 |
| −20.160 | −24.608 | 515.620 |
| −27.382 | −20.274 | 515.620 |
| −30.892 | −12.794 | 515.620 |
| −21.748 | −24.005 | 515.620 |
| −30.648 | −11.117 | 515.620 |
| −28.522 | −19.016 | 515.620 |
| −15.171 | −25.576 | 515.620 |
| −0.946 | −20.959 | 515.620 |
| −8.449 | −24.834 | 515.620 |
| −16.859 | −25.396 | 515.620 |
| −2.327 | −21.947 | 515.620 |
| −10.100 | −25.235 | 515.620 |
| −3.772 | −22.840 | 515.620 |
| −11.778 | −25.494 | 515.620 |
| −5.277 | −23.627 | 515.620 |
| −13.473 | −25.609 | 515.620 |
| −6.838 | −24.296 | 515.620 |
| 3.701 | 8.714 | 515.620 |
| 9.536 | 14.880 | 515.620 |
| 4.924 | 9.892 | 515.620 |
| 6.118 | 11.101 | 515.620 |
| 1.161 | 6.457 | 515.620 |
| 7.283 | 12.337 | 515.620 |
| 2.447 | 7.567 | 515.620 |
| 8.422 | 13.597 | 515.620 |
| 16.454 | 5.823 | 515.620 |
| 12.958 | 1.918 | 515.620 |
| 19.003 | 12.122 | 515.620 |
| 15.787 | 4.260 | 515.620 |
| 10.627 | 16.182 | 515.620 |
| 18.381 | 10.541 | 515.620 |
| 15.106 | 2.704 | 515.620 |
| 17.749 | 8.964 | 515.620 |
| 14.408 | 1.155 | 515.620 |
| 20.224 | 15.293 | 515.620 |
| 17.107 | 7.391 | 515.620 |
| 13.693 | −0.386 | 515.620 |
| 19.618 | 13.706 | 515.620 |
| 5.039 | −14.961 | 515.620 |
| 8.909 | −9.381 | 515.620 |
| 3.957 | −16.271 | 515.620 |
| 8.003 | −10.818 | 515.620 |
| 2.820 | −17.533 | 515.620 |
| 7.058 | −12.229 | 515.620 |
| 1.626 | −18.742 | 515.620 |
| 6.071 | −13.612 | 515.620 |
| 0.372 | −19.887 | 515.620 |
| 9.779 | −7.922 | 515.620 |
| 12.203 | −3.439 | 515.620 |
| 11.423 | −4.948 | 515.620 |
| 10.616 | −6.443 | 515.620 |
| 26.453 | 40.292 | 515.620 |
| 29.535 | 42.623 | 515.620 |
| 29.964 | 44.620 | 515.620 |
| 27.266 | 41.784 | 515.620 |
| 29.062 | 40.992 | 515.620 |
| 29.716 | 44.922 | 515.620 |
| 28.066 | 43.283 | 515.620 |
| 28.567 | 39.367 | 515.620 |
| 29.348 | 45.019 | 515.620 |
| 28.997 | 44.893 | 515.620 |
| 25.629 | 38.807 | 515.620 |
| 29.985 | 44.231 | 515.620 |
| 13.767 | 20.196 | 515.620 |
| 18.622 | 27.164 | 515.620 |
| 14.773 | 21.565 | 515.620 |
| 15.760 | 22.947 | 515.620 |
| 11.695 | 17.503 | 515.620 |
| 16.731 | 24.342 | 515.620 |
| 12.741 | 18.842 | 515.620 |
| 17.684 | 25.748 | 515.620 |

TABLE III-continued

| Stage 2 Nozzle Airfoil | | |
|---|---|---|
| X | Y | R |
| 24.860 | 28.068 | 515.620 |
| 22.004 | 20.068 | 515.620 |
| 23.095 | 34.385 | 515.620 |
| 27.028 | 34.508 | 515.620 |
| 24.300 | 26.464 | 515.620 |
| 19.545 | 28.591 | 515.620 |
| 21.417 | 18.474 | 515.620 |
| 23.950 | 35.853 | 515.620 |
| 26.497 | 32.894 | 515.620 |
| 23.734 | 24.862 | 515.620 |
| 20.453 | 30.027 | 515.620 |
| 20.824 | 16.882 | 515.620 |
| 24.794 | 37.327 | 515.620 |
| 25.959 | 31.283 | 515.620 |
| 23.163 | 23.262 | 515.620 |
| 21.346 | 31.471 | 515.620 |
| 28.063 | 37.745 | 515.620 |
| 25.413 | 29.674 | 515.620 |
| 22.586 | 21.664 | 515.620 |
| 22.227 | 32.924 | 515.620 |
| 27.549 | 36.125 | 515.620 |
| −24.852 | −5.398 | 515.620 |
| −23.245 | −4.849 | 515.620 |
| −29.095 | −8.127 | 515.620 |
| −21.614 | −4.375 | 515.620 |
| −27.848 | −6.978 | 515.620 |
| −19.973 | −3.933 | 515.620 |
| −26.406 | −6.084 | 515.620 |
| −18.332 | −3.495 | 515.620 |
| −2.894 | 3.373 | 515.620 |
| −16.695 | −3.041 | 515.620 |
| −8.755 | −0.055 | 515.620 |
| −1.510 | 4.357 | 515.620 |
| −15.068 | −2.552 | 515.620 |
| −7.243 | 0.719 | 515.620 |
| −0.158 | 5.386 | 515.620 |
| −13.457 | −2.013 | 515.620 |
| −5.761 | 1.551 | 515.620 |
| −11.865 | −1.420 | 515.620 |
| −4.312 | 2.437 | 515.620 |
| −10.296 | −0.768 | 515.620 |
| −23.277 | −23.267 | 515.620 |
| −30.039 | −9.534 | 515.620 |
| −29.493 | −17.624 | 515.620 |
| −24.736 | −22.397 | 515.620 |
| −30.255 | −16.107 | 515.620 |
| −18.527 | −25.072 | 515.620 |
| −26.111 | −21.400 | 515.620 |
| −30.746 | −14.483 | 515.620 |
| −20.160 | −24.608 | 515.620 |
| −27.382 | −20.274 | 515.620 |
| −30.892 | −12.794 | 515.620 |
| −21.748 | −24.005 | 515.620 |
| −30.648 | −11.117 | 515.620 |
| −28.522 | −19.016 | 515.620 |
| −15.171 | −25.576 | 515.620 |
| −0.946 | −20.959 | 515.620 |
| −8.449 | −24.834 | 515.620 |
| −16.859 | −25.396 | 515.620 |
| −2.327 | −21.947 | 515.620 |
| −10.100 | −25.235 | 515.620 |
| −3.772 | −22.840 | 515.620 |
| −11.778 | −25.494 | 515.620 |
| −5.277 | −23.627 | 515.620 |
| −13.473 | −25.609 | 515.620 |
| −6.838 | −24.296 | 515.620 |
| 3.701 | 8.714 | 515.620 |
| 9.536 | 14.880 | 515.620 |
| 4.924 | 9.892 | 515.620 |
| 6.118 | 11.101 | 515.620 |
| 1.161 | 6.457 | 515.620 |
| 7.283 | 12.337 | 515.620 |
| 2.447 | 7.567 | 515.620 |
| 8.422 | 13.597 | 515.620 |
| 16.454 | 5.823 | 515.620 |

TABLE III-continued

| Stage 2 Nozzle Airfoil | | |
|---|---|---|
| X | Y | R |
| 12.958 | −1.918 | 515.620 |
| 19.003 | 12.122 | 515.620 |
| 15.787 | 4.260 | 515.620 |
| 10.627 | 16.182 | 515.620 |
| 18.381 | 10.541 | 515.620 |
| 15.106 | 2.704 | 515.620 |
| 17.749 | 8.964 | 515.620 |
| 14.408 | 1.155 | 515.620 |
| 20.224 | 15.293 | 515.620 |
| 17.107 | 7.391 | 515.620 |
| 13.693 | −0.386 | 515.620 |
| 19.618 | 13.706 | 515.620 |
| 5.039 | −14.961 | 515.620 |
| 8.909 | −9.381 | 515.620 |
| 3.957 | −16.271 | 515.620 |
| 8.003 | −10.818 | 515.620 |
| 2.820 | −17.533 | 515.620 |
| 7.058 | −12.229 | 515.620 |
| 1.626 | −18.742 | 515.620 |
| 6.071 | −13.612 | 515.620 |
| 0.372 | −19.887 | 515.620 |
| 9.779 | −7.922 | 515.620 |
| 12.203 | −3.439 | 515.620 |
| 11.423 | −4.948 | 515.620 |
| 10.616 | −6.443 | 515.620 |
| 26.453 | 40.292 | 515.620 |
| 29.535 | 42.623 | 515.620 |
| 29.964 | 44.620 | 515.620 |
| 27.266 | 41.784 | 515.620 |
| 29.062 | 40.992 | 515.620 |
| 29.716 | 44.922 | 515.620 |
| 28.066 | 43.283 | 515.620 |
| 28.567 | 39.367 | 515.620 |
| 29.348 | 45.019 | 515.620 |
| 28.997 | 44.893 | 515.620 |
| 25.629 | 38.807 | 515.620 |
| 29.985 | 44.231 | 515.620 |
| 13.767 | 20.196 | 515.620 |
| 18.622 | 27.164 | 515.620 |
| 14.773 | 21.565 | 515.620 |
| 15.760 | 22.947 | 515.620 |
| 11.695 | 17.503 | 515.620 |
| 16.731 | 24.342 | 515.620 |
| 12.741 | 18.842 | 515.620 |
| 17.684 | 25.748 | 515.620 |
| 24.860 | 28.068 | 515.620 |
| 22.004 | 20.068 | 515.620 |
| 23.095 | 34.385 | 515.620 |
| 27.028 | 34.508 | 515.620 |
| 24.300 | 26.464 | 515.620 |
| 19.545 | 28.591 | 515.620 |
| 21.417 | 18.474 | 515.620 |
| 23.950 | 35.853 | 515.620 |
| 26.497 | 32.894 | 515.620 |
| 23.734 | 24.862 | 515.620 |
| 20.453 | 30.027 | 515.620 |
| 20.824 | 16.882 | 515.620 |
| 24.794 | 37.327 | 515.620 |
| 25.959 | 31.283 | 515.620 |
| 23.163 | 23.262 | 515.620 |
| 21.346 | 31.471 | 515.620 |
| 28.063 | 37.745 | 515.620 |
| 25.413 | 29.674 | 515.620 |
| 22.586 | 21.664 | 515.620 |
| 22.227 | 32.924 | 515.620 |
| 27.549 | 36.125 | 515.620 |
| −24.852 | −5.398 | 515.620 |
| −23.245 | −4.849 | 515.620 |
| −29.095 | −8.127 | 515.620 |
| −21.614 | −4.375 | 515.620 |
| −27.848 | −6.978 | 515.620 |
| −19.973 | −3.933 | 515.620 |
| −26.406 | −6.084 | 515.620 |
| −18.332 | −3.495 | 515.620 |
| −2.894 | 3.373 | 515.620 |

TABLE III-continued

| Stage 2 Nozzle Airfoil | | |
|---|---|---|
| X | Y | R |
| −16.695 | −3.041 | 515.620 |
| −8.755 | −0.055 | 515.620 |
| −1.510 | 4.357 | 515.620 |
| −15.068 | −2.552 | 515.620 |
| −7.243 | 0.719 | 515.620 |
| −0.158 | 5.386 | 515.620 |
| −13.457 | −2.013 | 515.620 |
| −5.761 | 1.551 | 515.620 |
| −11.865 | −1.420 | 515.620 |
| −4.312 | 2.437 | 515.620 |
| −10.296 | −0.768 | 515.620 |
| −23.277 | −23.267 | 515.620 |
| −30.039 | −9.534 | 515.620 |
| −29.493 | −17.624 | 515.620 |
| −24.736 | −22.397 | 515.620 |
| −30.255 | −16.107 | 515.620 |
| −18.527 | −25.072 | 515.620 |
| −26.111 | −21.400 | 515.620 |
| −30.746 | −14.483 | 515.620 |
| −20.160 | −24.608 | 515.620 |
| −27.382 | −20.274 | 515.620 |
| −30.892 | −12.794 | 515.620 |
| −21.748 | −24.005 | 515.620 |
| −30.648 | −11.117 | 515.620 |
| −28.522 | −19.016 | 515.620 |
| −15.171 | −25.576 | 515.620 |
| −0.946 | −20.959 | 515.620 |
| −8.449 | −24.834 | 515.620 |
| −16.859 | −25.396 | 515.620 |
| −2.327 | −21.947 | 515.620 |
| −10.100 | −25.235 | 515.620 |
| −3.772 | −22.840 | 515.620 |
| −11.778 | −25.494 | 515.620 |
| −5.277 | −23.627 | 515.620 |
| −13.473 | −25.609 | 515.620 |
| −6.838 | −24.296 | 515.620 |
| 3.701 | 8.714 | 515.620 |
| 9.536 | 14.880 | 515.620 |
| 4.924 | 9.892 | 515.620 |
| 6.118 | 11.101 | 515.620 |
| 1.161 | 6.457 | 515.620 |
| 7.283 | 12.337 | 515.620 |
| 2.447 | 7.567 | 515.620 |
| 8.422 | 13.597 | 515.620 |
| 16.454 | 5.823 | 515.620 |
| 12.958 | 1.918 | 515.620 |
| 19.003 | 12.122 | 515.620 |
| 15.787 | 4.260 | 515.620 |
| 10.627 | 16.182 | 515.620 |
| 18.381 | 10.541 | 515.620 |
| 15.106 | 2.704 | 515.620 |
| 17.749 | 8.964 | 515.620 |
| 14.408 | 1.155 | 515.620 |
| 20.224 | 15.293 | 515.620 |
| 17.107 | 7.391 | 515.620 |
| 13.693 | −0.386 | 515.620 |
| 19.618 | 13.706 | 515.620 |
| 5.039 | −14.961 | 515.620 |
| 8.909 | −9.381 | 515.620 |
| 3.957 | −16.271 | 515.620 |
| 8.003 | −10.818 | 515.620 |
| 2.820 | −17.533 | 515.620 |
| 7.058 | −12.229 | 515.620 |
| 1.626 | −18.742 | 515.620 |
| 6.071 | −13.612 | 515.620 |
| 0.372 | −19.887 | 515.620 |
| 9.779 | −7.922 | 515.620 |
| 12.203 | −3.439 | 515.620 |
| 11.423 | −4.948 | 515.620 |
| 10.616 | −6.443 | 515.620 |
| 29.490 | 41.451 | 522.710 |
| 30.415 | 45.220 | 522.710 |
| 28.508 | 43.864 | 522.710 |
| 28.995 | 39.780 | 522.710 |
| 30.162 | 45.531 | 522.710 |

TABLE III-continued

| Stage 2 Nozzle Airfoil | | |
|---|---|---|
| X | Y | R |
| 25.204 | 37.726 | 522.710 |
| 28.489 | 38.112 | 522.710 |
| 29.784 | 45.626 | 522.710 |
| 26.045 | 39.253 | 522.710 |
| 29.428 | 45.492 | 522.710 |
| 26.876 | 40.785 | 522.710 |
| 29.966 | 43.127 | 522.710 |
| 30.450 | 45.024 | 522.710 |
| 27.697 | 42.322 | 522.710 |
| 10.898 | 15.885 | 522.710 |
| 16.098 | 22.874 | 522.710 |
| 11.983 | 17.249 | 522.710 |
| 17.078 | 24.316 | 522.710 |
| 13.044 | 18.632 | 522.710 |
| 18.040 | 25.769 | 522.710 |
| 14.083 | 20.031 | 522.710 |
| 9.790 | 14.540 | 522.710 |
| 15.100 | 21.446 | 522.710 |
| 19.915 | 28.707 | 522.710 |
| 21.764 | 18.312 | 522.710 |
| 24.353 | 36.206 | 522.710 |
| 26.912 | 33.127 | 522.710 |
| 24.118 | 24.874 | 522.710 |
| 20.830 | 30.191 | 522.710 |
| 21.159 | 16.678 | 522.710 |
| 26.369 | 31.471 | 522.710 |
| 23.539 | 23.230 | 522.710 |
| 21.730 | 31.683 | 522.710 |
| 20.547 | 15.046 | 522.710 |
| 25.818 | 29.818 | 522.710 |
| 22.953 | 21.589 | 522.710 |
| 22.617 | 33.183 | 522.710 |
| 27.973 | 36.448 | 522.710 |
| 25.258 | 28.167 | 522.710 |
| 18.986 | 27.233 | 522.710 |
| 22.361 | 19.949 | 522.710 |
| 23.491 | 34.691 | 522.710 |
| 27.447 | 34.786 | 522.710 |
| 24.692 | 26.519 | 522.710 |
| −29.966 | −8.767 | 522.710 |
| −22.153 | −5.178 | 522.710 |
| −28.637 | −7.645 | 522.710 |
| −20.465 | −4.745 | 522.710 |
| −27.118 | −6.794 | 522.710 |
| −18.778 | −4.308 | 522.710 |
| −25.500 | −6.151 | 522.710 |
| −30.973 | −10.183 | 522.710 |
| −23.836 | −5.633 | 522.710 |
| −15.427 | −3.352 | 522.710 |
| −7.393 | −0.010 | 522.710 |
| −13.773 | −2.803 | 522.710 |
| −5.872 | 0.840 | 522.710 |
| −12.139 | −2.197 | 522.710 |
| −4.383 | 1.746 | 522.710 |
| −10.528 | −1.531 | 522.710 |
| −2.928 | 2.704 | 522.710 |
| −17.097 | −3.849 | 522.710 |
| −8.946 | −0.802 | 522.710 |
| −1.506 | 3.712 | 522.710 |
| −25.564 | −23.367 | 522.710 |
| −31.234 | −16.918 | 522.710 |
| −19.210 | −26.152 | 522.710 |
| −26.972 | −22.341 | 522.710 |
| −31.735 | −15.252 | 522.710 |
| −20.881 | −25.658 | 522.710 |
| −28.276 | −21.186 | 522.710 |
| −31.875 | −13.518 | 522.710 |
| −22.505 | −25.028 | 522.710 |
| −29.448 | −19.897 | 522.710 |
| −24.070 | −24.263 | 522.710 |
| −30.450 | −18.473 | 522.710 |
| −31.616 | −11.799 | 522.710 |
| −2.561 | −23.160 | 522.710 |
| −10.568 | −26.446 | 522.710 |
| −4.050 | −24.065 | 522.710 |

TABLE III-continued

| Stage 2 Nozzle Airfoil | | |
|---|---|---|
| X | Y | R |
| −12.293 | −26.686 | 522.710 |
| −5.601 | −24.858 | 522.710 |
| −14.033 | −26.777 | 522.710 |
| −7.210 | −25.527 | 522.710 |
| −15.774 | −26.716 | 522.710 |
| −1.138 | −22.154 | 522.710 |
| −8.869 | −26.059 | 522.710 |
| −17.504 | −26.507 | 522.710 |
| 5.086 | 9.398 | 522.710 |
| −0.119 | 4.767 | 522.710 |
| 6.306 | 10.643 | 522.710 |
| 1.234 | 5.866 | 522.710 |
| 7.495 | 11.917 | 522.710 |
| 2.552 | 7.006 | 522.710 |
| 8.656 | 13.217 | 522.710 |
| 3.836 | 8.185 | 522.710 |
| 12.341 | −4.180 | 522.710 |
| 18.664 | 10.169 | 522.710 |
| 15.313 | 2.126 | 522.710 |
| 18.018 | 8.550 | 522.710 |
| 14.598 | 0.536 | 522.710 |
| 17.361 | 6.936 | 522.710 |
| 13.866 | −1.046 | 522.710 |
| 19.928 | 13.417 | 522.710 |
| 16.692 | 5.326 | 522.710 |
| 13.114 | −2.618 | 522.710 |
| 19.300 | 11.791 | 522.710 |
| 16.010 | 3.723 | 522.710 |
| 8.044 | −11.755 | 522.710 |
| 2.733 | −18.649 | 522.710 |
| 7.076 | −13.205 | 522.710 |
| 1.507 | −19.887 | 522.710 |
| 6.066 | −14.625 | 522.710 |
| 0.217 | −21.059 | 522.710 |
| 9.862 | −8.782 | 522.710 |
| 5.008 | −16.010 | 522.710 |
| 8.971 | −10.280 | 522.710 |
| 3.899 | −17.354 | 522.710 |
| 11.543 | −5.729 | 522.710 |
| 10.718 | −7.264 | 522.710 |
| 25.506 | 37.923 | 529.800 |
| 28.985 | 38.717 | 529.800 |
| 30.612 | 46.139 | 529.800 |
| 26.354 | 39.494 | 529.800 |
| 28.467 | 37.009 | 529.800 |
| 30.224 | 46.232 | 529.800 |
| 27.192 | 41.069 | 529.800 |
| 30.463 | 43.864 | 529.800 |
| 23.777 | 34.799 | 529.800 |
| 27.939 | 35.304 | 529.800 |
| 29.862 | 46.089 | 529.800 |
| 28.022 | 42.650 | 529.800 |
| 29.987 | 42.144 | 529.800 |
| 30.900 | 45.619 | 529.800 |
| 24.647 | 36.358 | 529.800 |
| 28.845 | 44.234 | 529.800 |
| 29.492 | 40.429 | 529.800 |
| 30.868 | 45.821 | 529.800 |
| 12.135 | 16.841 | 529.800 |
| 17.303 | 24.115 | 529.800 |
| 13.214 | 18.263 | 529.800 |
| 18.276 | 25.611 | 529.800 |
| 8.742 | 12.698 | 529.800 |
| 14.268 | 19.703 | 529.800 |
| 9.900 | 14.057 | 529.800 |
| 15.301 | 21.159 | 529.800 |
| 11.031 | 15.438 | 529.800 |
| 16.312 | 22.630 | 529.800 |
| 26.854 | 31.902 | 529.800 |
| 23.993 | 23.448 | 529.800 |
| 22.001 | 31.702 | 529.800 |
| 20.952 | 15.057 | 529.800 |
| 26.298 | 30.206 | 529.800 |
| 23.398 | 21.765 | 529.800 |
| 22.896 | 33.247 | 529.800 |

TABLE III-continued

| Stage 2 Nozzle Airfoil | | |
|---|---|---|
| X | Y | R |
| 20.321 | 13.388 | 529.800 |
| 25.733 | 28.513 | 529.800 |
| 19.231 | 27.119 | 529.800 |
| 22.797 | 20.084 | 529.800 |
| 25.160 | 26.822 | 529.800 |
| 20.170 | 28.637 | 529.800 |
| 22.190 | 18.406 | 529.800 |
| 27.401 | 33.602 | 529.800 |
| 24.580 | 25.134 | 529.800 |
| 21.093 | 30.165 | 529.800 |
| 21.575 | 16.730 | 529.800 |
| −29.561 | −8.460 | 529.800 |
| −21.168 | −5.544 | 529.800 |
| −27.994 | −7.609 | 529.800 |
| −19.439 | −5.100 | 529.800 |
| −26.330 | −6.965 | 529.800 |
| −31.975 | −11.037 | 529.800 |
| −24.623 | −6.444 | 529.800 |
| −30.937 | −9.591 | 529.800 |
| −22.898 | −5.984 | 529.800 |
| −6.180 | 0.081 | 529.800 |
| −12.629 | −2.969 | 529.800 |
| −4.647 | 0.995 | 529.800 |
| −10.974 | −2.300 | 529.800 |
| −3.148 | 1.964 | 529.800 |
| −17.716 | −4.635 | 529.800 |
| −9.345 | −1.569 | 529.800 |
| −1.685 | 2.986 | 529.800 |
| −16.003 | −4.132 | 529.800 |
| −7.747 | −0.774 | 529.800 |
| −14.306 | −3.578 | 529.800 |
| −32.684 | −16.236 | 529.800 |
| −21.382 | −26.724 | 529.800 |
| −29.018 | −22.239 | 529.800 |
| −32.855 | −14.463 | 529.800 |
| −23.050 | −26.092 | 529.800 |
| −30.244 | −20.943 | 529.800 |
| −32.618 | −12.698 | 529.800 |
| −24.662 | −25.326 | 529.800 |
| −31.303 | −19.508 | 529.800 |
| −26.204 | −24.428 | 529.800 |
| −32.140 | −17.933 | 529.800 |
| −19.668 | −27.222 | 529.800 |
| −27.662 | −23.399 | 529.800 |
| −12.582 | −27.763 | 529.800 |
| −5.728 | −25.890 | 529.800 |
| −14.364 | −27.856 | 529.800 |
| −7.376 | −26.577 | 529.800 |
| −16.148 | −27.794 | 529.800 |
| −1.164 | −23.109 | 529.800 |
| −9.075 | −27.122 | 529.800 |
| −17.920 | −27.580 | 529.800 |
| −2.618 | −24.144 | 529.800 |
| −10.815 | −27.518 | 529.800 |
| −4.141 | −25.075 | 529.800 |
| 1.133 | 5.177 | 529.800 |
| 7.556 | 11.365 | 529.800 |
| 2.487 | 6.340 | 529.800 |
| 3.805 | 7.544 | 529.800 |
| 5.089 | 8.785 | 529.800 |
| −0.257 | 4.058 | 529.800 |
| 6.338 | 10.059 | 529.800 |
| 18.372 | 8.400 | 529.800 |
| 14.880 | 0.186 | 529.800 |
| 17.701 | 6.745 | 529.800 |
| 14.133 | −1.435 | 529.800 |
| 17.018 | 5.096 | 529.800 |
| 13.366 | −3.046 | 529.800 |
| 19.680 | 11.721 | 529.800 |
| 16.322 | 3.453 | 529.800 |
| 12.577 | −4.648 | 529.800 |
| 19.031 | 10.059 | 529.800 |
| 15.609 | 1.816 | 529.800 |
| 11.763 | −6.237 | 529.800 |
| 7.212 | −13.908 | 529.800 |

TABLE III-continued

| Stage 2 Nozzle Airfoil | | |
|---|---|---|
| X | Y | R |
| 1.536 | −20.776 | 529.800 |
| 6.182 | −15.366 | 529.800 |
| 0.220 | −21.982 | 529.800 |
| 5.105 | −16.790 | 529.800 |
| 9.142 | −10.905 | 529.800 |
| 3.975 | −18.171 | 529.800 |
| 8.197 | −12.420 | 529.800 |
| 2.786 | −19.503 | 529.800 |
| 10.922 | −7.811 | 529.800 |
| 10.049 | −9.368 | 529.800 |
| 23.071 | 33.128 | 536.890 |
| 29.023 | 37.797 | 536.890 |
| 31.064 | 46.748 | 536.890 |
| 27.413 | 41.157 | 536.890 |
| 31.016 | 44.822 | 536.890 |
| 23.962 | 34.721 | 536.890 |
| 28.493 | 36.049 | 536.890 |
| 31.322 | 46.421 | 536.890 |
| 28.252 | 42.778 | 536.890 |
| 30.543 | 43.059 | 536.890 |
| 24.840 | 36.322 | 536.890 |
| 27.953 | 34.305 | 536.890 |
| 31.351 | 46.215 | 536.890 |
| 29.085 | 44.403 | 536.890 |
| 30.049 | 41.301 | 536.890 |
| 30.298 | 46.683 | 536.890 |
| 25.708 | 37.928 | 536.890 |
| 29.542 | 39.547 | 536.890 |
| 30.667 | 46.838 | 536.890 |
| 26.565 | 39.540 | 536.890 |
| 8.679 | 12.057 | 536.890 |
| 14.324 | 19.226 | 536.890 |
| 9.865 | 13.445 | 536.890 |
| 15.375 | 20.720 | 536.890 |
| 11.022 | 14.858 | 536.890 |
| 16.402 | 22.229 | 536.890 |
| 12.149 | 16.294 | 536.890 |
| 17.409 | 23.752 | 536.890 |
| 7.462 | 10.696 | 536.890 |
| 13.250 | 17.750 | 536.890 |
| 18.395 | 25.288 | 536.890 |
| 23.913 | 22.181 | 536.890 |
| 20.787 | 13.605 | 536.890 |
| 26.274 | 29.092 | 536.890 |
| 19.363 | 26.836 | 536.890 |
| 23.304 | 20.460 | 536.890 |
| 20.135 | 11.899 | 536.890 |
| 25.696 | 27.360 | 536.890 |
| 20.314 | 28.395 | 536.890 |
| 22.687 | 18.742 | 536.890 |
| 25.109 | 25.631 | 536.890 |
| 21.248 | 29.964 | 536.890 |
| 22.062 | 17.026 | 536.890 |
| 27.403 | 32.565 | 536.890 |
| 24.515 | 23.905 | 536.890 |
| 22.166 | 31.542 | 536.890 |
| 21.429 | 15.314 | 536.890 |
| 26.843 | 30.827 | 536.890 |
| −20.306 | −5.875 | 536.890 |
| −33.653 | −13.816 | 536.890 |
| −27.337 | −7.845 | 536.890 |
| −18.544 | −5.400 | 536.890 |
| −33.042 | −12.101 | 536.890 |
| −25.598 | −7.287 | 536.890 |
| −32.006 | −10.605 | 536.890 |
| −23.840 | −6.798 | 536.890 |
| −30.617 | −9.427 | 536.890 |
| −22.073 | −6.335 | 536.890 |
| −29.028 | −8.531 | 536.890 |
| −11.626 | −3.072 | 536.890 |
| −3.557 | 1.168 | 536.890 |
| −9.950 | −2.348 | 536.890 |
| −2.048 | 2.195 | 536.890 |
| −16.790 | −4.893 | 536.890 |
| −8.303 | −1.562 | 536.890 |

TABLE III-continued

| Stage 2 Nozzle Airfoil | | |
|---|---|---|
| X | Y | R |
| −15.050 | −4.340 | 536.890 |
| −6.686 | −0.713 | 536.890 |
| −13.328 | −3.734 | 536.890 |
| −5.104 | 0.197 | 536.890 |
| −23.397 | −27.196 | 536.890 |
| −30.915 | −22.151 | 536.890 |
| −25.064 | −26.452 | 536.890 |
| −32.053 | −20.725 | 536.890 |
| −26.665 | −25.576 | 536.890 |
| −32.970 | −19.149 | 536.890 |
| −19.915 | −28.283 | 536.890 |
| −28.188 | −24.569 | 536.890 |
| −33.592 | −17.435 | 536.890 |
| −21.677 | −27.807 | 536.890 |
| −29.613 | −23.430 | 536.890 |
| −33.831 | −15.629 | 536.890 |
| −7.349 | −27.451 | 536.890 |
| −16.306 | −28.810 | 536.890 |
| −9.080 | −28.029 | 536.890 |
| −18.121 | −28.620 | 536.890 |
| −2.512 | −24.908 | 536.890 |
| −10.855 | −28.456 | 536.890 |
| −4.058 | −25.877 | 536.890 |
| −12.660 | −28.729 | 536.890 |
| −5.673 | −26.729 | 536.890 |
| −14.481 | −28.848 | 536.890 |
| 2.250 | 5.586 | 536.890 |
| 3.607 | 6.807 | 536.890 |
| 4.927 | 8.068 | 536.890 |
| −0.577 | 3.276 | 536.890 |
| 6.212 | 9.366 | 536.890 |
| 0.856 | 4.408 | 536.890 |
| 14.485 | −1.567 | 536.890 |
| 17.424 | 5.119 | 536.890 |
| 13.704 | −3.217 | 536.890 |
| 16.714 | 3.437 | 536.890 |
| 12.902 | −4.857 | 536.890 |
| 19.474 | 10.198 | 536.890 |
| 15.988 | 1.761 | 536.890 |
| 12.075 | −6.484 | 536.890 |
| 18.802 | 8.500 | 536.890 |
| 15.246 | 0.093 | 536.890 |
| 11.219 | −8.098 | 536.890 |
| 18.119 | 6.807 | 536.890 |
| 0.368 | −22.667 | 536.890 |
| 5.319 | −17.313 | 536.890 |
| −1.036 | −23.834 | 536.890 |
| 4.173 | −18.734 | 536.890 |
| 8.454 | −12.824 | 536.890 |
| 2.969 | −20.106 | 536.890 |
| 7.454 | −14.352 | 536.890 |
| 1.702 | −21.421 | 536.890 |
| 6.411 | −15.850 | 536.890 |
| 10.333 | −9.694 | 536.890 |
| 9.412 | −11.270 | 536.890 |
| 24.039 | 34.476 | 543.980 |
| 29.100 | 37.010 | 543.980 |
| 31.517 | 47.357 | 543.980 |
| 28.391 | 42.723 | 543.980 |
| 31.145 | 44.184 | 543.980 |
| 24.931 | 36.114 | 543.980 |
| 28.557 | 35.226 | 543.980 |
| 31.110 | 47.447 | 543.980 |
| 29.235 | 44.386 | 543.980 |
| 30.655 | 42.385 | 543.980 |
| 25.811 | 37.758 | 543.980 |
| 28.002 | 33.445 | 543.980 |
| 30.735 | 47.275 | 543.980 |
| 30.076 | 46.050 | 543.980 |
| 22.216 | 31.222 | 543.980 |
| 30.151 | 40.589 | 543.980 |
| 31.803 | 46.813 | 543.980 |
| 26.680 | 39.408 | 543.980 |
| 27.438 | 31.668 | 543.980 |
| 23.135 | 32.845 | 543.980 |

TABLE III-continued

| Stage 2 Nozzle Airfoil | | |
|---|---|---|
| X | Y | R |
| 29.632 | 38.797 | 543.980 |
| 31.776 | 47.023 | 543.980 |
| 27.540 | 41.063 | 543.980 |
| 15.296 | 20.156 | 543.980 |
| 10.837 | 14.177 | 543.980 |
| 16.346 | 21.697 | 543.980 |
| 5.891 | 8.596 | 543.980 |
| 11.994 | 15.640 | 543.980 |
| 17.373 | 23.254 | 543.980 |
| 7.178 | 9.946 | 543.980 |
| 13.122 | 17.125 | 543.980 |
| 8.431 | 11.328 | 543.980 |
| 14.222 | 18.631 | 543.980 |
| 9.650 | 12.739 | 543.980 |
| 20.647 | 12.312 | 543.980 |
| 26.281 | 28.121 | 543.980 |
| 20.333 | 28.002 | 543.980 |
| 23.237 | 19.307 | 543.980 |
| 19.975 | 10.572 | 543.980 |
| 25.689 | 26.353 | 543.980 |
| 21.282 | 29.607 | 543.980 |
| 22.604 | 17.553 | 543.980 |
| 19.292 | 8.836 | 543.980 |
| 25.088 | 24.587 | 543.980 |
| 21.961 | 15.803 | 543.980 |
| 18.379 | 24.825 | 543.980 |
| 24.479 | 22.825 | 543.980 |
| 21.309 | 14.055 | 543.980 |
| 26.864 | 29.893 | 543.980 |
| 19.365 | 26.408 | 543.980 |
| 23.862 | 21.065 | 543.980 |
| −26.763 | −8.206 | 543.980 |
| −34.715 | −15.191 | 543.980 |
| −33.167 | −11.848 | 543.980 |
| −24.979 | −7.661 | 543.980 |
| −31.799 | −10.586 | 543.980 |
| −23.183 | −7.158 | 543.980 |
| −30.217 | −9.603 | 543.980 |
| −21.383 | −6.670 | 543.980 |
| −28.519 | −8.833 | 543.980 |
| −19.584 | −6.178 | 543.980 |
| −34.169 | −13.414 | 543.980 |
| −2.631 | 1.372 | 543.980 |
| −17.792 | −5.663 | 543.980 |
| −9.082 | −2.361 | 543.980 |
| −16.011 | −5.108 | 543.980 |
| −7.416 | −1.522 | 543.980 |
| −14.246 | −4.507 | 543.980 |
| −5.784 | −0.619 | 543.980 |
| −12.500 | −3.852 | 543.980 |
| −4.189 | 0.346 | 543.980 |
| −10.777 | −3.138 | 543.980 |
| −32.700 | −22.147 | 543.980 |
| −26.957 | −26.828 | 543.980 |
| −33.726 | −20.592 | 543.980 |
| −19.965 | −29.345 | 543.980 |
| −28.556 | −25.869 | 543.980 |
| −34.458 | −18.880 | 543.980 |
| −21.780 | −28.916 | 543.980 |
| −30.066 | −24.775 | 543.980 |
| −34.799 | −17.050 | 543.980 |
| −23.557 | −28.353 | 543.980 |
| −31.461 | −23.539 | 543.980 |
| −25.287 | −27.657 | 543.980 |
| −8.904 | −28.792 | 543.980 |
| −18.123 | −29.633 | 543.980 |
| −2.260 | −25.466 | 543.980 |
| −10.706 | −29.271 | 543.980 |
| −3.822 | −26.485 | 543.980 |
| −12.542 | −29.595 | 543.980 |
| −5.453 | −27.388 | 543.980 |
| −14.399 | −29.764 | 543.980 |
| −7.150 | −28.162 | 543.980 |
| −16.264 | −29.775 | 543.980 |
| 4.567 | 7.283 | 543.980 |

TABLE III-continued

| Stage 2 Nozzle Airfoil | | |
|---|---|---|
| X | Y | R |
| −1.112 | 2.454 | 543.980 |
| 0.367 | 3.590 | 543.980 |
| 1.806 | 4.776 | 543.980 |
| 3.206 | 6.008 | 543.980 |
| 17.170 | 3.660 | 543.980 |
| 13.299 | −4.823 | 543.980 |
| 16.433 | 1.946 | 543.980 |
| 12.461 | −6.489 | 543.980 |
| 15.678 | 0.241 | 543.980 |
| 11.595 | −8.141 | 543.980 |
| 18.598 | 7.105 | 543.980 |
| 14.906 | −1.457 | 543.980 |
| 10.698 | −9.776 | 543.980 |
| 17.891 | 5.380 | 543.980 |
| 14.113 | −3.145 | 543.980 |
| 4.478 | −19.061 | 543.980 |
| 8.798 | −12.985 | 543.980 |
| 3.264 | −20.477 | 543.980 |
| 7.788 | −14.553 | 543.980 |
| 1.987 | −21.836 | 543.980 |
| 6.734 | −16.092 | 543.980 |
| 0.643 | −23.129 | 543.980 |
| 5.633 | −17.597 | 543.980 |
| −0.772 | −24.343 | 543.980 |
| 9.767 | −11.392 | 543.980 |

Figure 4:
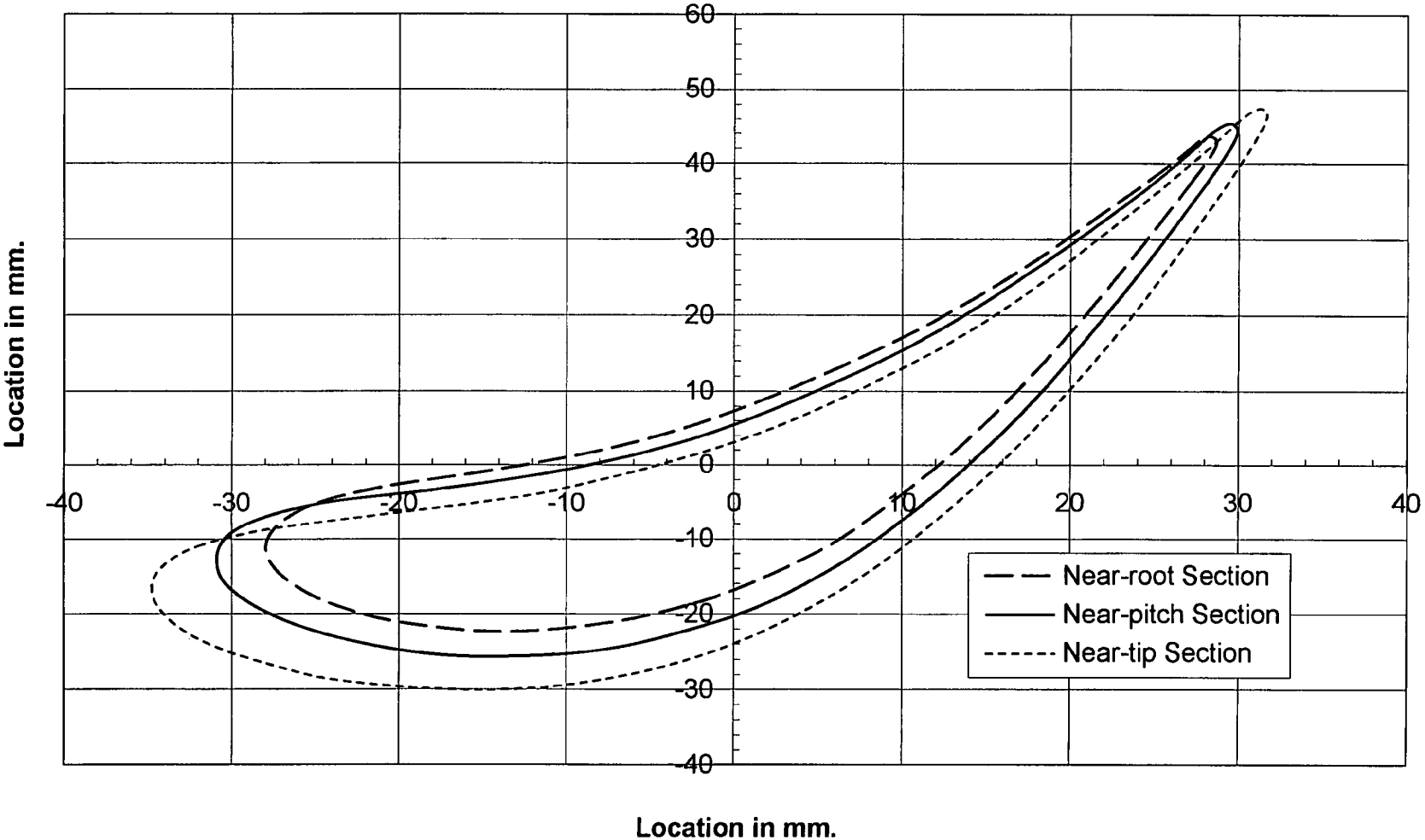
FIGS. 4 and 5 constitute plots of the second stage nozzle and bucket airfoil shapes at the near root, near pitch and near tip sections.
Figure 5:
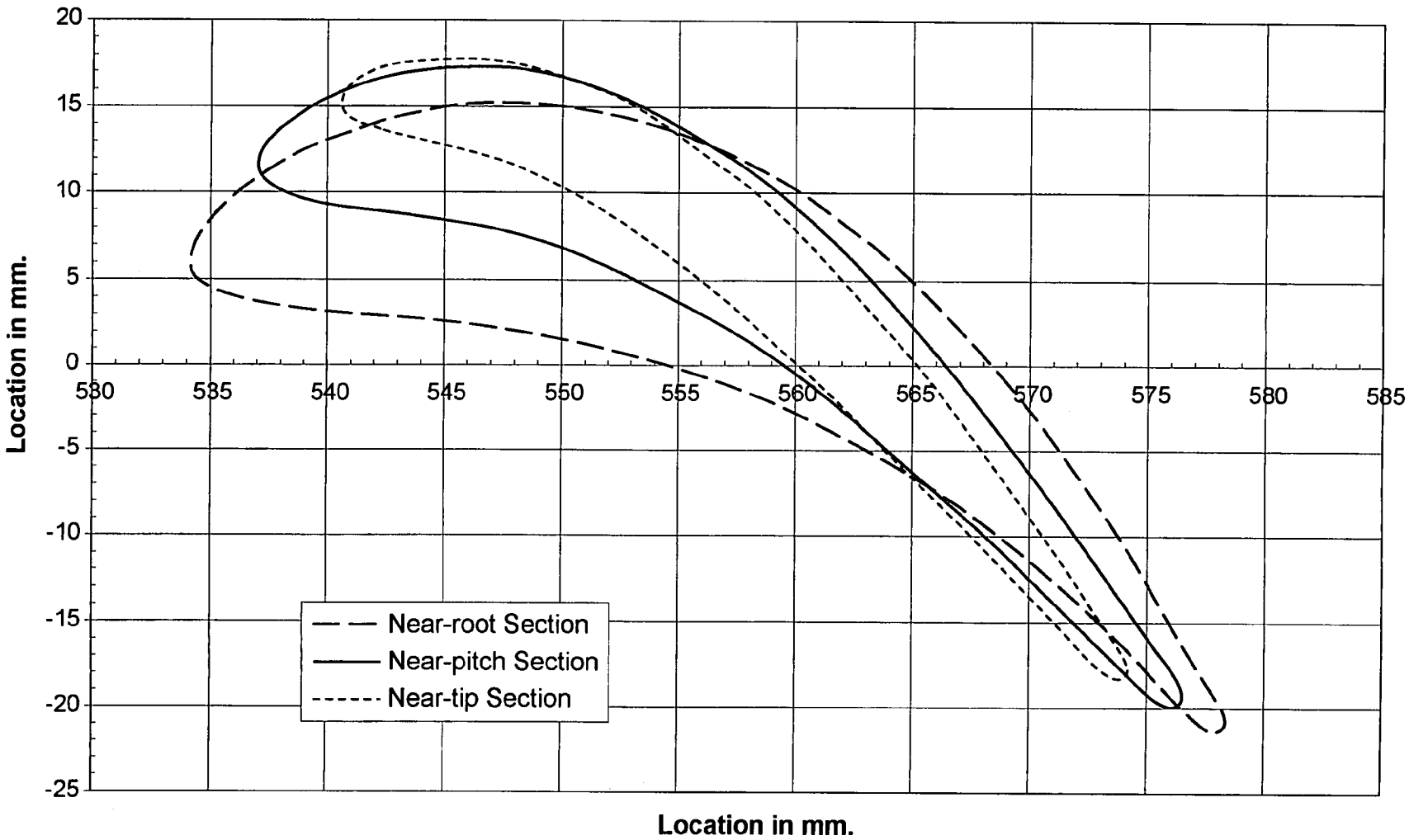

As an example, the profile sections of the second stage nozzle airfoils 20 at each of the near root, near pitch and near tip distances R are illustrated in FIG. 4.

The coordinate values given in Table IV below provide the preferred nominal profile shape excluding the fillet region for the second stage bucket airfoils 22.

TABLE IV

| Stage 2 Bucket Airfoil | | |
|---|---|---|
| X | Y | R |
| 534.521 | 7.749 | 498.825 |
| 535.028 | 8.634 | 498.825 |
| 535.635 | 9.456 | 498.825 |
| 536.310 | 10.221 | 498.825 |
| 537.040 | 10.935 | 498.825 |
| 537.815 | 11.600 | 498.825 |
| 538.629 | 12.216 | 498.825 |
| 539.479 | 12.782 | 498.825 |
| 544.153 | 14.786 | 498.825 |
| 545.151 | 15.001 | 498.825 |
| 546.161 | 15.148 | 498.825 |
| 547.179 | 15.225 | 498.825 |
| 548.200 | 15.232 | 498.825 |
| 549.219 | 15.170 | 498.825 |
| 550.232 | 15.039 | 498.825 |
| 551.234 | 14.843 | 498.825 |
| 552.221 | 14.585 | 498.825 |
| 553.192 | 14.267 | 498.825 |
| 554.142 | 13.895 | 498.825 |
| 555.071 | 13.471 | 498.825 |
| 555.977 | 13.000 | 498.825 |
| 556.859 | 12.486 | 498.825 |
| 557.717 | 11.932 | 498.825 |
| 558.551 | 11.342 | 498.825 |
| 559.360 | 10.719 | 498.825 |
| 560.145 | 10.066 | 498.825 |
| 560.907 | 9.386 | 498.825 |
| 561.646 | 8.681 | 498.825 |
| 562.362 | 7.954 | 498.825 |
| 563.058 | 7.206 | 498.825 |
| 563.733 | 6.440 | 498.825 |
| 564.388 | 5.657 | 498.825 |
| 565.025 | 4.859 | 498.825 |

TABLE IV-continued

| Stage 2 Bucket Airfoil | | |
|---|---|---|
| X | Y | R |
| 565.644 | 4.046 | 498.825 |
| 566.245 | 3.221 | 498.825 |
| 566.831 | 2.385 | 498.825 |
| 567.401 | 1.538 | 498.825 |
| 567.957 | 0.681 | 498.825 |
| 568.499 | −0.185 | 498.825 |
| 569.027 | −1.058 | 498.825 |
| 569.543 | −1.940 | 498.825 |
| 570.048 | −2.827 | 498.825 |
| 570.542 | −3.721 | 498.825 |
| 571.025 | −4.621 | 498.825 |
| 571.499 | −5.525 | 498.825 |
| 571.964 | −6.434 | 498.825 |
| 572.421 | −7.347 | 498.825 |
| 572.871 | −8.264 | 498.825 |
| 573.313 | −9.185 | 498.825 |
| 573.750 | −10.108 | 498.825 |
| 574.180 | −11.034 | 498.825 |
| 574.605 | −11.962 | 498.825 |
| 575.026 | −12.893 | 498.825 |
| 575.442 | −13.825 | 498.825 |
| 559.701 | −2.634 | 498.825 |
| 558.827 | −2.106 | 498.825 |
| 557.939 | −1.602 | 498.825 |
| 557.038 | −1.121 | 498.825 |
| 556.124 | −0.666 | 498.825 |
| 555.198 | −0.236 | 498.825 |
| 554.260 | 0.168 | 498.825 |
| 553.310 | 0.544 | 498.825 |
| 552.351 | 0.892 | 498.825 |
| 551.381 | 1.213 | 498.825 |
| 550.403 | 1.505 | 498.825 |
| 549.417 | 1.770 | 498.825 |
| 548.423 | 2.007 | 498.825 |
| 547.424 | 2.218 | 498.825 |
| 546.420 | 2.404 | 498.825 |
| 545.412 | 2.566 | 498.825 |
| 544.401 | 2.708 | 498.825 |
| 543.387 | 2.833 | 498.825 |
| 542.372 | 2.945 | 498.825 |
| 541.356 | 3.048 | 498.825 |
| 540.340 | 3.152 | 498.825 |
| 539.325 | 3.264 | 498.825 |
| 538.313 | 3.399 | 498.825 |
| 537.308 | 3.577 | 498.825 |
| 536.321 | 3.836 | 498.825 |
| 535.383 | 4.237 | 498.825 |
| 534.592 | 4.874 | 498.825 |
| 534.139 | 5.777 | 498.825 |
| 534.176 | 6.790 | 498.825 |
| 540.361 | 13.296 | 498.825 |
| 541.272 | 13.757 | 498.825 |
| 542.210 | 14.161 | 498.825 |
| 543.171 | 14.505 | 498.825 |
| 577.1.74 | −20.960 | 498.825 |
| 576.615 | −20.106 | 498.825 |
| 576.046 | −19.258 | 498.825 |
| 575.469 | −18.415 | 498.825 |
| 574.882 | −17.580 | 498.825 |
| 574.284 | −16.752 | 498.825 |
| 573.675 | −15.932 | 498.825 |
| 573.056 | −15.121 | 498.825 |
| 572.425 | −14.317 | 498.825 |
| 571.783 | −13.523 | 498.825 |
| 571.129 | −12.739 | 498.825 |
| 570.463 | −11.965 | 498.825 |
| 569.784 | −11.202 | 498.825 |
| 569.092 | −10.452 | 498.825 |
| 568.386 | −9.713 | 498.825 |
| 567.667 | −8.988 | 498.825 |
| 566.935 | −8.277 | 498.825 |
| 566.188 | −7.581 | 498.825 |
| 565.427 | −6.900 | 498.825 |
| 564.652 | −6.235 | 498.825 |
| 563.862 | −5.587 | 498.825 |

TABLE IV-continued

| Stage 2 Bucket Airfoil | | |
|---|---|---|
| X | Y | R |
| 563.058 | −4.957 | 498.825 |
| 562.240 | −4.346 | 498.825 |
| 561.408 | −3.755 | 498.825 |
| 560.562 | −3.183 | 498.825 |
| 575.854 | −14.760 | 498.825 |
| 576.262 | −15.696 | 498.825 |
| 576.667 | −16.633 | 498.825 |
| 577.068 | −17.572 | 498.825 |
| 577.465 | −18.513 | 498.825 |
| 577.857 | −19.456 | 498.825 |
| 578.245 | −20.401 | 498.825 |
| 578.028 | −21.288 | 498.825 |
| 535.115 | 9.162 | 508.157 |
| 535.586 | 10.053 | 508.157 |
| 536.168 | 10.876 | 508.157 |
| 536.824 | 11.642 | 508.157 |
| 537.538 | 12.354 | 508.157 |
| 538.301 | 13.014 | 508.157 |
| 539.106 | 13.622 | 508.157 |
| 539.948 | 14.176 | 508.157 |
| 540.825 | 14.674 | 508.157 |
| 559.943 | −1.951 | 508.157 |
| 559.124 | −1.363 | 508.157 |
| 558.291 | −0.794 | 508.157 |
| 557.444 | −0.246 | 508.157 |
| 556.583 | 0.280 | 508.157 |
| 555.708 | 0.782 | 508.157 |
| 554.820 | 1.259 | 508.157 |
| 553.917 | 1.709 | 508.157 |
| 553.001 | 2.132 | 508.157 |
| 552.072 | 2.525 | 508.157 |
| 551.131 | 2.889 | 508.157 |
| 550.179 | 3.222 | 508.157 |
| 549.216 | 3.523 | 508.157 |
| 548.245 | 3.794 | 508.157 |
| 547.265 | 4.034 | 508.157 |
| 546.278 | 4.244 | 508.157 |
| 545.286 | 4.426 | 508.157 |
| 544.290 | 4.582 | 508.157 |
| 543.290 | 4.717 | 508.157 |
| 542.288 | 4.834 | 508.157 |
| 541.285 | 4.941 | 508.157 |
| 540.281 | 5.045 | 508.157 |
| 539.279 | 5.159 | 508.157 |
| 538.281 | 5.303 | 508.157 |
| 537.294 | 5.510 | 508.157 |
| 534.929 | 7.204 | 508.157 |
| 534.832 | 8.196 | 508.157 |
| 541.733 | 15.113 | 508.157 |
| 542.669 | 15.489 | 508.157 |
| 543.629 | 15.798 | 508.157 |
| 544.609 | 16.037 | 508.157 |
| 545.604 | 16.202 | 508.157 |
| 546.609 | 16.291 | 508.157 |
| 547.617 | 16.305 | 508.157 |
| 548.624 | 16.242 | 508.157 |
| 549.623 | 16.105 | 508.157 |
| 550.610 | 15.896 | 508.157 |
| 551.580 | 15.621 | 508.157 |
| 552.530 | 15.283 | 508.157 |
| 553.458 | 14.888 | 508.157 |
| 554.362 | 14.441 | 508.157 |
| 555.241 | 13.946 | 508.157 |
| 556.095 | 13.408 | 508.157 |
| 556.923 | 12.833 | 508.157 |
| 557.726 | 12.222 | 508.157 |
| 558.505 | 11.582 | 508.157 |
| 559.261 | 10.914 | 508.157 |
| 559.994 | 10.221 | 508.157 |
| 560.706 | 9.506 | 508.157 |
| 561.397 | 8.771 | 508.157 |
| 562.069 | 8.019 | 508.157 |
| 562.722 | 7.250 | 508.157 |
| 563.358 | 6.467 | 508.157 |
| 563.977 | 5.670 | 508.157 |

TABLE IV-continued

| Stage 2 Bucket Airfoil | | |
|---|---|---|
| X | Y | R |
| 564.581 | 4.862 | 508.157 |
| 565.170 | 4.043 | 508.157 |
| 565.745 | 3.214 | 508.157 |
| 576.722 | −20.611 | 508.157 |
| 576.161 | −19.773 | 508.157 |
| 575.593 | −18.939 | 508.157 |
| 575.018 | −18.110 | 508.157 |
| 574.435 | −17.287 | 508.157 |
| 573.843 | −16.471 | 508.157 |
| 573.242 | −15.660 | 508.157 |
| 572.633 | −14.856 | 508.157 |
| 572.016 | −14.058 | 508.157 |
| 571.389 | −13.267 | 508.157 |
| 570.754 | −12.484 | 508.157 |
| 570.109 | −11.708 | 508.157 |
| 569.455 | −10.940 | 508.157 |
| 568.790 | −10.181 | 508.157 |
| 568.116 | −9.431 | 508.157 |
| 567.431 | −8.691 | 508.157 |
| 566.735 | −7.960 | 508.157 |
| 566.028 | −7.240 | 508.157 |
| 565.310 | −6.532 | 508.157 |
| 564.581 | −5.835 | 508.157 |
| 563.839 | −5.151 | 508.157 |
| 563.086 | −4.481 | 508.157 |
| 562.320 | −3.824 | 508.157 |
| 561.541 | −3.183 | 508.157 |
| 560.749 | −2.559 | 508.157 |
| 566.307 | 2.377 | 508.157 |
| 566.857 | 1.531 | 508.157 |
| 567.395 | −0.678 | 508.157 |
| 567.922 | −0.183 | 508.157 |
| 568.438 | −1.049 | 508.157 |
| 568.946 | −1.921 | 508.157 |
| 569.444 | −2.798 | 508.157 |
| 569.933 | −3.680 | 508.157 |
| 570.415 | −4.566 | 508.157 |
| 570.889 | −5.457 | 508.157 |
| 571.357 | −6.351 | 508.157 |
| 571.818 | −7.248 | 508.157 |
| 572.273 | −8.148 | 508.157 |
| 572.723 | −9.051 | 508.157 |
| 573.168 | −9.956 | 508.157 |
| 573.608 | −10.864 | 508.157 |
| 574.044 | −11.774 | 508.157 |
| 574.476 | −12.685 | 508.157 |
| 574.904 | −13.599 | 508.157 |
| 575.329 | −14.514 | 508.157 |
| 575.750 | −15.430 | 508.157 |
| 576.167 | −16.349 | 508.157 |
| 576.580 | −17.269 | 508.157 |
| 576.988 | −18.192 | 508.157 |
| 577.390 | −19.117 | 508.157 |
| 577.785 | −20.045 | 508.157 |
| 577.571 | −20.922 | 508.157 |
| 536.340 | 5.836 | 508.157 |
| 535.495 | 6.379 | 508.157 |
| 541.285 | 15.567 | 517.489 |
| 540.408 | 15.105 | 517.489 |
| 539.566 | 14.582 | 517.489 |
| 538.764 | 13.999 | 517.489 |
| 538.007 | 13.359 | 517.489 |
| 537.303 | 12.662 | 517.489 |
| 536.662 | 11.906 | 517.489 |
| 536.109 | 11.084 | 517.489 |
| 535.691 | 10.186 | 517.489 |
| 565.329 | 3.094 | 517.489 |
| 564.775 | 3.916 | 517.489 |
| 564.210 | 4.731 | 517.489 |
| 563.632 | 5.536 | 517.489 |
| 563.040 | 6.332 | 517.489 |
| 562.435 | 7.117 | 517.489 |
| 561.814 | 7.890 | 517.489 |
| 561.176 | 8.649 | 517.489 |
| 560.521 | 9.393 | 517.489 |

TABLE IV-continued

| Stage 2 Bucket Airfoil | | |
|---|---|---|
| X | Y | R |
| 559.848 | 10.121 | 517.489 |
| 559.155 | 10.830 | 517.489 |
| 558.441 | 11.518 | 517.489 |
| 557.706 | 12.183 | 517.489 |
| 556.947 | 12.821 | 517.489 |
| 556.164 | 13.429 | 517.489 |
| 555.356 | 14.003 | 517.489 |
| 554.522 | 14.540 | 517.489 |
| 553.663 | 15.034 | 517.489 |
| 552.777 | 15.480 | 517.489 |
| 551.867 | 15.873 | 517.489 |
| 550.934 | 16.207 | 517.489 |
| 549.980 | 16.477 | 517.489 |
| 549.010 | 16.679 | 517.489 |
| 548.027 | 16.807 | 517.489 |
| 547.037 | 16.859 | 517.489 |
| 546.046 | 16.834 | 517.489 |
| 545.060 | 16.730 | 517.489 |
| 544.086 | 16.549 | 517.489 |
| 543.129 | 16.292 | 517.489 |
| 542.193 | 15.964 | 517.489 |
| 535.532 | 9.214 | 517.489 |
| 535.856 | 8.290 | 517.489 |
| 536.559 | 7.601 | 517.489 |
| 537.453 | 7.178 | 517.489 |
| 538.411 | 6.925 | 517.489 |
| 539.388 | 6.758 | 517.489 |
| 540.371 | 6.631 | 517.489 |
| 541.356 | 6.518 | 517.489 |
| 542.341 | 6.403 | 517.489 |
| 543.324 | 6.276 | 517.489 |
| 544.305 | 6.129 | 517.489 |
| 545.281 | 5.957 | 517.489 |
| 546.252 | 5.756 | 517.489 |
| 547.216 | 5.525 | 517.489 |
| 548.171 | 5.260 | 517.489 |
| 549.117 | 4.961 | 517.489 |
| 550.051 | 4.629 | 517.489 |
| 550.973 | 4.265 | 517.489 |
| 551.882 | 3.868 | 517.489 |
| 552.776 | 3.441 | 517.489 |
| 553.657 | 2.985 | 517.489 |
| 554.522 | 2.501 | 517.489 |
| 555.372 | 1.992 | 517.489 |
| 556.208 | 1.458 | 517.489 |
| 557.028 | 0.901 | 517.489 |
| 557.835 | 0.324 | 517.489 |
| 558.627 | −0.272 | 517.489 |
| 559.405 | −0.886 | 517.489 |
| 560.170 | −1.517 | 517.489 |
| 577.326 | −19.694 | 517.489 |
| 576.925 | −18.787 | 517.489 |
| 576.517 | −17.883 | 517.489 |
| 576.101 | −16.983 | 517.489 |
| 575.681 | −16.085 | 517.489 |
| 575.256 | −15.189 | 517.489 |
| 574.828 | −14.295 | 517.489 |
| 574.397 | −13.402 | 517.489 |
| 573.963 | −12.511 | 517.489 |
| 573.526 | −11.621 | 517.489 |
| 573.086 | −10.732 | 517.489 |
| 572.642 | −9.846 | 517.489 |
| 572.195 | −8.961 | 517.489 |
| 571.743 | −8.078 | 517.489 |
| 571.288 | −7.198 | 517.489 |
| 570.828 | −6.319 | 517.489 |
| 570.363 | −5.444 | 517.489 |
| 569.892 | −4.571 | 517.489 |
| 569.416 | −3.701 | 517.489 |
| 568.933 | −2.836 | 517.489 |
| 568.443 | −1.974 | 517.489 |
| 567.946 | −1.116 | 517.489 |
| 567.441 | −0.263 | 517.489 |
| 566.927 | 0.585 | 517.489 |
| 566.404 | 1.428 | 517.489 |

TABLE IV-continued

| Stage 2 Bucket Airfoil | | |
|---|---|---|
| X | Y | R |
| 565.872 | 2.264 | 517.489 |
| 560.923 | −2.162 | 517.489 |
| 561.663 | −2.822 | 517.489 |
| 562.391 | −3.494 | 517.489 |
| 563.109 | −4.179 | 517.489 |
| 563.816 | −4.874 | 517.489 |
| 564.512 | −5.579 | 517.489 |
| 565.199 | −6.294 | 517.489 |
| 565.877 | −7.018 | 517.489 |
| 566.546 | −7.750 | 517.489 |
| 567.206 | −8.489 | 517.489 |
| 567.859 | −9.236 | 517.489 |
| 568.503 | −9.989 | 517.489 |
| 569.141 | −10.749 | 517.489 |
| 569.771 | −11.514 | 517.489 |
| 570.394 | −12.285 | 517.489 |
| 571.010 | −13.062 | 517.489 |
| 571.620 | −13.844 | 517.489 |
| 572.223 | −14.630 | 517.489 |
| 572.821 | −15.422 | 517.489 |
| 573.412 | −16.217 | 517.489 |
| 573.997 | −17.018 | 517.489 |
| 574.575 | −17.823 | 517.489 |
| 575.147 | −18.633 | 517.489 |
| 575.713 | −19.447 | 517.489 |
| 576.272 | −20.266 | 517.489 |
| 577.115 | −20.555 | 517.489 |
| 564.441 | 3.728 | 526.821 |
| 563.894 | 4.531 | 526.821 |
| 563.337 | 5.326 | 526.821 |
| 562.767 | 6.113 | 526.821 |
| 562.184 | 6.890 | 526.821 |
| 561.588 | 7.657 | 526.821 |
| 560.977 | 8.412 | 526.821 |
| 560.350 | 9.154 | 526.821 |
| 559.707 | 9.882 | 526.821 |
| 559.045 | 10.593 | 526.821 |
| 558.364 | 11.286 | 526.821 |
| 557.663 | 11.958 | 526.821 |
| 556.941 | 12.608 | 526.821 |
| 556.195 | 13.230 | 526.821 |
| 555.426 | 13.824 | 526.821 |
| 554.633 | 14.384 | 526.821 |
| 553.814 | 14.906 | 526.821 |
| 552.970 | 15.387 | 526.821 |
| 552.100 | 15.820 | 526.821 |
| 551.206 | 16.200 | 526.821 |
| 550.290 | 16.522 | 526.821 |
| 549.354 | 16.780 | 526.821 |
| 564.977 | 2.918 | 526.821 |
| 540.862 | 15.753 | 526.821 |
| 540.019 | 15.271 | 526.821 |
| 539.217 | 14.723 | 526.821 |
| 538.463 | 14.111 | 526.821 |
| 537.767 | 13.434 | 526.821 |
| 537.144 | 12.689 | 526.821 |
| 536.628 | 11.867 | 526.821 |
| 536.297 | 10.957 | 526.821 |
| 548.401 | 16.970 | 526.821 |
| 547.437 | 17.087 | 526.821 |
| 546.467 | 17.128 | 526.821 |
| 545.497 | 17.091 | 526.821 |
| 544.532 | 16.976 | 526.821 |
| 543.581 | 16.782 | 526.821 |
| 542.648 | 16.511 | 526.821 |
| 541.740 | 16.167 | 526.821 |
| 536.371 | 10.003 | 526.821 |
| 536.911 | 9.205 | 526.821 |
| 537.717 | 8.670 | 526.821 |
| 538.634 | 8.352 | 526.821 |
| 539.584 | 8.151 | 526.821 |
| 540.544 | 8.002 | 526.821 |
| 541.507 | 7.874 | 526.821 |
| 542.470 | 7.747 | 526.821 |
| 543.431 | 7.605 | 526.821 |

TABLE IV-continued

| Stage 2 Bucket Airfoil | | |
|---|---|---|
| X | Y | R |
| 544.389 | 7.443 | 526.821 |
| 545.341 | 7.254 | 526.821 |
| 546.287 | 7.034 | 526.821 |
| 547.225 | 6.781 | 526.821 |
| 548.153 | 6.494 | 526.821 |
| 549.069 | 6.171 | 526.821 |
| 549.972 | 5.814 | 526.821 |
| 550.862 | 5.423 | 526.821 |
| 551.737 | 5.001 | 526.821 |
| 552.596 | 4.548 | 526.821 |
| 553.440 | 4.066 | 526.821 |
| 554.267 | 3.558 | 526.821 |
| 555.080 | 3.025 | 526.821 |
| 555.876 | 2.470 | 526.821 |
| 556.658 | 1.893 | 526.821 |
| 557.425 | 1.297 | 526.821 |
| 558.178 | 0.683 | 526.821 |
| 558.918 | 0.053 | 526.821 |
| 559.645 | −0.591 | 526.821 |
| 560.360 | −1.249 | 526.821 |
| 576.868 | −19.344 | 526.821 |
| 576.463 | −18.461 | 526.821 |
| 576.052 | −17.581 | 526.821 |
| 575.631 | −16.705 | 526.821 |
| 575.207 | −15.831 | 526.821 |
| 574.780 | −14.959 | 526.821 |
| 574.350 | −14.088 | 526.821 |
| 573.917 | −13.218 | 526.821 |
| 573.482 | −12.350 | 526.821 |
| 573.044 | −11.482 | 526.821 |
| 572.604 | −10.616 | 526.821 |
| 572.161 | −9.752 | 526.821 |
| 571.716 | −8.888 | 526.821 |
| 571.267 | −8.027 | 526.821 |
| 570.815 | −7.167 | 526.821 |
| 570.360 | −6.309 | 526.821 |
| 569.900 | −5.453 | 526.821 |
| 569.436 | −4.600 | 526.821 |
| 568.967 | −3.749 | 526.821 |
| 568.492 | −2.902 | 526.821 |
| 568.012 | −2.057 | 526.821 |
| 567.525 | −1.217 | 526.821 |
| 567.031 | −0.380 | 526.821 |
| 566.530 | 0.452 | 526.821 |
| 566.021 | 1.279 | 526.821 |
| 565.503 | 2.101 | 526.821 |
| 561.063 | −1.918 | 526.821 |
| 561.756 | −2.599 | 526.821 |
| 562.439 | −3.290 | 526.821 |
| 563.112 | −3.990 | 526.821 |
| 563.777 | −4.699 | 526.821 |
| 564.433 | −5.415 | 526.821 |
| 565.081 | −6.138 | 526.821 |
| 565.723 | −6.868 | 526.821 |
| 566.357 | −7.604 | 526.821 |
| 566.985 | −8.345 | 526.821 |
| 567.607 | −9.091 | 526.821 |
| 568.224 | −9.841 | 526.821 |
| 568.835 | −10.596 | 526.821 |
| 569.441 | −11.355 | 526.821 |
| 570.043 | −12.118 | 526.821 |
| 570.641 | −12.884 | 526.821 |
| 571.234 | −13.653 | 526.821 |
| 571.823 | −14.425 | 526.821 |
| 572.408 | −15.200 | 526.821 |
| 572.989 | −15.979 | 526.821 |
| 573.566 | −16.760 | 526.821 |
| 574.139 | −17.545 | 526.821 |
| 574.706 | −18.334 | 526.821 |
| 575.269 | −19.126 | 526.821 |
| 575.825 | −19.922 | 526.821 |
| 576.658 | −20.189 | 526.821 |
| 540.496 | 15.819 | 536.153 |
| 539.694 | 15.309 | 536.153 |
| 538.942 | 14.727 | 536.153 |

TABLE IV-continued

| Stage 2 Bucket Airfoil | | |
|---|---|---|
| X | Y | R |
| 538.254 | 14.072 | 536.153 |
| 537.653 | 13.337 | 536.153 |
| 563.629 | 4.335 | 536.153 |
| 563.089 | 5.117 | 536.153 |
| 562.538 | 5.892 | 536.153 |
| 561.975 | 6.658 | 536.153 |
| 561.400 | 7.415 | 536.153 |
| 560.811 | 8.162 | 536.153 |
| 560.208 | 8.897 | 536.153 |
| 559.589 | 9.619 | 536.153 |
| 558.954 | 10.327 | 536.153 |
| 558.302 | 11.018 | 536.153 |
| 557.631 | 11.692 | 536.153 |
| 556.940 | 12.345 | 536.153 |
| 556.229 | 12.976 | 536.153 |
| 555.495 | 13.580 | 536.153 |
| 554.738 | 14.156 | 536.153 |
| 553.957 | 14.698 | 536.153 |
| 553.152 | 15.203 | 536.153 |
| 552.322 | 15.667 | 536.153 |
| 551.467 | 16.084 | 536.153 |
| 550.589 | 16.448 | 536.153 |
| 549.690 | 16.755 | 536.153 |
| 548.771 | 16.999 | 536.153 |
| 547.837 | 17.174 | 536.153 |
| 546.892 | 17.277 | 536.153 |
| 545.941 | 17.303 | 536.153 |
| 544.992 | 17.251 | 536.153 |
| 544.051 | 17.120 | 536.153 |
| 543.124 | 16.909 | 536.153 |
| 542.218 | 16.620 | 536.153 |
| 541.340 | 16.256 | 536.153 |
| 541.644 | 9.060 | 536.153 |
| 542.584 | 8.915 | 536.153 |
| 543.521 | 8.758 | 536.153 |
| 544.455 | 8.580 | 536.153 |
| 545.383 | 8.374 | 536.153 |
| 546.304 | 8.135 | 536.153 |
| 547.215 | 7.863 | 536.153 |
| 548.115 | 7.556 | 536.153 |
| 549.001 | 7.213 | 536.153 |
| 549.874 | 6.835 | 536.153 |
| 550.731 | 6.425 | 536.153 |
| 551.573 | 5.982 | 536.153 |
| 552.398 | 5.510 | 536.153 |
| 553.207 | 5.011 | 536.153 |
| 554.000 | 4.485 | 536.153 |
| 554.776 | 3.937 | 536.153 |
| 555.537 | 3.367 | 536.153 |
| 556.283 | 2.777 | 536.153 |
| 557.015 | 2.170 | 536.153 |
| 557.733 | 1.547 | 536.153 |
| 558.438 | 0.909 | 536.153 |
| 559.131 | 0.258 | 536.153 |
| 559.812 | −0.406 | 536.153 |
| 576.412 | −18.994 | 536.153 |
| 576.007 | −18.134 | 536.153 |
| 575.595 | −17.277 | 536.153 |
| 575.176 | −16.423 | 536.153 |
| 574.753 | −15.572 | 536.153 |
| 574.328 | −14.721 | 536.153 |
| 573.900 | −13.872 | 536.153 |
| 573.470 | −13.024 | 536.153 |
| 573.038 | −12.177 | 536.153 |
| 572.604 | −11.331 | 536.153 |
| 572.168 | −10.486 | 536.153 |
| 571.729 | −9.643 | 536.153 |
| 571.289 | −8.800 | 536.153 |
| 570.845 | −7.959 | 536.153 |
| 570.399 | −7.119 | 536.153 |
| 569.950 | −6.281 | 536.153 |
| 569.497 | −5.445 | 536.153 |
| 569.041 | −4.611 | 536.153 |
| 568.580 | −3.780 | 536.153 |
| 568.114 | −2.951 | 536.153 |

TABLE IV-continued

| Stage 2 Bucket Airfoil | | |
|---|---|---|
| X | Y | R |
| 567.643 | −2.125 | 536.153 |
| 567.166 | −1.302 | 536.153 |
| 566.683 | −0.483 | 536.153 |
| 566.193 | 0.332 | 536.153 |
| 565.697 | 1.143 | 536.153 |
| 565.193 | 1.949 | 536.153 |
| 564.681 | 2.750 | 536.153 |
| 564.160 | 3.546 | 536.153 |
| 560.483 | −1.079 | 536.153 |
| 561.144 | −1.763 | 536.153 |
| 561.796 | −2.455 | 536.153 |
| 562.439 | −3.155 | 536.153 |
| 563.075 | −3.862 | 536.153 |
| 563.703 | −4.576 | 536.153 |
| 564.325 | −5.295 | 536.153 |
| 564.940 | −6.020 | 536.153 |
| 565.550 | −6.749 | 536.153 |
| 566.155 | −7.483 | 536.153 |
| 566.755 | −8.221 | 536.153 |
| 567.351 | −8.961 | 536.153 |
| 567.943 | −9.705 | 536.153 |
| 568.532 | −10.452 | 536.153 |
| 569.117 | −11.201 | 536.153 |
| 569.700 | −11.953 | 536.153 |
| 570.280 | −12.706 | 536.153 |
| 570.857 | −13.461 | 536.153 |
| 571.433 | −14.219 | 536.153 |
| 572.005 | −14.978 | 536.153 |
| 572.575 | −15.738 | 536.153 |
| 573.143 | −16.501 | 536.153 |
| 573.708 | −17.266 | 536.153 |
| 574.270 | −18.033 | 536.153 |
| 574.827 | −18.804 | 536.153 |
| 575.379 | −19.578 | 536.153 |
| 576.201 | −19.823 | 536.153 |
| 537.188 | 12.509 | 536.153 |
| 536.997 | 11.586 | 536.153 |
| 537.322 | 10.704 | 536.153 |
| 537.998 | 10.045 | 536.153 |
| 538.855 | 9.638 | 536.153 |
| 539.771 | 9.388 | 536.153 |
| 540.705 | 9.210 | 536.153 |
| 539.450 | 15.240 | 545.485 |
| 538.772 | 14.604 | 545.485 |
| 563.415 | 4.157 | 545.485 |
| 562.890 | 4.924 | 545.485 |
| 562.355 | 5.685 | 545.485 |
| 561.809 | 6.438 | 545.485 |
| 561.252 | 7.182 | 545.485 |
| 560.682 | 7.918 | 545.485 |
| 560.100 | 8.643 | 545.485 |
| 559.503 | 9.356 | 545.485 |
| 558.892 | 10.057 | 545.485 |
| 558.264 | 10.744 | 545.485 |
| 557.620 | 11.415 | 545.485 |
| 556.958 | 12.067 | 545.485 |
| 556.276 | 12.700 | 545.485 |
| 555.574 | 13.311 | 545.485 |
| 554.851 | 13.895 | 545.485 |
| 554.106 | 14.451 | 545.485 |
| 553.337 | 14.975 | 545.485 |
| 552.544 | 15.461 | 545.485 |
| 551.728 | 15.906 | 545.485 |
| 550.888 | 16.305 | 545.485 |
| 550.025 | 16.652 | 545.485 |
| 549.141 | 16.941 | 545.485 |
| 548.239 | 17.166 | 545.485 |
| 547.322 | 17.323 | 545.485 |
| 546.396 | 17.407 | 545.485 |
| 545.467 | 17.415 | 545.485 |
| 544.540 | 17.344 | 545.485 |
| 543.622 | 17.193 | 545.485 |
| 542.722 | 16.961 | 545.485 |
| 541.845 | 16.650 | 545.485 |
| 541.002 | 16.260 | 545.485 |

TABLE IV-continued

| Stage 2 Bucket Airfoil | | |
|---|---|---|
| X | Y | R |
| 540.199 | 15.791 | 545.485 |
| 538.198 | 13.874 | 545.485 |
| 537.803 | 13.036 | 545.485 |
| 537.806 | 12.121 | 545.485 |
| 538.287 | 11.334 | 545.485 |
| 539.050 | 10.811 | 545.485 |
| 539.922 | 10.491 | 545.485 |
| 540.826 | 10.273 | 545.485 |
| 541.739 | 10.096 | 545.485 |
| 542.654 | 9.928 | 545.485 |
| 543.568 | 9.753 | 545.485 |
| 544.477 | 9.557 | 545.485 |
| 545.379 | 9.333 | 545.485 |
| 546.274 | 9.078 | 545.485 |
| 547.157 | 8.787 | 545.485 |
| 548.028 | 8.462 | 545.485 |
| 548.886 | 8.102 | 545.485 |
| 549.728 | 7.708 | 545.485 |
| 550.554 | 7.281 | 545.485 |
| 551.364 | 6.823 | 545.485 |
| 552.157 | 6.337 | 545.485 |
| 552.933 | 5.825 | 545.485 |
| 553.693 | 5.289 | 545.485 |
| 554.437 | 4.731 | 545.485 |
| 555.166 | 4.153 | 545.485 |
| 555.880 | 3.557 | 545.485 |
| 556.581 | 2.945 | 545.485 |
| 557.268 | 2.318 | 545.485 |
| 557.943 | 1.678 | 545.485 |
| 558.606 | 1.027 | 545.485 |
| 559.259 | 0.364 | 545.485 |
| 575.954 | −18.646 | 545.485 |
| 575.556 | −17.805 | 545.485 |
| 575.150 | −16.969 | 545.485 |
| 574.737 | −16.135 | 545.485 |
| 574.322 | −15.303 | 545.485 |
| 573.903 | −14.472 | 545.485 |
| 573.483 | −13.643 | 545.485 |
| 573.060 | −12.814 | 545.485 |
| 572.635 | −11.987 | 545.485 |
| 572.209 | −11.160 | 545.485 |
| 571.780 | −10.335 | 545.485 |
| 571.349 | −9.511 | 545.485 |
| 570.916 | −8.688 | 545.485 |
| 570.481 | −7.866 | 545.485 |
| 570.042 | −7.046 | 545.485 |
| 569.601 | −6.227 | 545.485 |
| 569.156 | −5.410 | 545.485 |
| 568.707 | −4.595 | 545.485 |
| 568.255 | −3.783 | 545.485 |
| 567.798 | −2.973 | 545.485 |
| 567.336 | −2.166 | 545.485 |
| 566.868 | −1.362 | 545.485 |
| 566.395 | −0.561 | 545.485 |
| 565.916 | 0.237 | 545.485 |
| 565.431 | 1.030 | 545.485 |
| 564.939 | 1.819 | 545.485 |
| 564.439 | 2.604 | 545.485 |
| 563.932 | 3.383 | 545.485 |
| 559.902 | −0.308 | 545.485 |
| 560.536 | −0.988 | 545.485 |
| 561.161 | −1.677 | 545.485 |
| 561.779 | −2.372 | 545.485 |
| 562.390 | −3.073 | 545.485 |
| 562.994 | −3.780 | 545.485 |
| 563.593 | −4.492 | 545.485 |
| 564.186 | −5.208 | 545.485 |
| 564.775 | −5.928 | 545.485 |
| 565.359 | −6.652 | 545.485 |
| 565.940 | −7.379 | 545.485 |
| 566.516 | −8.108 | 545.485 |
| 567.090 | −8.840 | 545.485 |
| 567.661 | −9.574 | 545.485 |
| 568.230 | −10.310 | 545.485 |
| 568.797 | −11.047 | 545.485 |

TABLE IV-continued

| Stage 2 Bucket Airfoil | | |
|---|---|---|
| X | Y | R |
| 569.363 | −11.786 | 545.485 |
| 569.927 | −12.525 | 545.485 |
| 570.490 | −13.266 | 545.485 |
| 571.051 | −14.007 | 545.485 |
| 571.612 | −14.749 | 545.485 |
| 572.171 | −15.493 | 545.485 |
| 572.728 | −16.237 | 545.485 |
| 573.284 | −16.983 | 545.485 |
| 573.838 | −17.730 | 545.485 |
| 574.388 | −18.480 | 545.485 |
| 574.933 | −19.234 | 545.485 |
| 575.745 | −19.457 | 545.485 |
| 563.252 | 4.006 | 554.817 |
| 562.741 | 4.758 | 554.817 |
| 562.221 | 5.504 | 554.817 |
| 561.691 | 6.243 | 554.817 |
| 561.150 | 6.975 | 554.817 |
| 560.599 | 7.698 | 554.817 |
| 560.035 | 8.412 | 554.817 |
| 559.459 | 9.116 | 554.817 |
| 558.869 | 9.808 | 554.817 |
| 558.265 | 10.487 | 554.817 |
| 557.645 | 11.153 | 554.817 |
| 557.008 | 11.802 | 554.817 |
| 556.354 | 12.434 | 554.817 |
| 555.681 | 13.045 | 554.817 |
| 554.988 | 13.634 | 554.817 |
| 554.274 | 14.198 | 554.817 |
| 553.538 | 14.732 | 554.817 |
| 552.780 | 15.234 | 554.817 |
| 551.998 | 15.698 | 554.817 |
| 551.193 | 16.122 | 554.817 |
| 550.366 | 16.498 | 554.817 |
| 549.516 | 16.822 | 554.817 |
| 548.647 | 17.089 | 554.817 |
| 547.761 | 17.293 | 554.817 |
| 546.862 | 17.428 | 554.817 |
| 545.955 | 17.491 | 554.817 |
| 545.045 | 17.478 | 554.817 |
| 544.141 | 17.386 | 554.817 |
| 543.249 | 17.213 | 554.817 |
| 542.376 | 16.957 | 554.817 |
| 541.534 | 16.616 | 554.817 |
| 540.732 | 16.187 | 554.817 |
| 539.986 | 15.668 | 554.817 |
| 539.320 | 15.050 | 554.817 |
| 538.779 | 14.321 | 554.817 |
| 538.475 | 13.471 | 554.817 |
| 538.650 | 12.592 | 554.817 |
| 539.251 | 11.921 | 554.817 |
| 540.058 | 11.508 | 554.817 |
| 540.926 | 11.237 | 554.817 |
| 541.811 | 11.028 | 554.817 |
| 542.700 | 10.836 | 554.817 |
| 543.588 | 10.640 | 554.817 |
| 544.472 | 10.426 | 554.817 |
| 545.349 | 10.185 | 554.817 |
| 546.217 | 9.913 | 554.817 |
| 547.073 | 9.606 | 554.817 |
| 547.916 | 9.265 | 554.817 |
| 548.744 | 8.889 | 554.817 |
| 549.556 | 8.480 | 554.817 |
| 550.352 | 8.040 | 554.817 |
| 551.131 | 7.570 | 554.817 |
| 551.893 | 7.074 | 554.817 |
| 552.638 | 6.553 | 554.817 |
| 553.367 | 6.010 | 554.817 |
| 554.081 | 5.446 | 554.817 |
| 554.781 | 4.865 | 554.817 |
| 555.466 | 4.267 | 554.817 |
| 556.138 | 3.654 | 554.817 |
| 556.798 | 3.028 | 554.817 |
| 557.446 | 2.390 | 554.817 |
| 558.083 | 1.742 | 554.817 |
| 558.711 | 1.084 | 554.817 |

TABLE IV-continued

| Stage 2 Bucket Airfoil | | |
|---|---|---|
| X | Y | R |
| 559.330 | 0.417 | 554.817 |
| 575.499 | −18.298 | 554.817 |
| 575.112 | −17.475 | 554.817 |
| 574.716 | −16.656 | 554.817 |
| 574.315 | −15.840 | 554.817 |
| 573.911 | −15.025 | 554.817 |
| 573.505 | −14.211 | 554.817 |
| 573.096 | −13.399 | 554.817 |
| 572.685 | −12.588 | 554.817 |
| 572.271 | −11.778 | 554.817 |
| 571.855 | −10.969 | 554.817 |
| 571.437 | −10.162 | 554.817 |
| 571.016 | −9.356 | 554.817 |
| 570.592 | −8.551 | 554.817 |
| 570.165 | −7.748 | 554.817 |
| 569.736 | −6.946 | 554.817 |
| 569.303 | −6.146 | 554.817 |
| 568.867 | −5.348 | 554.817 |
| 568.427 | −4.552 | 554.817 |
| 567.983 | −3.758 | 554.817 |
| 567.535 | −2.967 | 554.817 |
| 567.082 | −2.178 | 554.817 |
| 566.624 | −1.392 | 554.817 |
| 566.161 | −0.610 | 554.817 |
| 565.693 | 0.170 | 554.817 |
| 565.218 | 0.946 | 554.817 |
| 564.737 | 1.718 | 554.817 |
| 564.250 | 2.485 | 554.817 |
| 563.755 | 3.248 | 554.817 |
| 559.941 | −0.257 | 554.817 |
| 560.544 | −0.938 | 554.817 |
| 561.139 | −1.625 | 554.817 |
| 561.729 | −2.317 | 554.817 |
| 562.313 | −3.015 | 554.817 |
| 562.891 | −3.716 | 554.817 |
| 563.465 | −4.422 | 554.817 |
| 564.035 | −5.131 | 554.817 |
| 564.601 | −5.843 | 554.817 |
| 565.164 | −6.557 | 554.817 |
| 565.723 | −7.274 | 554.817 |
| 566.280 | −7.993 | 554.817 |
| 566.835 | −8.714 | 554.817 |
| 567.388 | −9.435 | 554.817 |
| 567.940 | −10.159 | 554.817 |
| 568.490 | −10.883 | 554.817 |
| 569.039 | −11.607 | 554.817 |
| 569.588 | −12.333 | 554.817 |
| 570.136 | −13.058 | 554.817 |
| 570.684 | −13.785 | 554.817 |
| 571.231 | −14.511 | 554.817 |
| 571.778 | −15.238 | 554.817 |
| 572.323 | −15.966 | 554.817 |
| 572.868 | −16.694 | 554.817 |
| 573.411 | −17.424 | 554.817 |
| 573.951 | −18.155 | 554.817 |
| 574.488 | −18.889 | 554.817 |
| 575.289 | −19.091 | 554.817 |
| 562.623 | 4.619 | 564.149 |
| 562.117 | 5.350 | 564.149 |
| 561.602 | 6.075 | 564.149 |
| 561.077 | 6.793 | 564.149 |
| 560.542 | 7.503 | 564.149 |
| 559.996 | 8.205 | 564.149 |
| 559.438 | 8.897 | 564.149 |
| 558.867 | 9.579 | 564.149 |
| 558.284 | 10.250 | 564.149 |
| 557.685 | 10.908 | 564.149 |
| 557.072 | 11.551 | 564.149 |
| 556.442 | 12.179 | 564.149 |
| 555.794 | 12.788 | 564.149 |
| 555.128 | 13.377 | 564.149 |
| 554.443 | 13.944 | 564.149 |
| 553.737 | 14.484 | 564.149 |
| 553.010 | 14.996 | 564.149 |
| 552.261 | 15.475 | 564.149 |

TABLE IV-continued

| Stage 2 Bucket Airfoil | | |
|---|---|---|
| X | Y | R |
| 551.489 | 15.918 | 564.149 |
| 550.696 | 16.318 | 564.149 |
| 549.880 | 16.673 | 564.149 |
| 549.045 | 16.976 | 564.149 |
| 548.190 | 17.222 | 564.149 |
| 547.321 | 17.406 | 564.149 |
| 546.439 | 17.522 | 564.149 |
| 545.551 | 17.565 | 564.149 |
| 544.663 | 17.531 | 564.149 |
| 543.782 | 17.416 | 564.149 |
| 542.916 | 17.215 | 564.149 |
| 542.076 | 16.925 | 564.149 |
| 541.275 | 16.539 | 564.149 |
| 548.613 | 9.636 | 564.149 |
| 549.395 | 9.213 | 564.149 |
| 550.160 | 8.760 | 564.149 |
| 550.908 | 8.279 | 564.149 |
| 551.639 | 7.773 | 564.149 |
| 552.354 | 7.244 | 564.149 |
| 553.053 | 6.695 | 564.149 |
| 553.738 | 6.127 | 564.149 |
| 554.408 | 5.543 | 564.149 |
| 555.066 | 4.944 | 564.149 |
| 555.711 | 4.333 | 564.149 |
| 556.345 | 3.709 | 564.149 |
| 556.968 | 3.075 | 564.149 |
| 557.582 | 2.431 | 564.149 |
| 558.186 | 1.779 | 564.149 |
| 558.783 | 1.120 | 564.149 |
| 559.372 | 0.454 | 564.149 |
| 571.524 | −10.764 | 564.149 |
| 571.118 | −9.973 | 564.149 |
| 570.708 | −9.184 | 564.149 |
| 570.295 | −8.397 | 564.149 |
| 569.879 | −7.611 | 564.149 |
| 569.459 | −6.827 | 564.149 |
| 569.037 | −6.045 | 564.149 |
| 568.610 | −5.264 | 564.149 |
| 568.180 | −4.486 | 564.149 |
| 567.745 | −3.710 | 564.149 |
| 567.307 | −2.937 | 564.149 |
| 566.863 | −2.166 | 564.149 |
| 566.415 | −1.398 | 564.149 |
| 565.962 | −0.633 | 564.149 |
| 565.504 | 0.129 | 564.149 |
| 565.040 | 0.888 | 564.149 |
| 564.570 | 1.643 | 564.149 |
| 564.094 | 2.394 | 564.149 |
| 563.611 | 3.141 | 564.149 |
| 563.121 | 3.883 | 564.149 |
| 559.954 | −0.218 | 564.149 |
| 560.530 | −0.896 | 564.149 |
| 561.100 | −1.578 | 564.149 |
| 540.532 | 16.053 | 564.149 |
| 539.878 | 15.452 | 564.149 |
| 539.377 | 14.721 | 564.149 |
| 539.198 | 13.861 | 564.149 |
| 539.525 | 13.048 | 564.149 |
| 540.222 | 12.505 | 564.149 |
| 541.043 | 12.169 | 564.149 |
| 541.897 | 11.921 | 564.149 |
| 542.760 | 11.704 | 564.149 |
| 543.622 | 11.488 | 564.149 |
| 544.480 | 11.255 | 564.149 |
| 545.331 | 10.997 | 564.149 |
| 546.172 | 10.708 | 564.149 |
| 547.001 | 10.385 | 564.149 |
| 547.815 | 10.027 | 564.149 |
| 575.048 | −17.949 | 564.149 |
| 574.672 | −17.143 | 564.149 |
| 574.289 | −16.341 | 564.149 |
| 573.902 | −15.540 | 564.149 |
| 573.513 | −14.741 | 564.149 |
| 573.121 | −13.943 | 564.149 |
| 572.726 | −13.146 | 564.149 |

TABLE IV-continued

| Stage 2 Bucket Airfoil | | |
|---|---|---|
| X | Y | R |
| 572.328 | −12.350 | 564.149 |
| 571.928 | −11.557 | 564.149 |
| 561.665 | −2.265 | 564.149 |
| 562.226 | −2.955 | 564.149 |
| 562.782 | −3.649 | 564.149 |
| 563.334 | −4.346 | 564.149 |
| 563.883 | −5.045 | 564.149 |
| 564.430 | −5.747 | 564.149 |
| 564.973 | −6.451 | 564.149 |
| 565.514 | −7.157 | 564.149 |
| 566.053 | −7.864 | 564.149 |
| 566.590 | −8.572 | 564.149 |
| 567.126 | −9.282 | 564.149 |
| 567.661 | −9.992 | 564.149 |
| 568.196 | −10.703 | 564.149 |
| 568.729 | −11.414 | 564.149 |
| 569.263 | −12.126 | 564.149 |
| 569.796 | −12.837 | 564.149 |
| 570.328 | −13.549 | 564.149 |
| 570.861 | −14.261 | 564.149 |
| 571.393 | −14.974 | 564.149 |
| 571.925 | −15.686 | 564.149 |
| 572.457 | −16.399 | 564.149 |
| 572.988 | −17.112 | 564.149 |
| 573.516 | −17.827 | 564.149 |
| 574.044 | −18.543 | 564.149 |
| 574.833 | −18.724 | 564.149 |
| 562.510 | 4.531 | 573.481 |
| 562.018 | 5.249 | 573.481 |
| 561.518 | 5.962 | 573.481 |
| 561.009 | 6.668 | 573.481 |
| 560.491 | 7.367 | 573.481 |
| 559.962 | 8.058 | 573.481 |
| 559.422 | 8.741 | 573.481 |
| 558.870 | 9.414 | 573.481 |
| 558.306 | 10.077 | 573.481 |
| 557.729 | 10.728 | 573.481 |
| 557.137 | 11.365 | 573.481 |
| 556.530 | 11.989 | 573.481 |
| 555.906 | 12.596 | 573.481 |
| 555.266 | 13.185 | 573.481 |
| 554.607 | 13.754 | 573.481 |
| 553.929 | 14.300 | 573.481 |
| 553.231 | 14.820 | 573.481 |
| 552.513 | 15.311 | 573.481 |
| 551.773 | 15.770 | 573.481 |
| 551.012 | 16.191 | 573.481 |
| 550.229 | 16.572 | 573.481 |
| 549.426 | 16.906 | 573.481 |
| 548.602 | 17.188 | 573.481 |
| 547.762 | 17.413 | 573.481 |
| 546.907 | 17.575 | 573.481 |
| 546.042 | 17.669 | 573.481 |
| 545.172 | 17.688 | 573.481 |
| 544.304 | 17.627 | 573.481 |
| 543.447 | 17.480 | 573.481 |
| 542.610 | 17.242 | 573.481 |
| 541.809 | 16.904 | 573.481 |
| 541.065 | 16.454 | 573.481 |
| 540.421 | 15.871 | 573.481 |
| 539.982 | 15.126 | 573.481 |
| 539.971 | 14.269 | 573.481 |
| 540.466 | 13.570 | 573.481 |
| 541.222 | 13.144 | 573.481 |
| 542.043 | 12.856 | 573.481 |
| 542.880 | 12.617 | 573.481 |
| 543.718 | 12.385 | 573.481 |
| 544.553 | 12.139 | 573.481 |
| 545.380 | 11.866 | 573.481 |
| 546.195 | 11.562 | 573.481 |
| 546.997 | 11.225 | 573.481 |
| 547.784 | 10.853 | 573.481 |
| 548.555 | 10.449 | 573.481 |
| 549.308 | 10.013 | 573.481 |
| 550.044 | 9.549 | 573.481 |

TABLE IV-continued

| Stage 2 Bucket Airfoil | | |
|---|---|---|
| X | Y | R |
| 550.763 | 9.058 | 573.481 |
| 551.465 | 8.544 | 573.481 |
| 552.151 | 8.008 | 573.481 |
| 552.822 | 7.454 | 573.481 |
| 553.479 | 6.883 | 573.481 |
| 554.122 | 6.296 | 573.481 |
| 554.753 | 5.697 | 573.481 |
| 555.372 | 5.085 | 573.481 |
| 555.981 | 4.463 | 573.481 |
| 556.580 | 3.832 | 573.481 |
| 557.169 | 3.192 | 573.481 |
| 557.751 | 2.544 | 573.481 |
| 558.325 | 1.890 | 573.481 |
| 558.892 | 1.230 | 573.481 |
| 574.597 | −17.599 | 573.481 |
| 574.230 | −16.811 | 573.481 |
| 573.855 | −16.025 | 573.481 |
| 573.478 | −15.241 | 573.481 |
| 573.100 | −14.457 | 573.481 |
| 572.718 | −13.674 | 573.481 |
| 572.335 | −12.893 | 573.481 |
| 571.948 | −12.114 | 573.481 |
| 571.559 | −11.335 | 573.481 |
| 571.166 | −10.558 | 573.481 |
| 570.771 | −9.783 | 573.481 |
| 570.373 | −9.009 | 573.481 |
| 569.971 | −8.237 | 573.481 |
| 569.566 | −7.466 | 573.481 |
| 569.159 | −6.698 | 573.481 |
| 568.747 | −5.931 | 573.481 |
| 568.332 | −5.166 | 573.481 |
| 567.913 | −4.403 | 573.481 |
| 567.491 | −3.642 | 573.481 |
| 567.064 | −2.883 | 573.481 |
| 566.632 | −2.127 | 573.481 |
| 566.196 | −1.374 | 573.481 |
| 565.756 | −0.624 | 573.481 |
| 565.310 | 0.124 | 573.481 |
| 564.859 | 0.868 | 573.481 |
| 564.402 | 1.609 | 573.481 |
| 563.939 | 2.346 | 573.481 |
| 563.469 | 3.079 | 573.481 |
| 562.993 | 3.807 | 573.481 |
| 559.453 | 0.564 | 573.481 |
| 560.008 | −0.106 | 573.481 |
| 560.558 | −0.781 | 573.481 |
| 561.103 | −1.459 | 573.481 |
| 561.644 | −2.141 | 573.481 |
| 562.181 | −2.826 | 573.481 |
| 562.714 | −3.514 | 573.481 |
| 563.245 | −4.204 | 573.481 |
| 563.772 | −4.896 | 573.481 |
| 564.297 | −5.591 | 573.481 |
| 564.820 | −6.286 | 573.481 |
| 565.341 | −6.984 | 573.481 |
| 565.860 | −7.682 | 573.481 |
| 566.378 | −8.382 | 573.481 |
| 566.895 | −9.082 | 573.481 |
| 567.411 | −9.782 | 573.481 |
| 567.927 | −10.483 | 573.481 |
| 568.442 | −11.185 | 573.481 |
| 568.958 | −11.886 | 573.481 |
| 569.473 | −12.588 | 573.481 |
| 569.988 | −13.289 | 573.481 |
| 570.504 | −13.990 | 573.481 |
| 571.019 | −14.691 | 573.481 |
| 571.535 | −15.392 | 573.481 |
| 572.052 | −16.093 | 573.481 |
| 572.567 | −16.794 | 573.481 |
| 573.083 | −17.495 | 573.481 |
| 573.599 | −18.196 | 573.481 |
| 574.377 | −18.358 | 573.481 |
| 562.387 | 4.506 | 582.813 |
| 561.912 | 5.215 | 582.813 |
| 561.429 | 5.919 | 582.813 |

TABLE IV-continued

| Stage 2 Bucket Airfoil | | |
|---|---|---|
| X | Y | R |
| 560.937 | 6.616 | 582.813 |
| 560.436 | 7.307 | 582.813 |
| 559.926 | 7.991 | 582.813 |
| 559.404 | 8.666 | 582.813 |
| 558.872 | 9.333 | 582.813 |
| 558.328 | 9.990 | 582.813 |
| 557.771 | 10.637 | 582.813 |
| 557.200 | 11.271 | 582.813 |
| 556.615 | 11.893 | 582.813 |
| 556.015 | 12.500 | 582.813 |
| 555.399 | 13.090 | 582.813 |
| 554.766 | 13.662 | 582.813 |
| 554.114 | 14.213 | 582.813 |
| 553.444 | 14.741 | 582.813 |
| 552.753 | 15.242 | 582.813 |
| 552.043 | 15.714 | 582.813 |
| 551.311 | 16.153 | 582.813 |
| 550.558 | 16.554 | 582.813 |
| 549.784 | 16.913 | 582.813 |
| 548.989 | 17.225 | 582.813 |
| 548.176 | 17.483 | 582.813 |
| 547.347 | 17.684 | 582.813 |
| 546.505 | 17.821 | 582.813 |
| 545.654 | 17.888 | 582.813 |
| 544.801 | 17.880 | 582.813 |
| 543.953 | 17.788 | 582.813 |
| 543.120 | 17.607 | 582.813 |
| 542.315 | 17.324 | 582.813 |
| 541.567 | 16.917 | 582.813 |
| 540.940 | 16.343 | 582.813 |
| 540.629 | 15.561 | 582.813 |
| 540.822 | 14.747 | 582.813 |
| 541.459 | 14.192 | 582.813 |
| 542.241 | 13.853 | 582.813 |
| 543.054 | 13.595 | 582.813 |
| 543.873 | 13.354 | 582.813 |
| 544.688 | 13.100 | 582.813 |
| 545.493 | 12.820 | 582.813 |
| 546.287 | 12.505 | 582.813 |
| 547.065 | 12.156 | 582.813 |
| 547.828 | 11.774 | 582.813 |
| 548.574 | 11.359 | 582.813 |
| 549.302 | 10.914 | 582.813 |
| 550.012 | 10.441 | 582.813 |
| 550.705 | 9.943 | 582.813 |
| 551.381 | 9.423 | 582.813 |
| 552.042 | 8.882 | 582.813 |
| 552.687 | 8.324 | 582.813 |
| 553.318 | 7.749 | 582.813 |
| 553.937 | 7.161 | 582.813 |
| 554.543 | 6.561 | 582.813 |
| 555.138 | 5.949 | 582.813 |
| 555.723 | 5.328 | 582.813 |
| 556.298 | 4.697 | 582.813 |
| 556.865 | 4.059 | 582.813 |
| 557.423 | 3.414 | 582.813 |
| 557.974 | 2.762 | 582.813 |
| 558.519 | 2.105 | 582.813 |
| 559.058 | 1.444 | 582.813 |
| 574.147 | −17.248 | 582.813 |
| 573.783 | −16.477 | 582.813 |
| 573.411 | −15.709 | 582.813 |
| 573.037 | −14.942 | 582.813 |
| 572.662 | −14.175 | 582.813 |
| 572.285 | −13.409 | 582.813 |
| 571.908 | −12.644 | 582.813 |
| 571.528 | −11.879 | 582.813 |
| 571.147 | −11.116 | 582.813 |
| 570.763 | −10.354 | 582.813 |
| 570.378 | −9.592 | 582.813 |
| 569.990 | −8.832 | 582.813 |
| 569.600 | −8.073 | 582.813 |
| 569.207 | −7.316 | 582.813 |
| 568.812 | −6.559 | 582.813 |
| 568.413 | −5.805 | 582.813 |

TABLE IV-continued

| Stage 2 Bucket Airfoil | | |
|---|---|---|
| X | Y | R |
| 568.012 | −5.052 | 582.813 |
| 567.607 | −4.301 | 582.813 |
| 567.198 | −3.551 | 582.813 |
| 566.786 | −2.804 | 582.813 |
| 566.369 | −2.060 | 582.813 |
| 565.948 | −1.317 | 582.813 |
| 565.522 | −0.578 | 582.813 |
| 565.092 | 0.159 | 582.813 |
| 564.656 | 0.893 | 582.813 |
| 564.215 | 1.623 | 582.813 |
| 563.768 | 2.350 | 582.813 |
| 563.314 | 3.073 | 582.813 |
| 562.854 | 3.792 | 582.813 |
| 559.591 | 0.777 | 582.813 |
| 560.119 | 0.107 | 582.813 |
| 560.642 | −0.567 | 582.813 |
| 561.161 | −1.245 | 582.813 |
| 561.676 | −1.925 | 582.813 |
| 562.188 | −2.608 | 582.813 |
| 562.697 | −3.293 | 582.813 |
| 563.203 | −3.980 | 582.813 |
| 563.706 | −4.669 | 582.813 |
| 564.207 | −5.360 | 582.813 |
| 564.707 | −6.052 | 582.813 |
| 565.205 | −6.745 | 582.813 |
| 565.702 | −7.439 | 582.813 |
| 566.198 | −8.133 | 582.813 |
| 566.693 | −8.828 | 582.813 |
| 567.188 | −9.524 | 582.813 |
| 567.682 | −10.219 | 582.813 |
| 568.176 | −10.915 | 582.813 |
| 568.671 | −11.610 | 582.813 |
| 569.165 | −12.306 | 582.813 |
| 569.660 | −13.001 | 582.813 |
| 570.156 | −13.695 | 582.813 |
| 570.653 | −14.389 | 582.813 |
| 571.151 | −15.082 | 582.813 |
| 571.650 | −15.775 | 582.813 |
| 572.149 | −16.467 | 582.813 |
| 572.650 | −17.158 | 582.813 |
| 573.154 | −17.846 | 582.813 |
| 573.920 | −17.991 | 582.813 |

As an example, the profile sections of the second stage bucket airfoils 22 at each of the near root, near pitch and near tip distances R are illustrated in FIG. 4.

It will also be appreciated that the airfoils disclosed in the above Tables I-IV may be scaled up or down geometrically for use in other similar turbine designs. Consequently, the coordinate values set forth in Tables I-IV may be scaled upwardly or downwardly such the airfoil shapes remain unchanged. A scaled version of the coordinates values in Tables I-IV would be represented by X, Y and R coordinate values multiplied or divided by the same constant or number.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine nozzle for a turbine, the turbine nozzle including an airfoil having an airfoil shape, said airfoil having a nominal profile substantially in accordance with Cartesian coordinate values of X, Y and R set forth in millimeters in Table I, excluding values for X of 28.900 and for R of 494.350, wherein R is a distance along a radius from an axis of rotation of the turbine and X and Y are distances which, when connected by smooth continuing arcs, define airfoil profile sections in planes normal to the radius and at each distance R, the profile sections at the R distances being joined smoothly with one another to form said airfoil shape.

2. A turbine nozzle according to claim 1 forming part of a first stage of the turbine.

3. A turbine nozzle according to claim 1 wherein said airfoil shape lies in an envelope within ±4.064 millimeters in a direction normal to any airfoil surface location.

4. A turbine bucket including an airfoil having an airfoil shape, said airfoil having a nominal profile substantially in accordance with Cartesian coordinate values of X, Y and R set forth in millimeters in Table II wherein R is a distance along a radius from an axis of rotation of the turbine and X and Y are distances which, when connected by smooth continuing arcs, define airfoil profile sections in planes normal to the radius and at each distance R, the profile sections at the R distances being joined smoothly with one another to form said airfoil shape.

5. A turbine bucket according to claim 4 forming part of a first stage of the turbine.

6. A turbine bucket according to claim 4 wherein said airfoil shape lies in an envelope within 4.064 millimeters in a direction normal to any airfoil surface location.

7. A turbine nozzle including an airfoil having an airfoil shape, said airfoil having a nominal profile substantially in accordance with Cartesian coordinate values of X, Y and R set forth in millimeters in Table III wherein R is a distance along a radius from an axis of rotation of the turbine and X and Y are distances which, when connected by smooth continuous arcs, define airfoil profile sections in planes normal to the radius and at each distance R, the profile sections in planes normal to the radius and at the R distances being joined smoothly with one another to form said airfoil shape.

8. A turbine nozzle according to claim 7 forming part of a second stage of the turbine.

9. A turbine nozzle according to claim 7 wherein said airfoil shape lies in an envelope within ±4.064 millimeters in a direction normal to any airfoil surface location.

10. A turbine bucket including an airfoil having an airfoil shape, said airfoil having a nominal profile substantially in accordance with Cartesian coordinate values of X, Y and R set forth in millimeters in Table IV wherein R is a distance along a radius from an axis of rotation of the turbine and X and Y are distances which, when connected by smooth continuous arcs, define airfoil profile sections in planes normal to the radius and at each distance R, the profile sections at the R distances being joined smoothly with one another to form the airfoil shape.

11. A turbine bucket according to claim 10 forming part of a second stage of the turbine.

12. A turbine bucket according to claim 10 wherein said airfoil shape lies in an envelope within ±4.064 millimeters in a direction normal to any airfoil surface location.

13. A first stage of a turbine having a plurality of nozzles in a circumferential array about a turbine axis and a plurality of buckets in a circumferential array about said axis downstream of said nozzles, each said nozzle including a nozzle airfoil having a nozzle airfoil shape, said nozzle airfoil having a nominal profile substantially in accordance with Cartesian coordinate values of X, Y and R set forth in millimeters in Table I, excluding values for X of 28.900 and for R of 494.350, wherein R is a distance along a radius from the axis of rotation of the turbine and X and Y are distances which, when connected by smooth continuing arcs, define nozzle airfoil profile sections in planes normal to the radius and at each distance R, the nozzle airfoil profile sections at the R distances being joined smoothly with one another to form said nozzle airfoil shape; each said bucket including a bucket airfoil having a bucket airfoil shape, said bucket airfoil having a nominal airfoil profile substantially in accordance with Cartesian coordinate values of X, Y and R set forth in millimeters Table II wherein R is a distance along a radius from the axis of rotation of the turbine and X and Y are distances which, when connected by smooth continuing arcs, define bucket airfoil profile sections in planes normal to the radius and at each distance R, the bucket airfoil profile sections at the R distances of Table II being joined smoothly with one another to form said bucket airfoil shape.

14. A first turbine stage according to claim 13 wherein each said airfoil shape of each of said nozzle and said bucket lies in an envelope within ±4.064 millimeters in a direction normal to any respective airfoil surface location.

15. A second stage of a turbine having a plurality of nozzles in a circumferential array about a turbine axis and a plurality of buckets in a circumferential array about said axis downstream of said nozzles, each said nozzle including a nozzle airfoil having a nozzle airfoil shape, said nozzle airfoil having a nominal profile substantially in accordance with Cartesian coordinate values of X, Y and R set forth in millimeters in Table III wherein R is a distance along a radius from the axis of rotation of the turbine and X and y are distances which, when connected by smooth continuous arcs, define nozzle airfoil profile sections in planes normal to the radius and at each distance R, the nozzle profile sections at the R distances being joined smoothly with one another to form said nozzle airfoil shape; each said bucket including a bucket airfoil having a bucket airfoil shape, said bucket airfoil having a nominal profile substantially in accordance with Cartesian coordinate values of X, Y and R set forth in millimeters in Table IV wherein R is a distance along a radius from the axis of rotation of the turbine and X and Y are distances which, when connected by smooth continuous arcs, define bucket airfoil profile sections in planes normal to the radius and at each distance R, the bucket airfoil profile sections at the R distances of Table IV being joined smoothly with one another to form said bucket airfoil shape.

16. A second stage of a turbine according to claim 15 wherein each said airfoil shape of each of said nozzles and said buckets lie in an envelope within ±4.064 millimeters in a direction normal to any respective airfoil surface location.

* * * * *

UNITED STATES PATENT AND TRADEMARK OFFICE

CERTIFICATE OF CORRECTION

PATENT NO. : 7,467,920 B2
APPLICATION NO. : 11/648906
DATED : December 23, 2008
INVENTOR(S) : Sullivan et al.

It is certified that error appears in the above-identified patent and that said Letters Patent is hereby corrected as shown below:

In Table I:

Column 8, line 49, delete “523.759” and insert --523.750--.

Column 9, line 10, delete “20.098” and insert --30.098--.

In Table II:

Column 13, line 17, delete “412.69” and insert --412.693--.

Column 13, line 18, delete “407.46” and insert --407.464--.

Column 16, line 62, delete “~” before --545.997--.

In Table III:

Column 23, line 37, delete “-” before --1.309--.

Column 26, line 31, insert -- - -- before --1.918--.

Column 29, line 43, insert -- - -- before --1.918--.

Signed and Sealed this

Twenty-fourth Day of February, 2009

John Doll

JOHN DOLL
*Acting Director of the United States Patent and Trademark Office*